US009543665B2

(12) United States Patent
Sabo

(10) Patent No.: US 9,543,665 B2
(45) Date of Patent: Jan. 10, 2017

(54) INSULATION DISPLACEMENT CONNECTOR

(71) Applicant: FCI Americas Technology LLC, Carson City, NV (US)

(72) Inventor: James M. Sabo, Marysville, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 14/446,436

(22) Filed: Jul. 30, 2014

(65) Prior Publication Data

US 2015/0038003 A1 Feb. 5, 2015

Related U.S. Application Data

(60) Provisional application No. 61/860,085, filed on Jul. 30, 2015, provisional application No. 61/901,152, filed on Nov. 7, 2013, provisional application No. 62/000,459, filed on May 19, 2014.

(51) Int. Cl.

| | |
|---|---|
| ***H01R 4/24*** | (2006.01) |
| *H01R 12/51* | (2011.01) |
| *H01R 12/57* | (2011.01) |

(52) U.S. Cl.

CPC ..... *H01R 4/2433* (2013.01); *H01R 4/2454* (2013.01); *H01R 12/515* (2013.01); *H01R 12/57* (2013.01)

(58) Field of Classification Search

USPC ..... 439/401, 400, 397–399, 82, 394, 417

See application file for complete search history.

(56) References Cited

U.S. PATENT DOCUMENTS

| | | | | | |
|---|---|---|---|---|---|
| 3,936,128 | A | * | 2/1976 | D'Annessa et al. | 439/399 |
| 4,261,629 | A | * | 4/1981 | Reynolds et al. | 439/82 |
| 4,277,124 | A | * | 7/1981 | Loose et al. | 439/398 |
| 4,363,529 | A | * | 12/1982 | Loose | 439/82 |
| 4,533,199 | A | * | 8/1985 | Feldberg | 439/404 |
| 4,701,001 | A | * | 10/1987 | Verhoeven | 439/394 |
| 4,716,651 | A | * | 1/1988 | Klaiber et al. | 29/750 |
| 4,995,825 | A | | 2/1991 | Korsunsky et al. | |
| 5,022,868 | A | | 6/1991 | Legrady | |
| 5,562,478 | A | * | 10/1996 | Yamamoto | 439/402 |
| 5,586,905 | A | * | 12/1996 | Marshall et al. | 439/463 |
| 5,669,778 | A | * | 9/1997 | Kramer et al. | 439/398 |
| 5,807,121 | A | * | 9/1998 | Fulop et al. | 439/82 |
| 5,820,404 | A | * | 10/1998 | Chishima et al. | 439/417 |
| 6,074,238 | A | * | 6/2000 | DeRoss et al. | 439/409 |
| 6,394,833 | B1 | * | 5/2002 | Bulmer et al. | 439/393 |
| 6,443,752 | B1 | | 9/2002 | Kosawa | |
| 6,554,633 | B1 | | 4/2003 | Nobuyuki et al. | |
| D516,521 | S | | 3/2006 | Yao et al. | |
| 7,059,889 | B1 | * | 6/2006 | Pavlovic et al. | 439/397 |
| 7,134,903 | B1 | * | 11/2006 | Pavlovic | 439/404 |

(Continued)

FOREIGN PATENT DOCUMENTS

| | | |
|---|---|---|
| JP | 2001/266972 | 9/2001 |
| KR | 10-1987-0000780 | 2/1987 |

*Primary Examiner* — Alexander Gilman

(74) *Attorney, Agent, or Firm* — Wolf, Greenfield & Sacks, P.C.

(57) ABSTRACT

An insulation displacement contact includes a monolithic electrically conductive contact body that includes mating portion and a mounting portion. The mating portion defines a pair of insulation displacement slots configured to receive an electrical cable delivered by a connector housing.

28 Claims, 53 Drawing Sheets

(56) References Cited

U.S. PATENT DOCUMENTS

| | | | | |
|---|---|---|---|---|
| D555,092 | S | 11/2007 | Li et al. | |
| D569,801 | S | 5/2008 | Chuang | |
| D569,802 | S | 5/2008 | Long et al. | |
| D645,827 | S | 9/2011 | Lee et al. | |
| D688,246 | S | 8/2013 | Lee | |
| 2002/0192997 | A1 | 12/2002 | Turek et al. | |
| 2004/0185703 | A1* | 9/2004 | Lee | 439/417 |
| 2007/0082539 | A1 | 4/2007 | Pavlovic | |
| 2008/0286991 | A1 | 11/2008 | Northey | |
| 2010/0203752 | A1 | 8/2010 | Urano | |
| 2012/0052733 | A1 | 3/2012 | Zhu | |
| 2012/0171909 | A1 | 7/2012 | Harada | |
| 2013/0225013 | A1 | 8/2013 | Peng | |
| 2015/0038003 | A1 | 2/2015 | Sabo | |

* cited by examiner

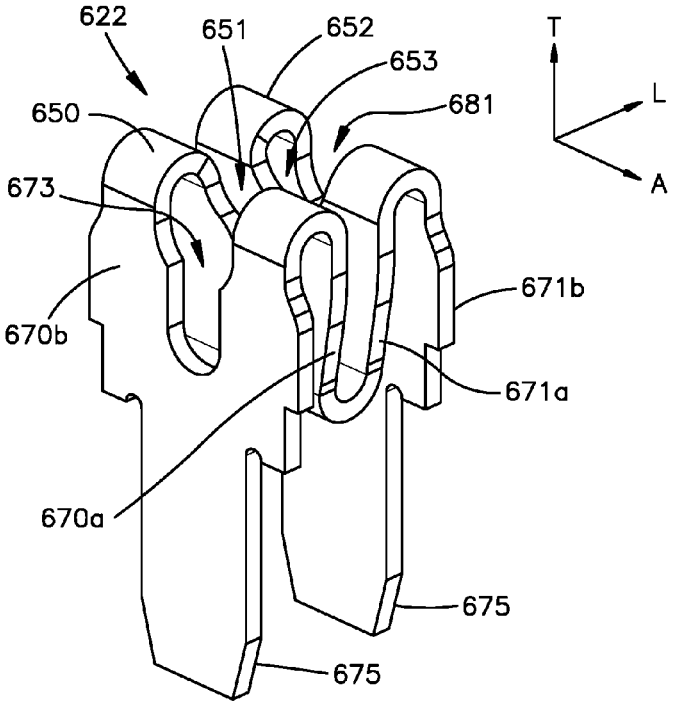
Fig.8A
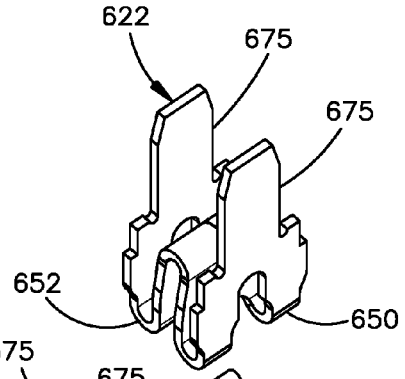
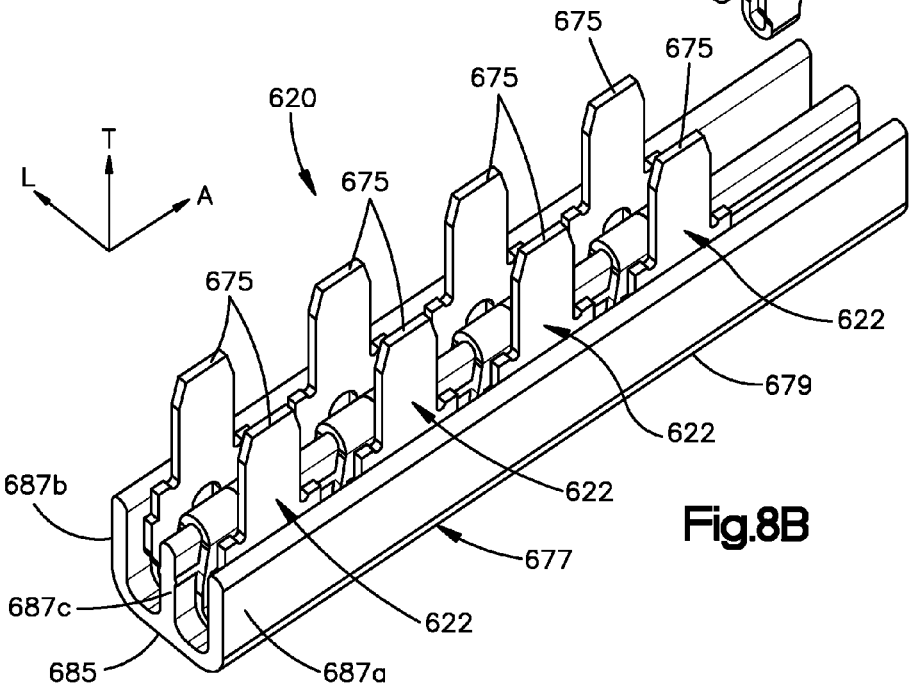
Fig.8B

INSULATION DISPLACEMENT CONNECTOR

CROSS-REFERENCE TO RELATED APPLICATIONS

This claims priority to U.S. Patent Application Ser. No. 61/860,085 filed Jul. 30, 2013, U.S. Patent Application Ser. No. 61/901,152 filed Nov. 7, 2013, and U.S. Patent Application Ser. No. 62/000,459 filed May 19, 2014, the disclosure of each of which is hereby incorporated by reference as if set forth in its entirety herein.

BACKGROUND

Insulation displacement connectors (IDCs) are configured to electrically connect one or more electrical cables to a complementary electrical component, such as a printed circuit board. For instance, insulation displacement connectors include at least one insulation displacement contact having a mating portion configured to be mate with the complementary electrical component, and a cable piercing end that is configured to at least partially receive an electrical cable. Electrical cables typically include at least one electrically insulative layer and an electrical conductor that is disposed inside the electrically insulative layer. The insulation displacement contact of the insulation displacement connector is configured to pierce the outer layer of insulation of the electrical cable so as to make contact with the electrical conductor, thereby placing the electrical conductor in electrical communication with the complementary electrical component. Insulation displacement connectors can be desirable, as they allow for connection to an insulated cable without first stripping the electrical insulation from the conductor.

SUMMARY

In accordance with one embodiment, an insulation displacement contact, includes a mounting portion configured to mounted onto a substrate so as to place the insulation displacement contact in electrical communication with the substrate. The insulation displacement contact can further include a first arm that extends out with respect to the mounting portion, the first arm defining a first insulation displacement slot. The insulation displacement contact can further include a second arm that extends out with respect to the mounting portion, the second arm defining a second insulation displacement slot. The first and second insulation displacement slots can be aligned with each other along a longitudinal direction so that when an electrical cable extends through the both insulation displacement slots along the longitudinal direction, respective first and second piercing members that at least partially define respective ones of the first and second insulation displacement slots pierce an outer electrically insulative layer of the electrical cable and contact an electrical conductor of the electrical cable that is disposed inside the electrically insulative layer.

BRIEF DESCRIPTION OF THE DRAWINGS

The foregoing summary, as well as the following detailed description of example embodiments of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

Figure 5A:
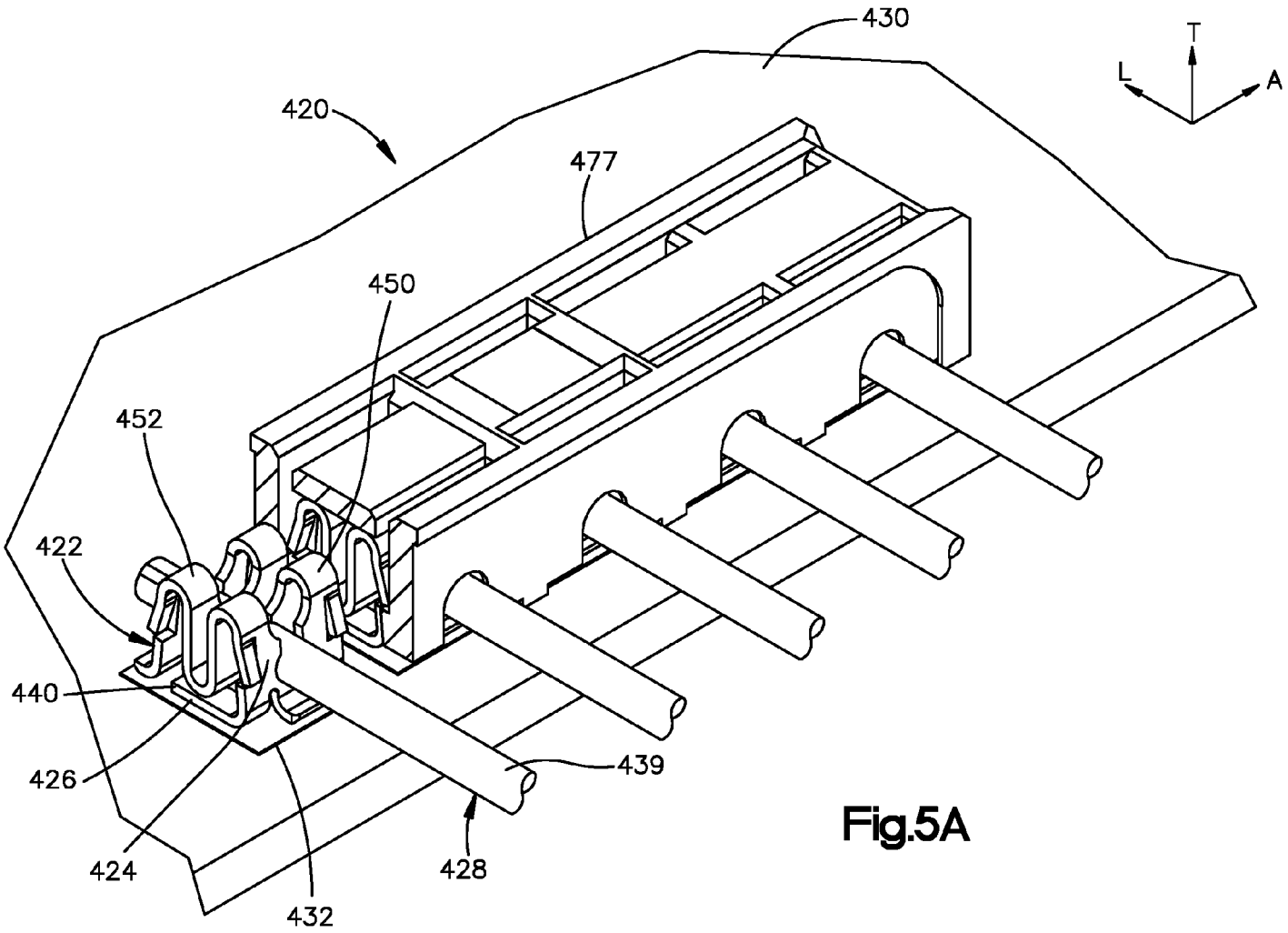
FIG. 5A is a perspective view of an electrical connector assembly constructed in accordance with another embodiment, including a printed circuit board, a plurality of cables, an insulation displacement contact configured to be mounted to the printed circuit board, and a connector housing that retains the cables, the connector housing configured to attach the cables to the insulation displacement contact.
Figure 5B:
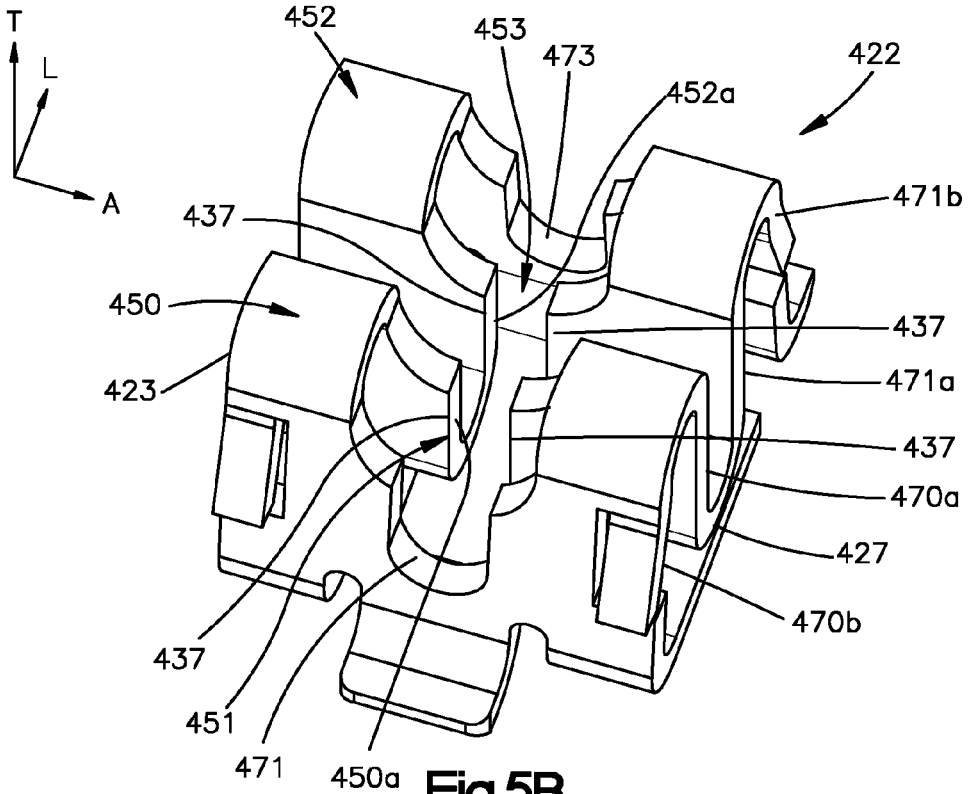
FIG. 5B is a perspective view of an insulation displacement contact illustrated in FIG. 5A.
Figure 5C:
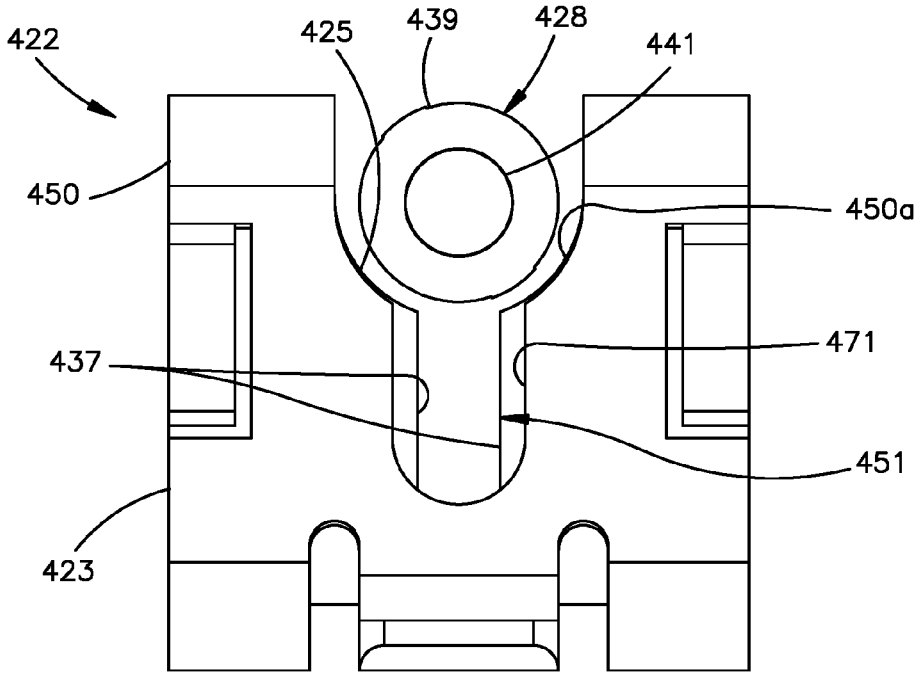
FIG. 5C is an end elevation view of the insulation displacement contact as illustrated in FIG. 5B, showing insertion of a respective electrical cable into the insulation displacement contact.
Figure 5D:
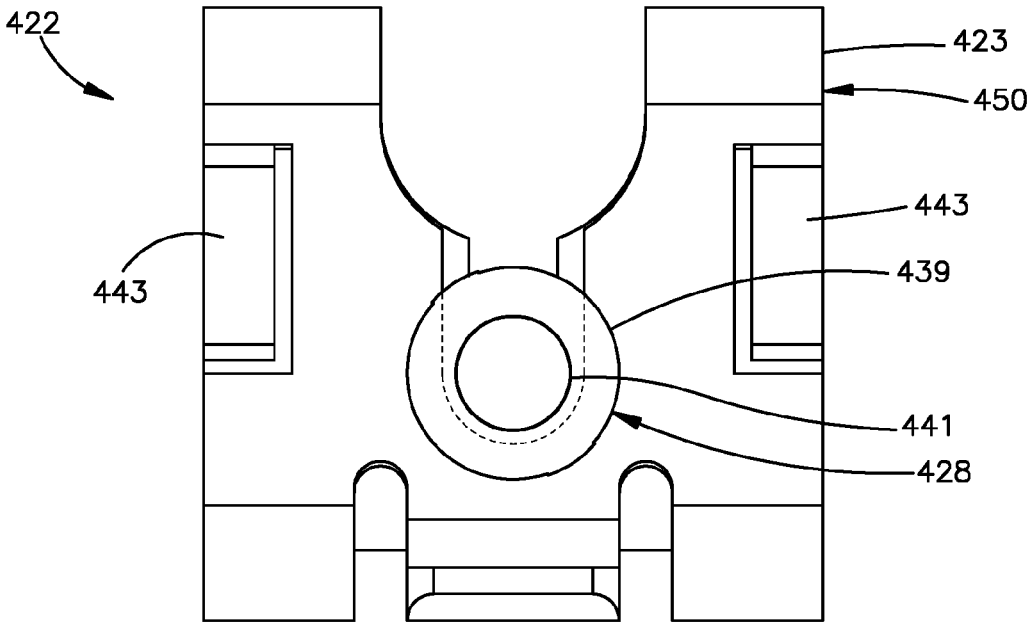
FIG. 5D is an end elevation view of the insulation displacement contact illustrated in FIG. 5C, showing the electrical cable fully attached to the insulation displacement contact.
Figure 5E:
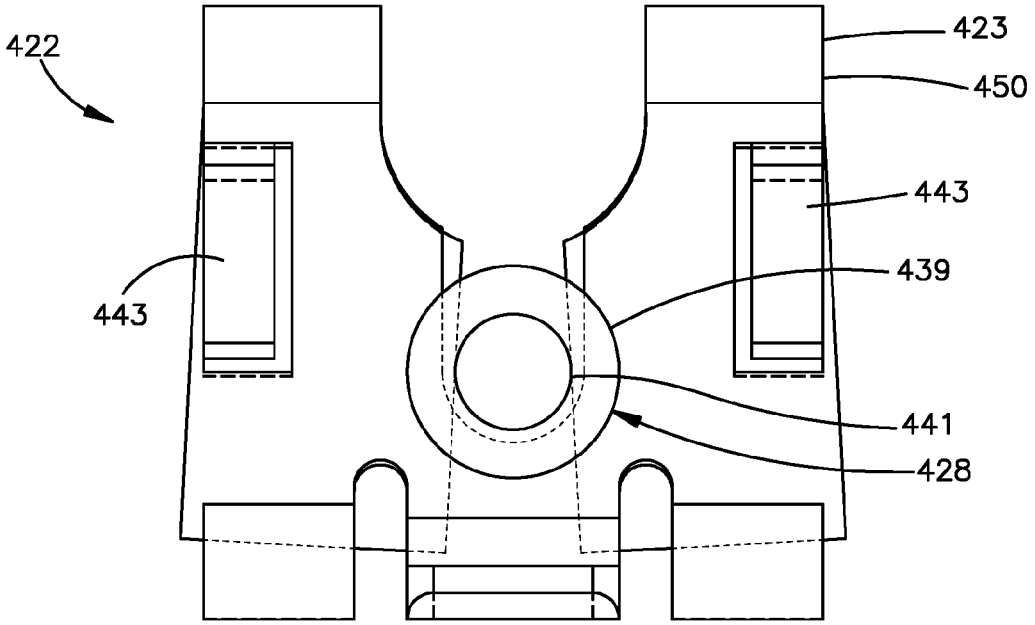
FIG. 5E is another end elevation view of the insulation displacement contact illustrated in FIG. 5D.
Figure 5F:
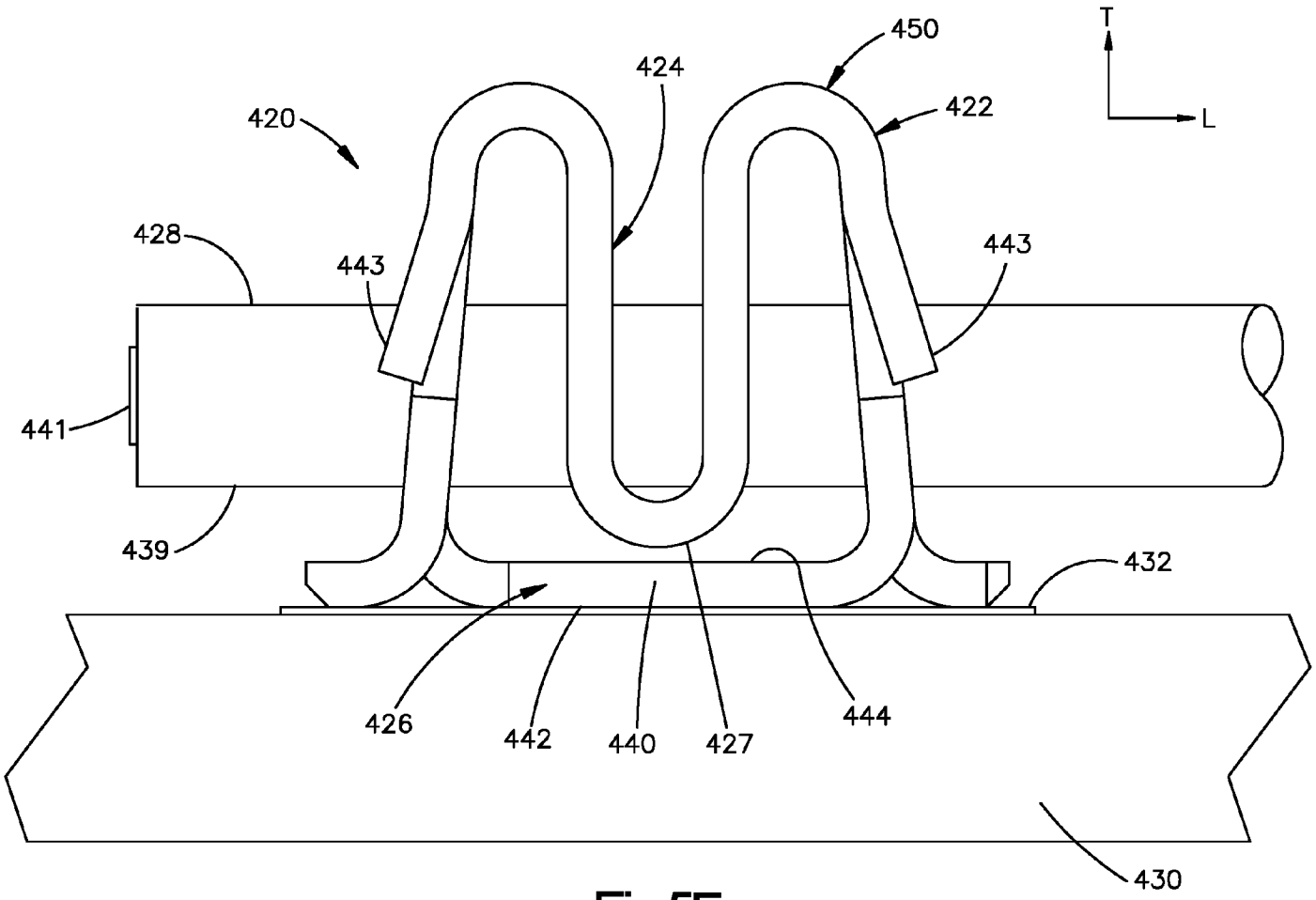
FIG. 5F is a side elevation view of the insulation displacement contact illustrated in FIG. 5E.
Figures 5G, 5H, 5I:
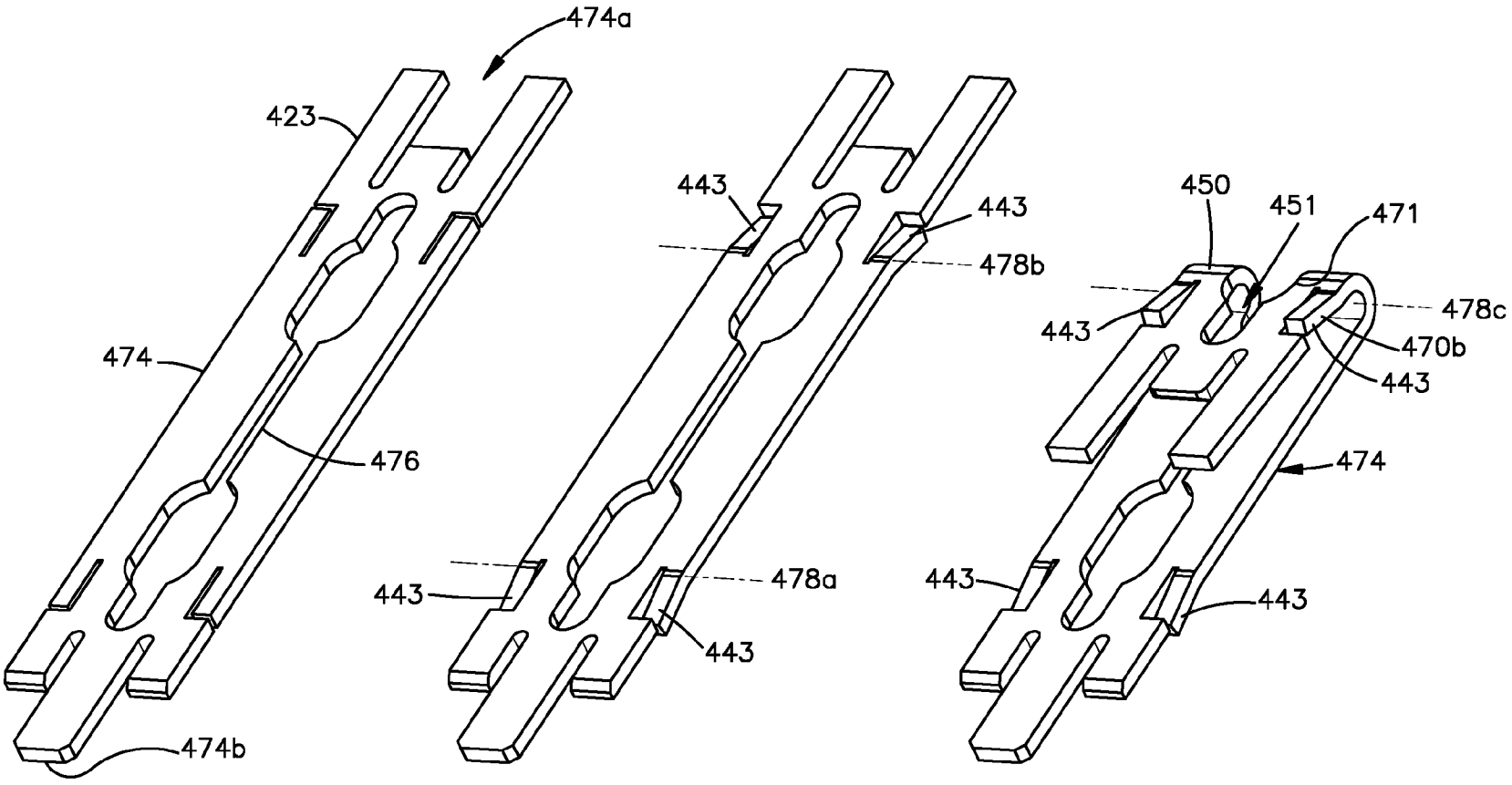
FIG. 5G is a perspective view of a blank of sheet metal that is configured to be bent to construct the insulation displacement contact illustrated in FIG. 5B.
FIG. 5H is a perspective view of the sheet metal illustrated in FIG. 5G, bent to show a first stage in forming of the insulation displacement contact illustrated in FIG. 5B.
FIG. 5I is a perspective view of the sheet metal illustrated in FIG. 5H, further bent to show another stage in forming of the insulation displacement contact illustrated in FIG. 5B.
Figure 5L:
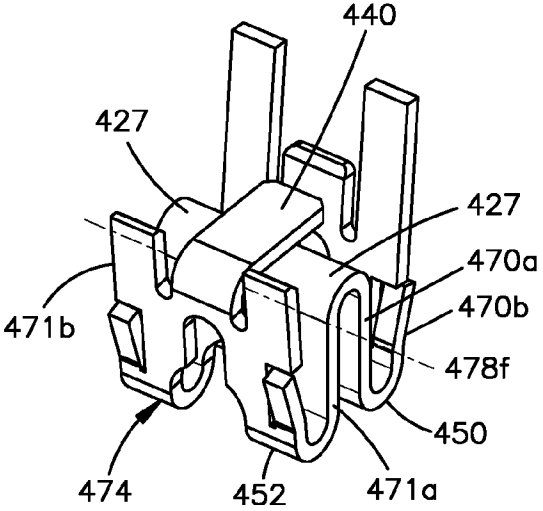
FIG. 5L is a perspective view of the sheet metal illustrated in FIG. 5K, further bent to show another stage in forming of the insulation displacement contact illustrated in FIG. 5B.
Figure 5K:
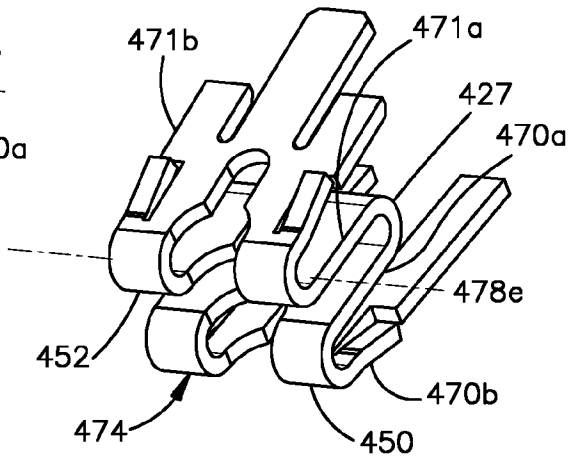
FIG. 5K is a perspective view of the sheet metal illustrated in FIG. 5J, further bent to show another stage in forming of the insulation displacement contact illustrated in FIG. 5B.
Figure 5J:
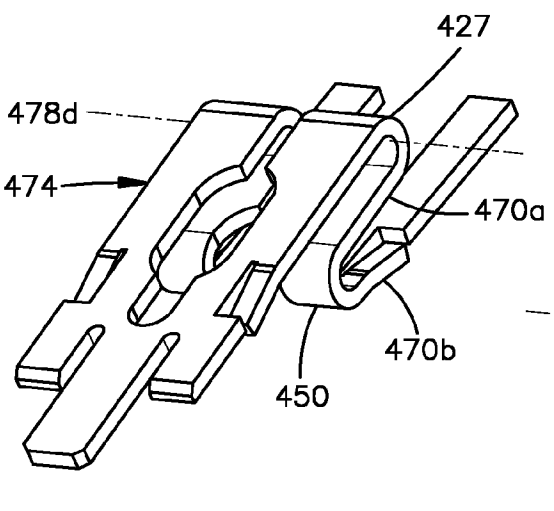
FIG. 5J is a perspective view of the sheet metal illustrated in FIG. 5I, further bent to show another stage in forming of the insulation displacement contact illustrated in FIG. 5B.
Figure 5N:
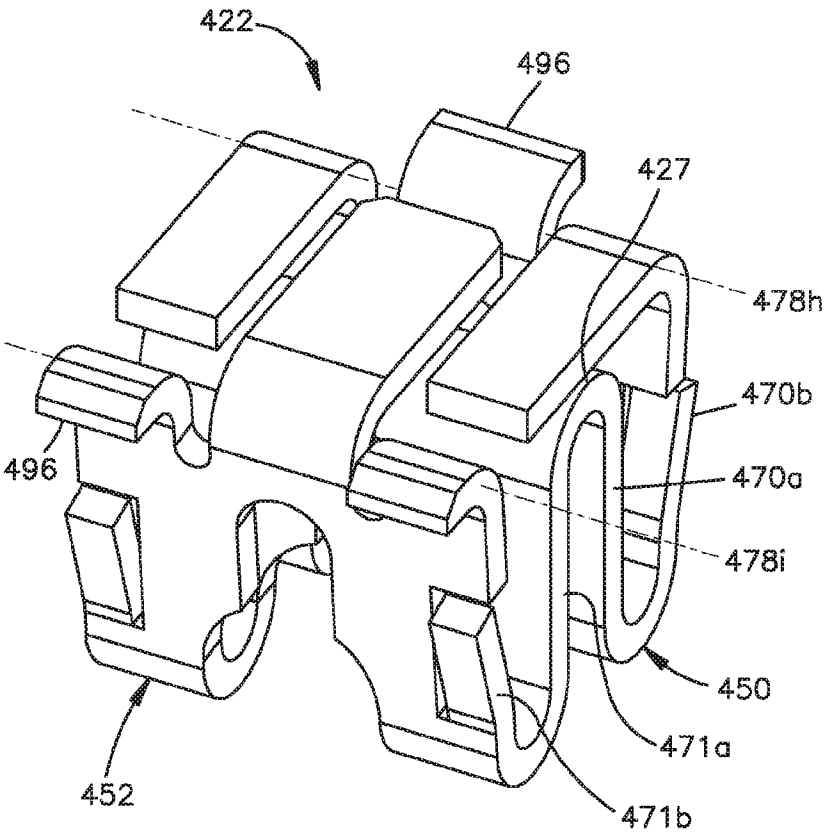
FIG. 5N is a perspective view of the sheet metal illustrated in FIG. 5M, further bent to show the insulation displacement contact illustrated in FIG. 5B.
Figure 5M:
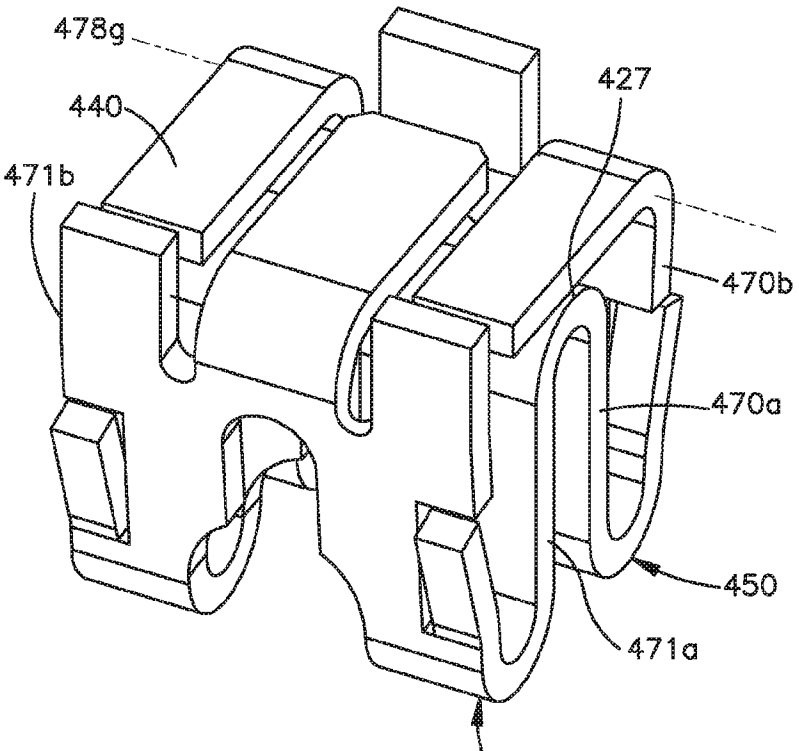
FIG. 5M is a perspective view of the sheet metal illustrated in FIG. 5L, further bent to show another stage in forming of the insulation displacement contact illustrated in FIG. 5B.
Figure 50:
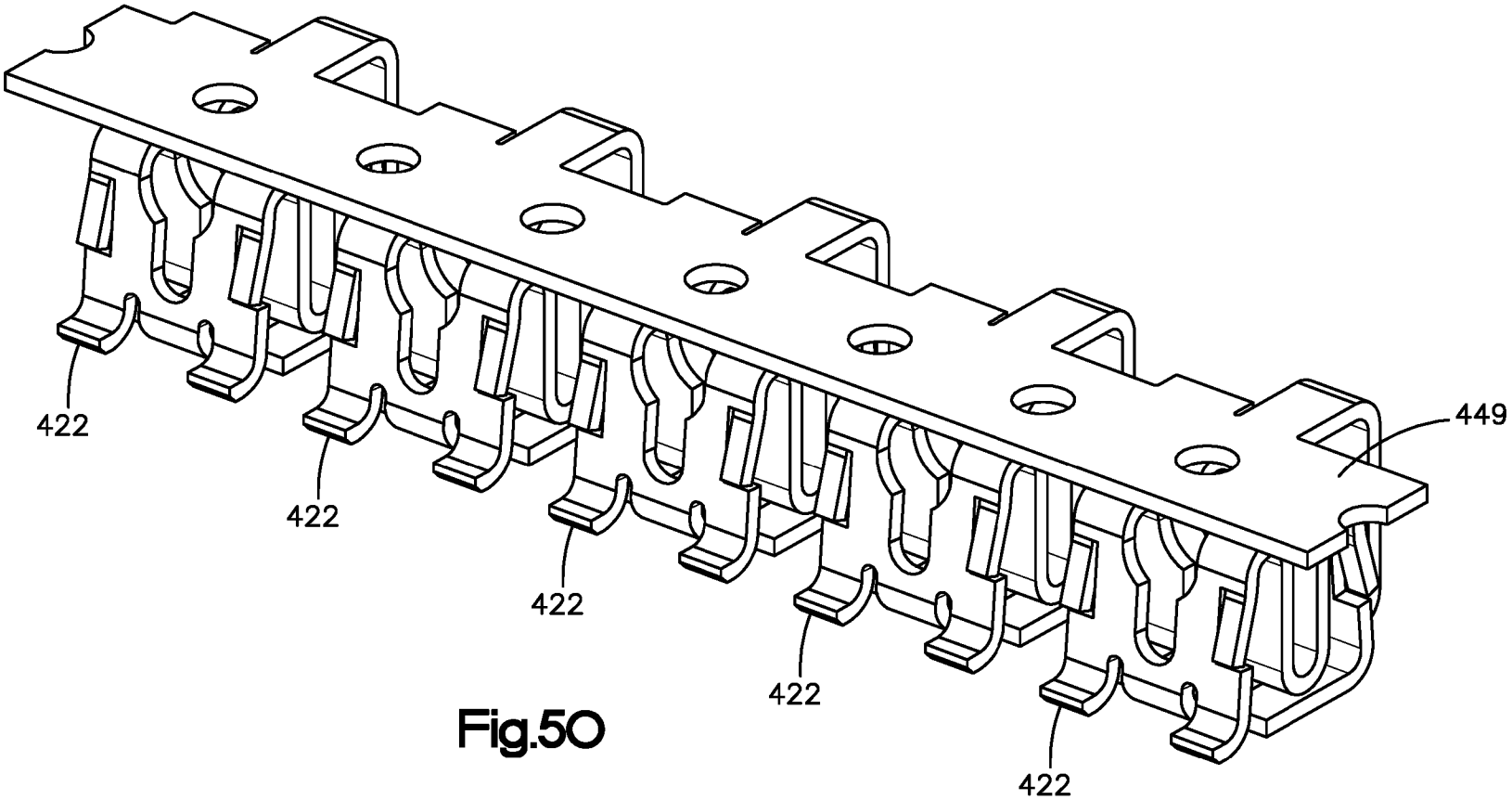
Figure 5P:
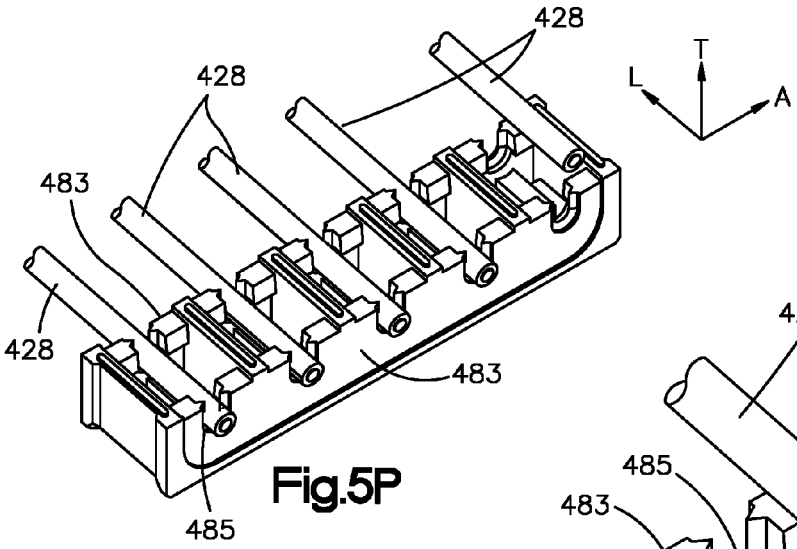
FIG. 5P is a perspective view of the connector housing illustrated in FIG. 5A, shown retaining the electrical cables.
Figure 5Q:
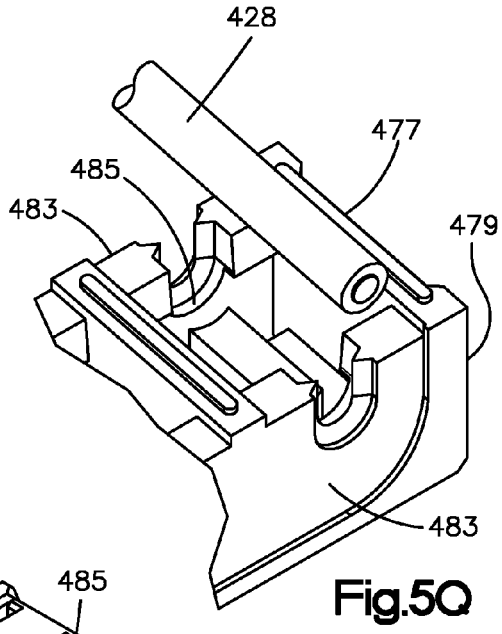
FIG. 5Q is an enlarged perspective view of a portion of the connector housing illustrated in FIG. 5P.
Figure 5R:
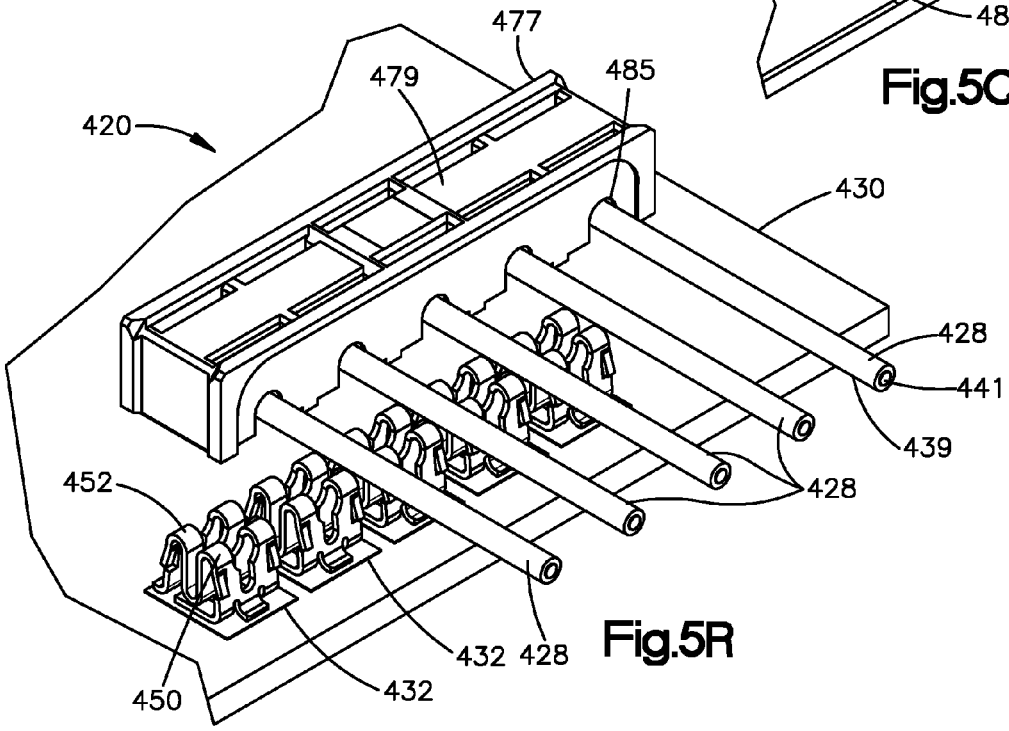
FIG. 5R is a perspective view of the connector housing shown retaining the electrical cables as illustrated in FIG.
Figures 5S, 5T:
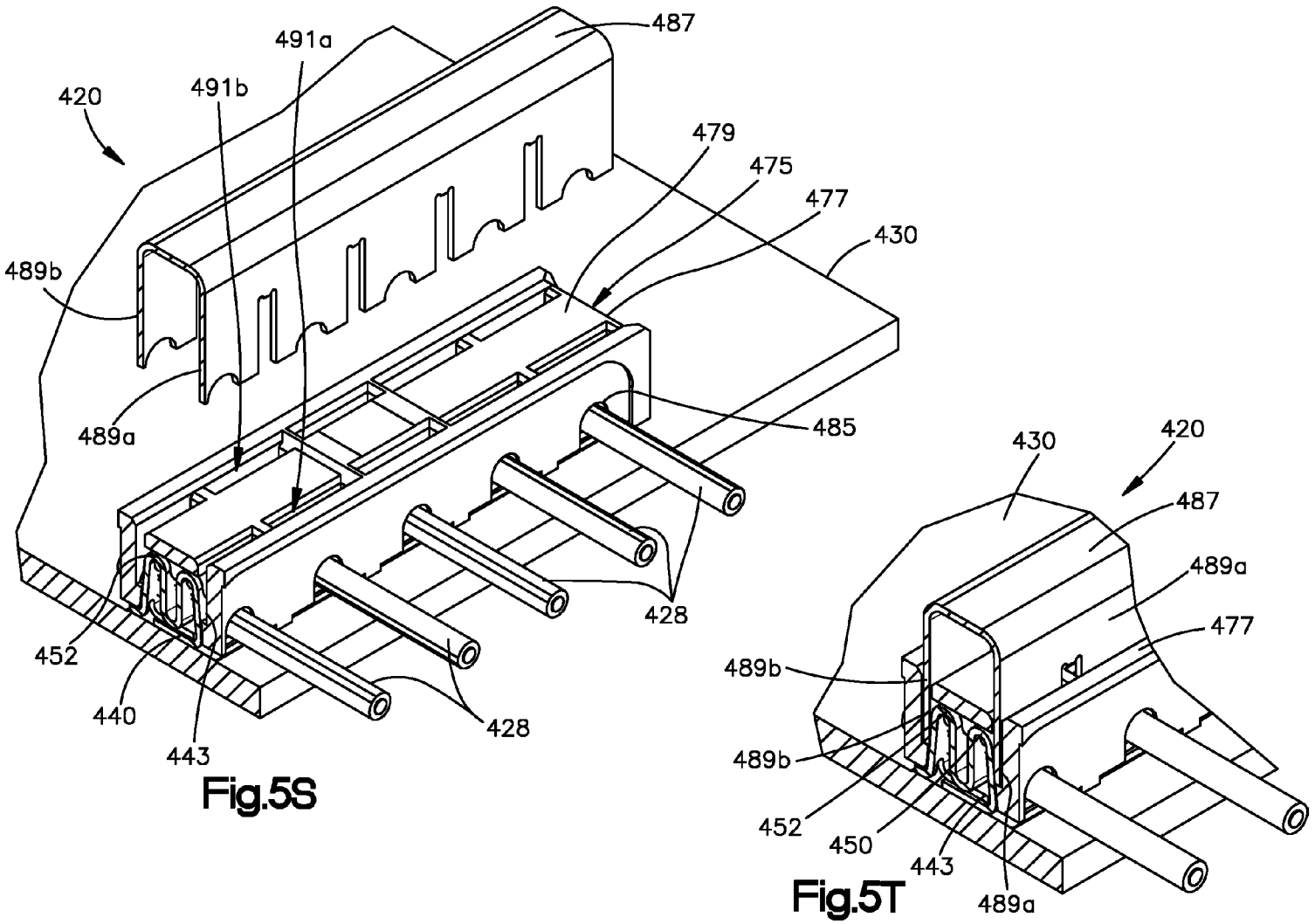
FIG. 5O is a perspective view of a plurality of insulation displacement contacts as illustrated in FIG. 5N, shown supported by a common carrier strip.
Figure 6A:
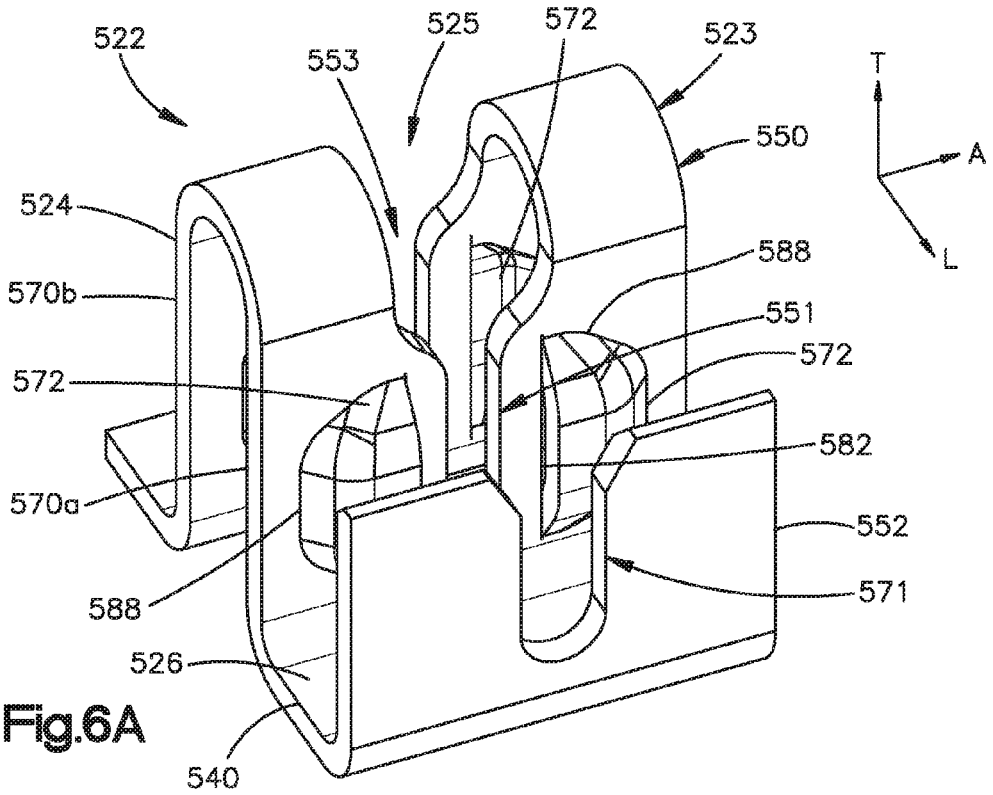
Figure 6B:
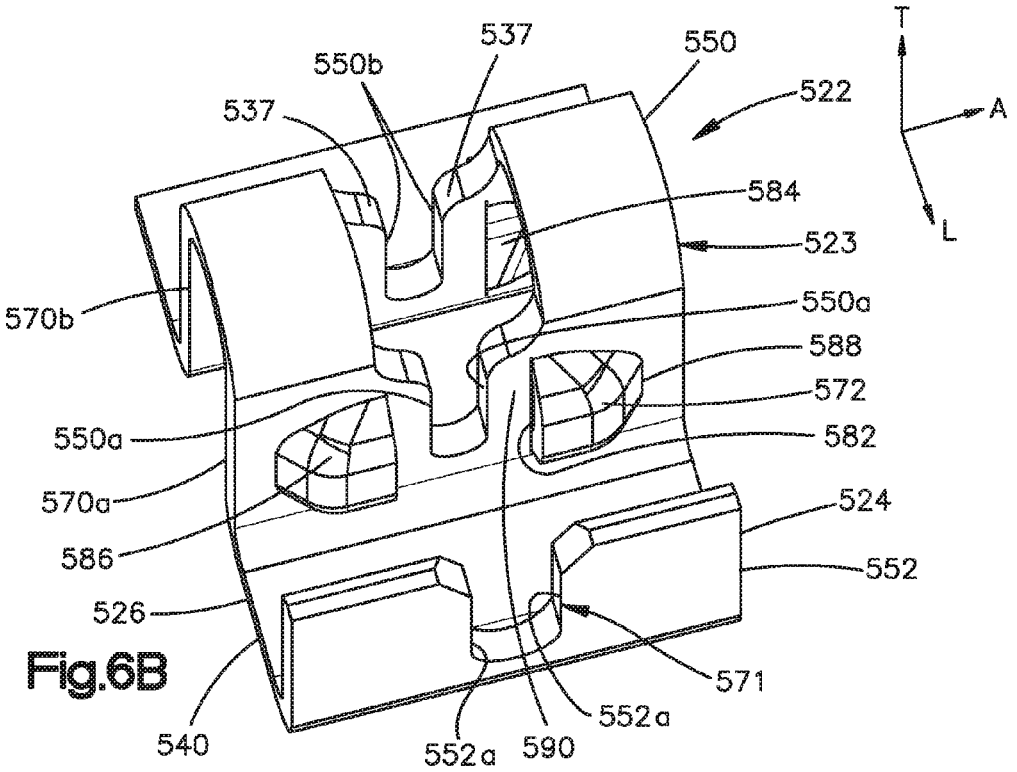
Figure 6C:
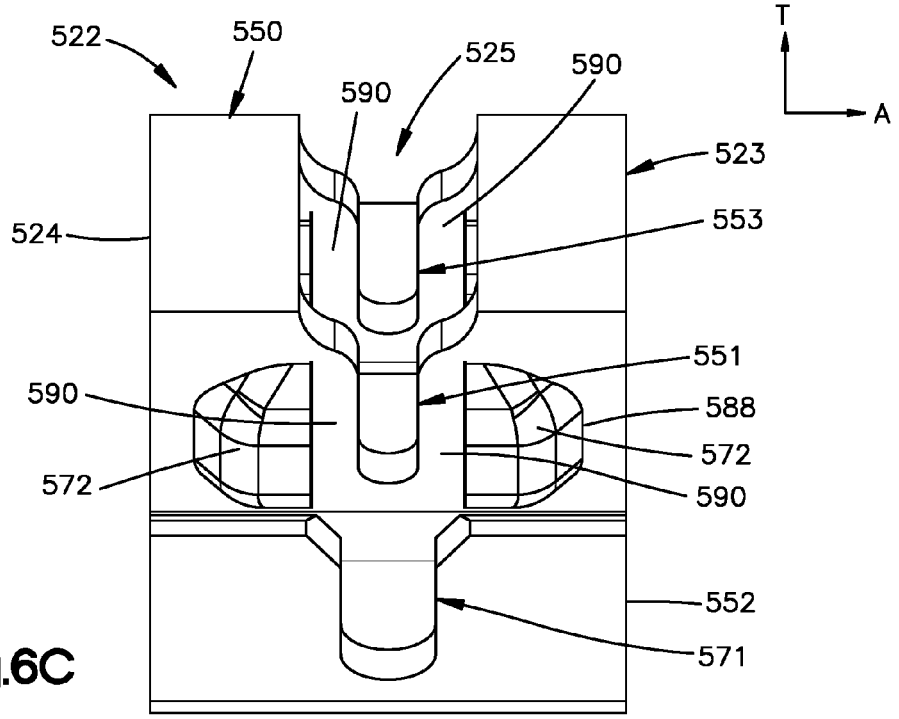
Figure 6D:
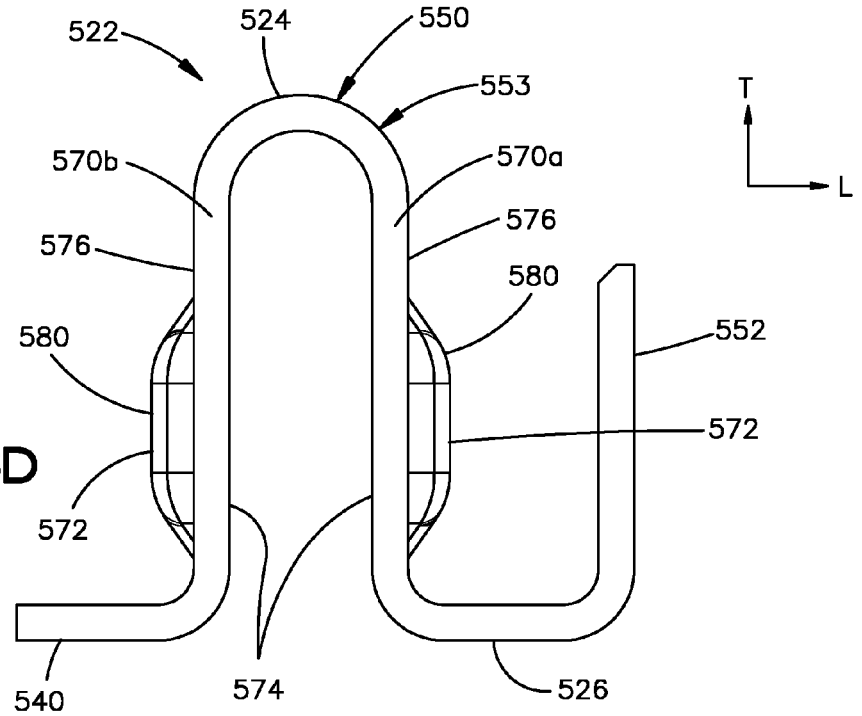
Figure 6E:
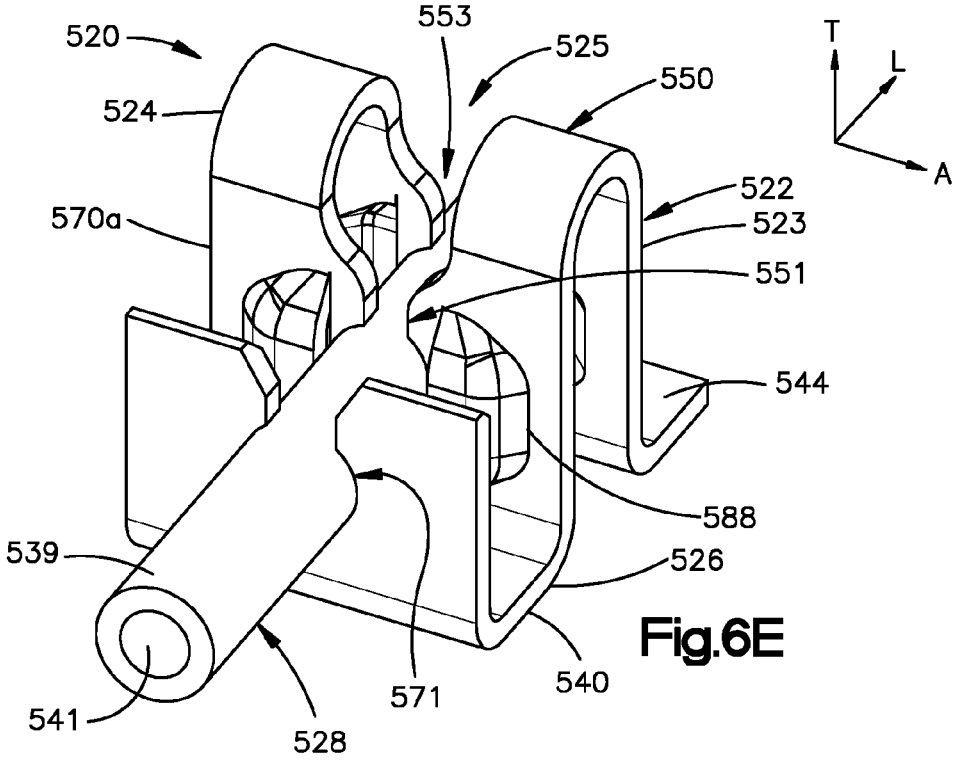
Figure 6F:
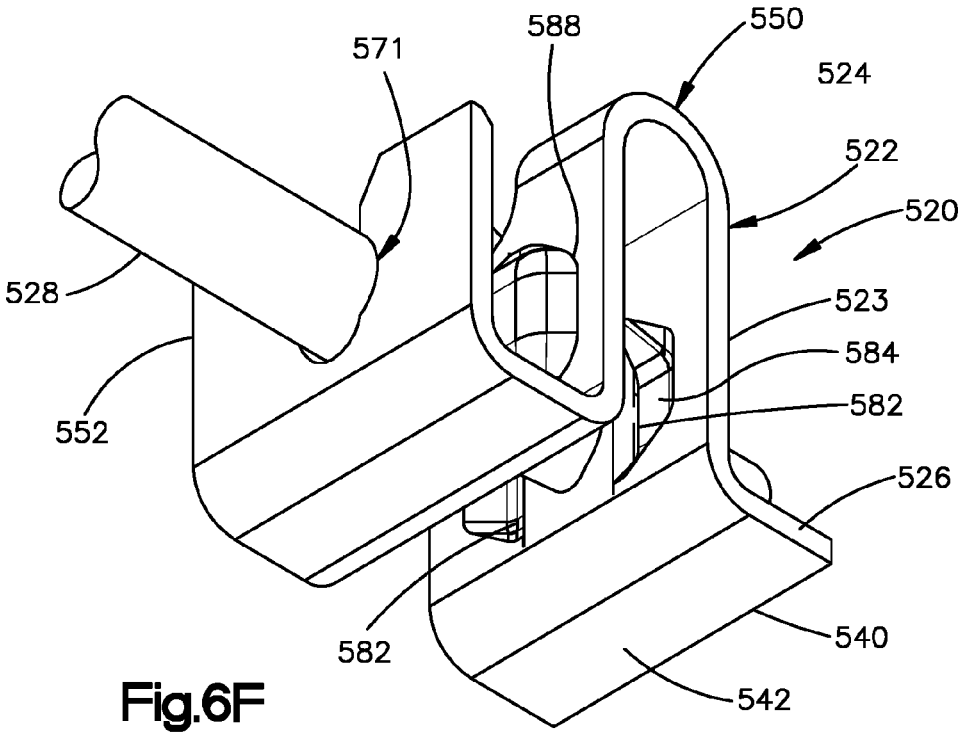
Figure 6G:
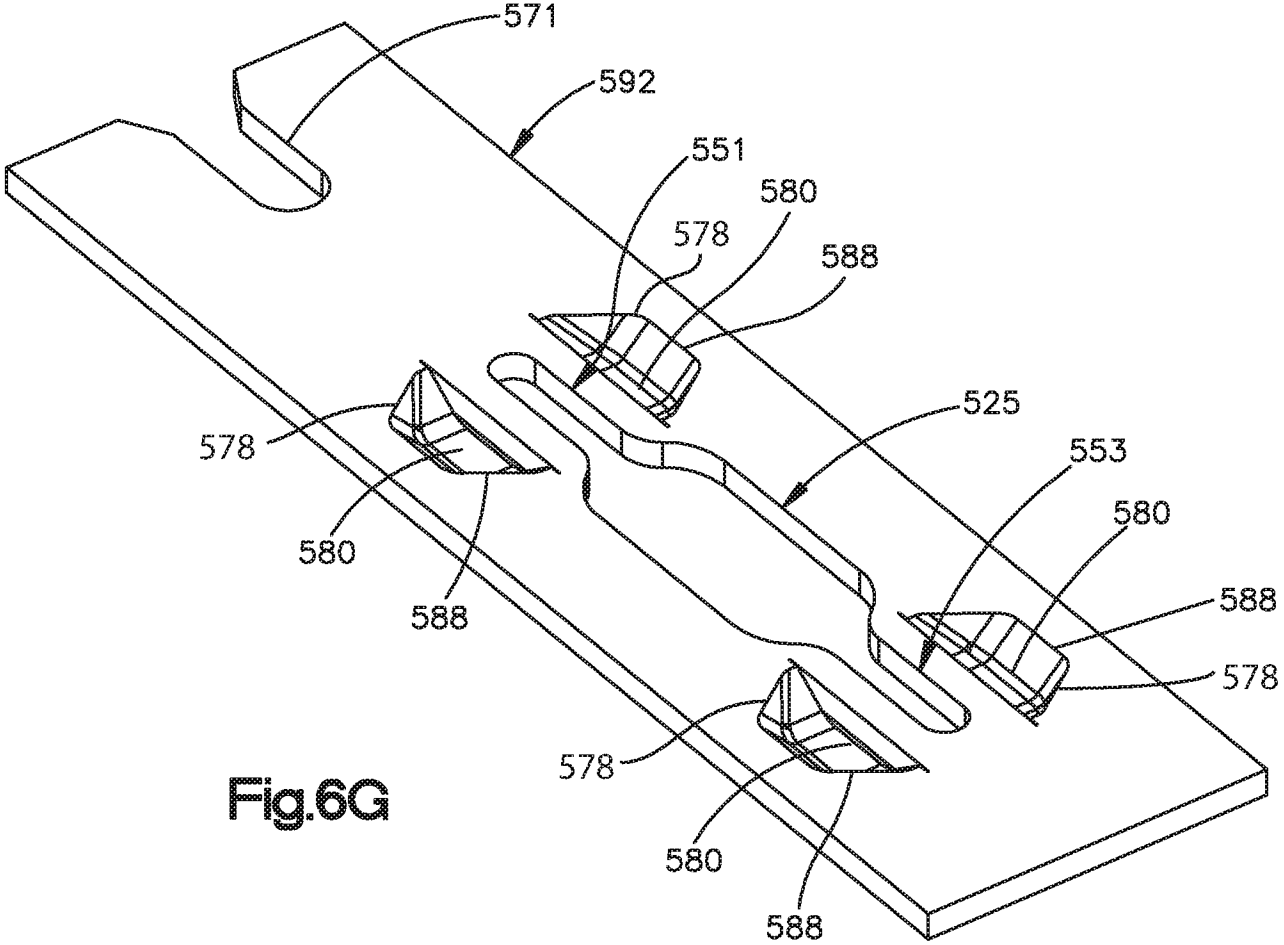
Figure 7A:
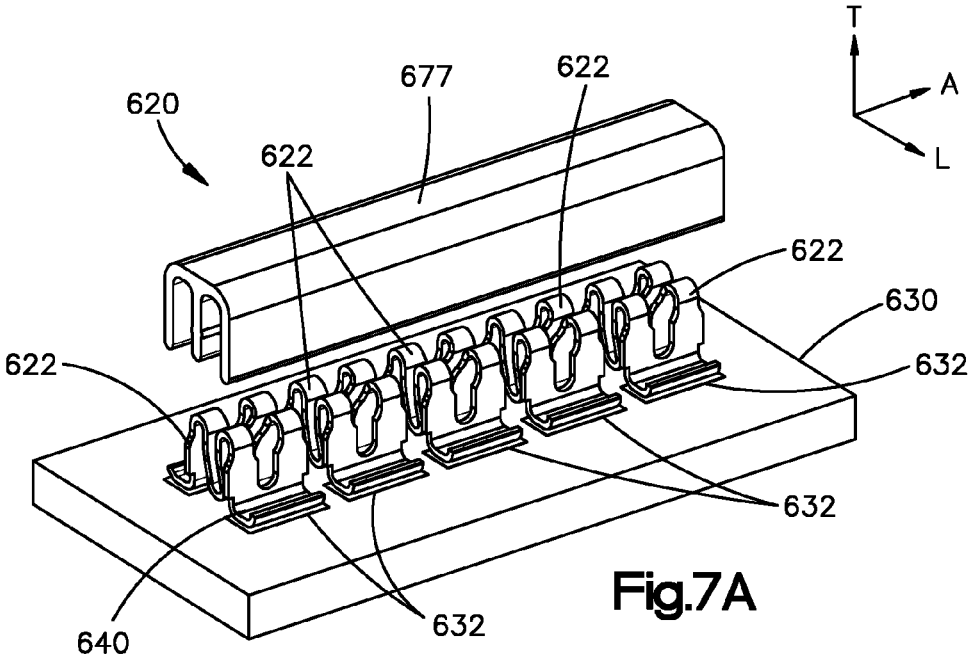
Figure 7B:
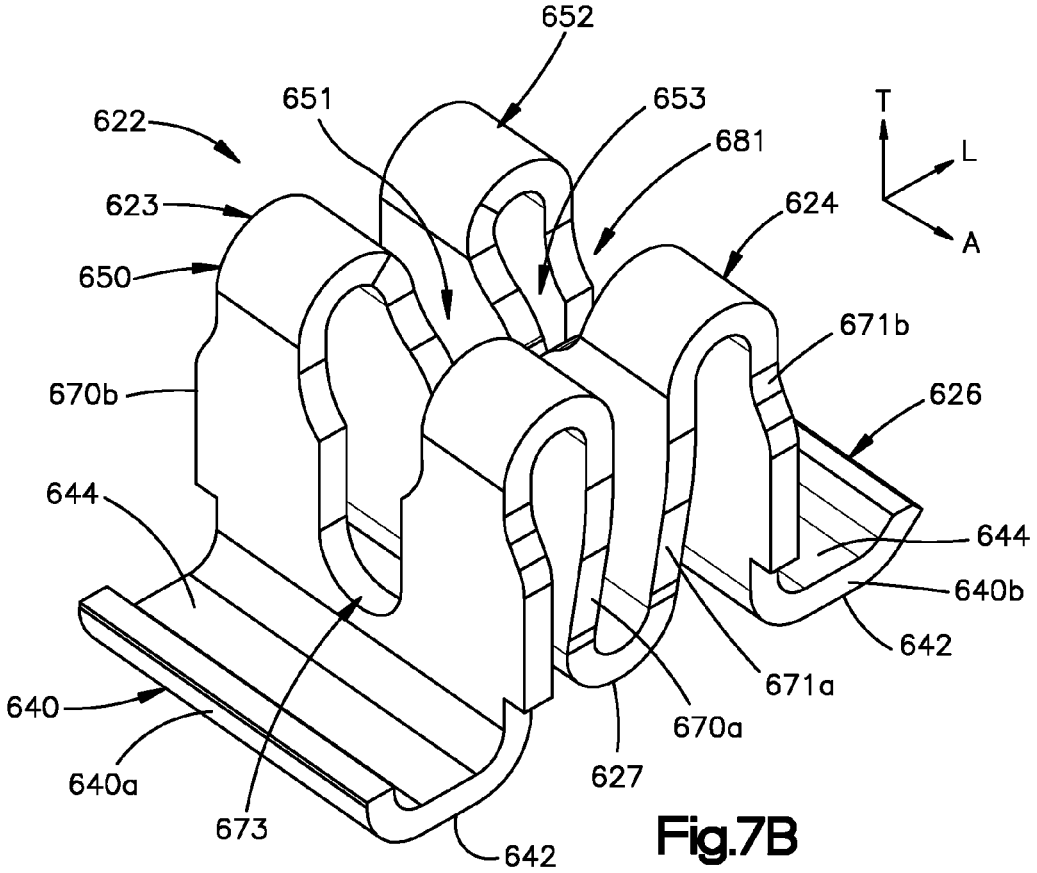
Figure 7C:
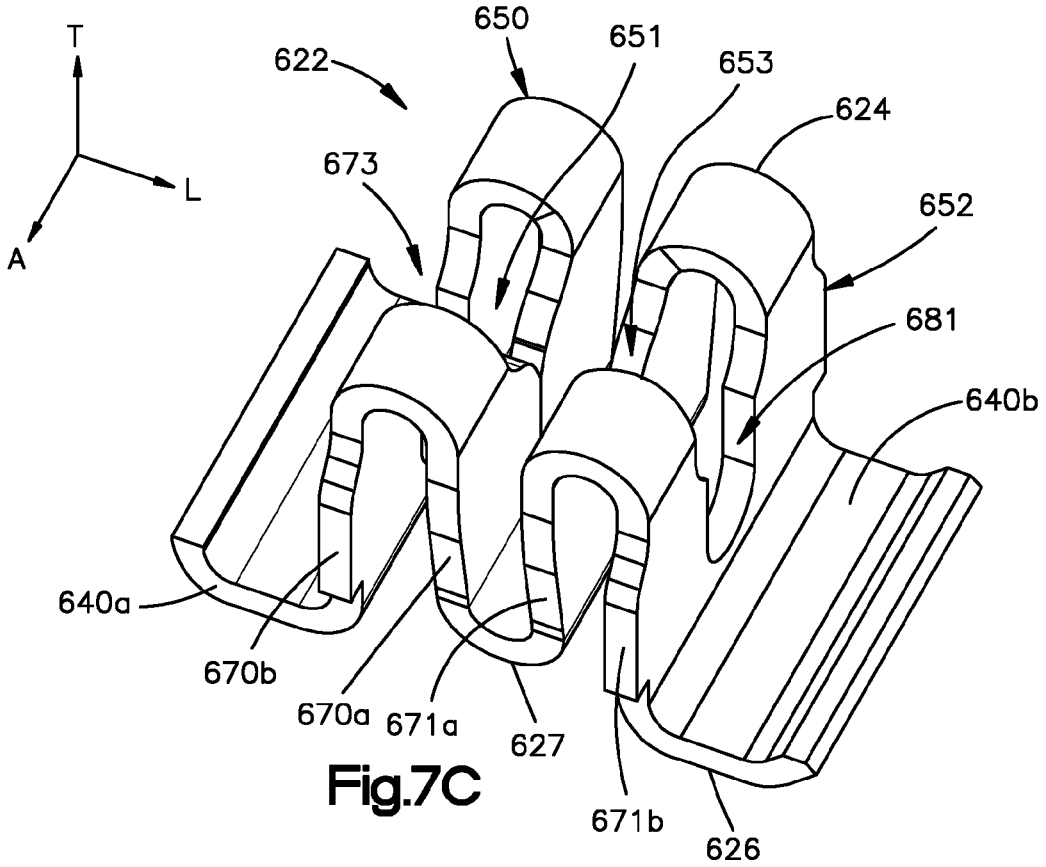
Figure 7D:
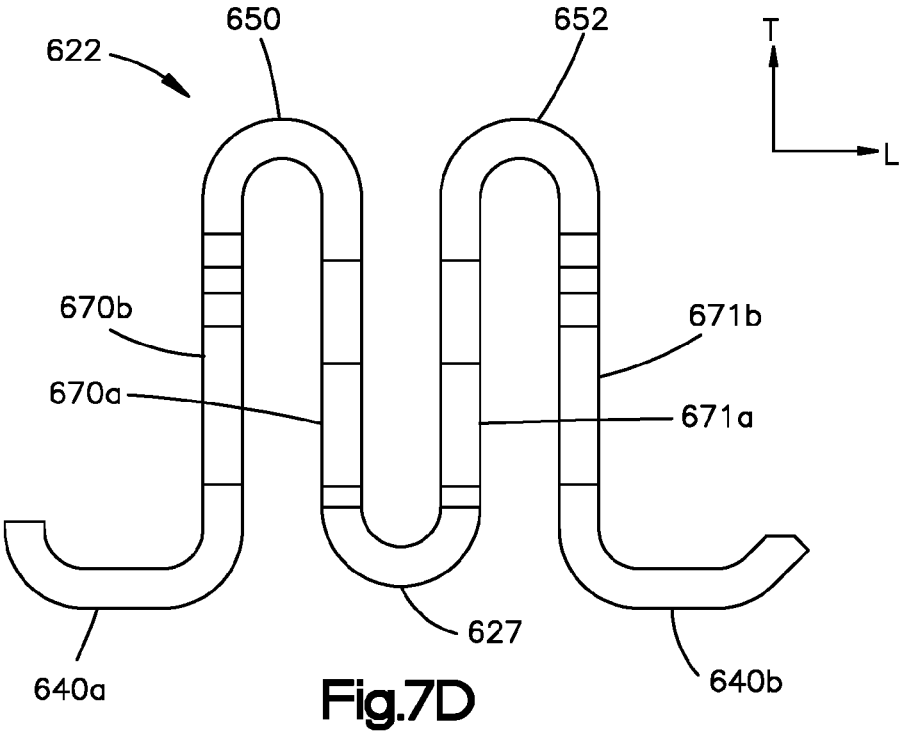
Figure 7E:
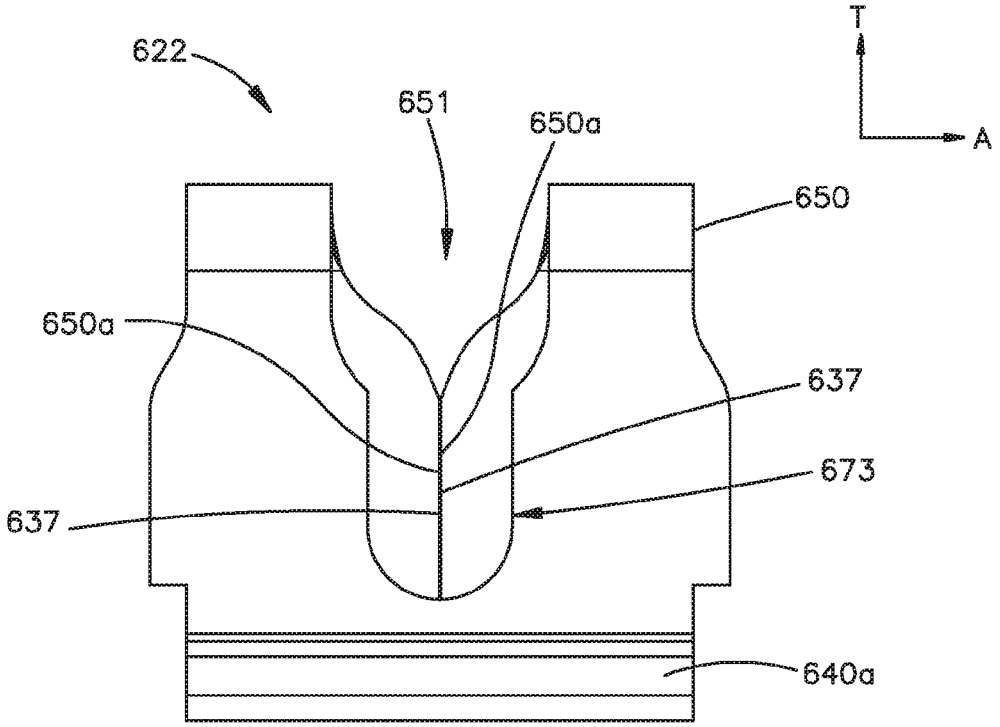
Figure 7F:
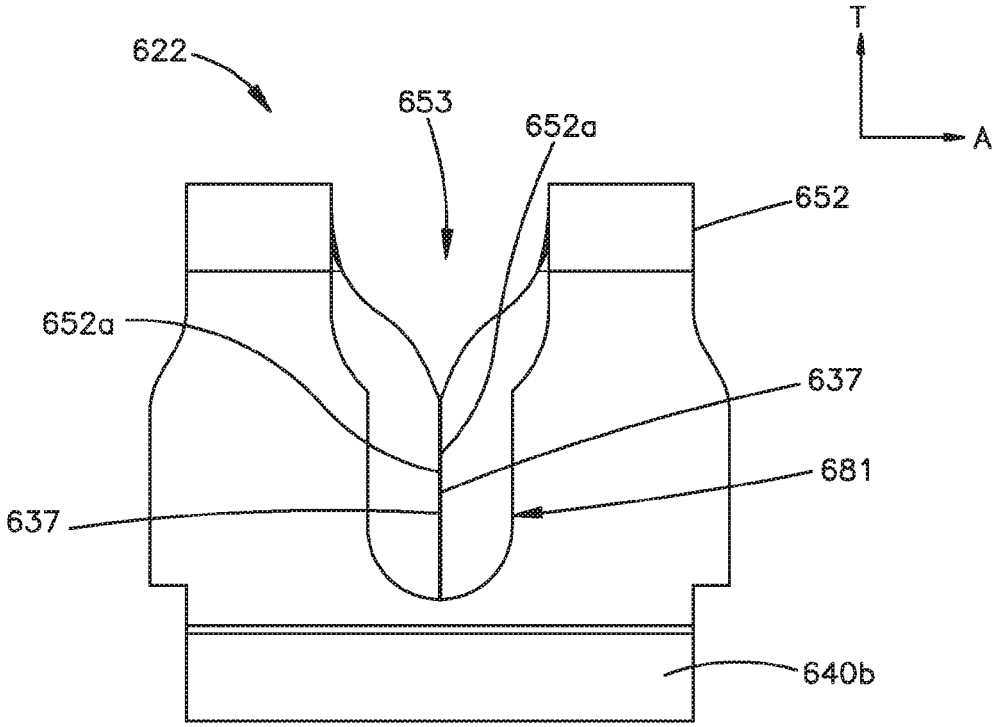
Figure 7G:
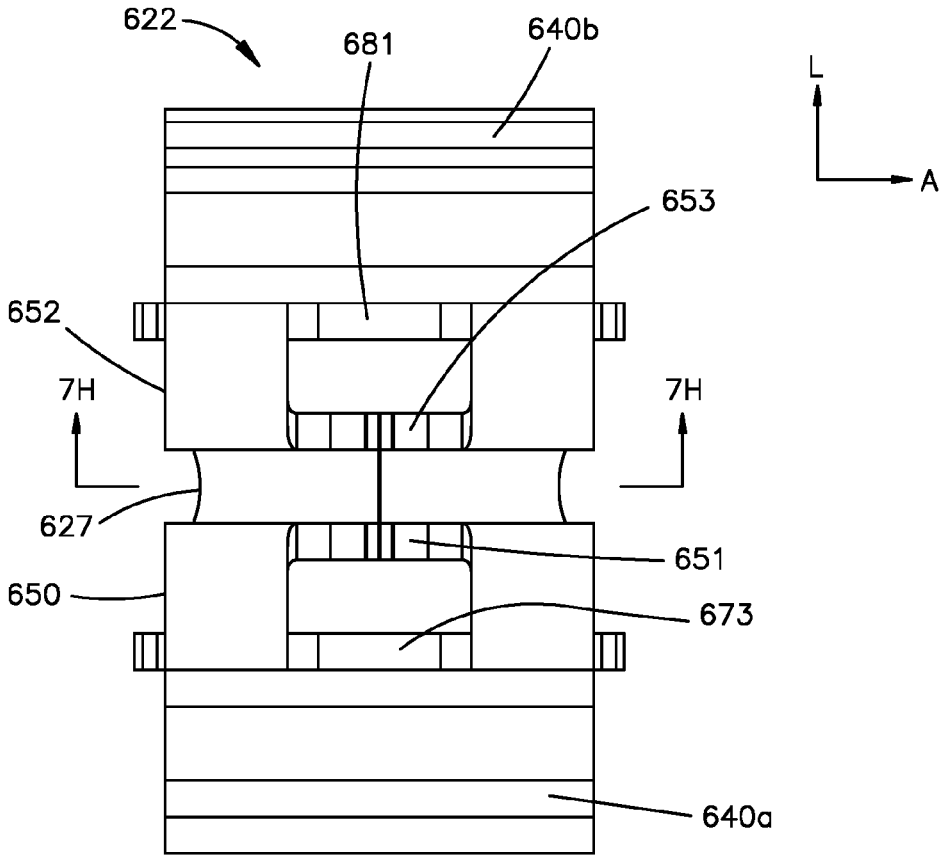
Figure 7H:
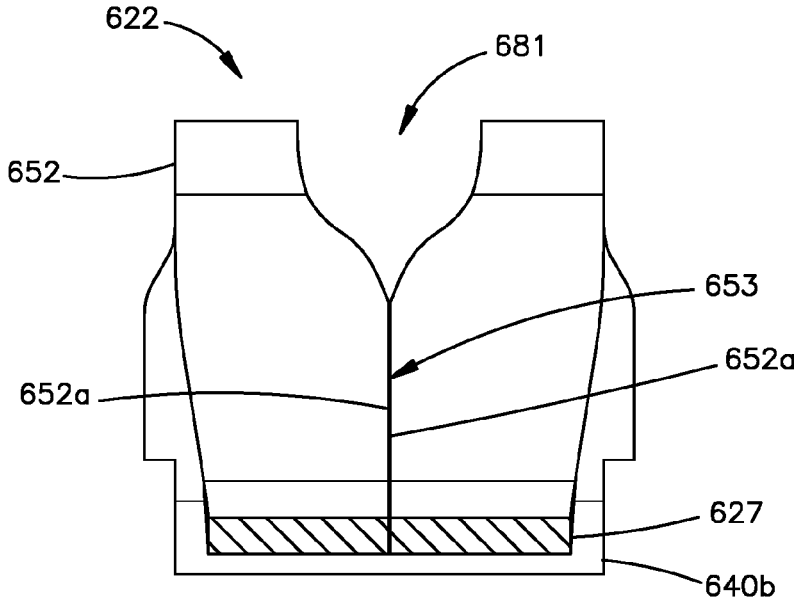
Figure 7I:
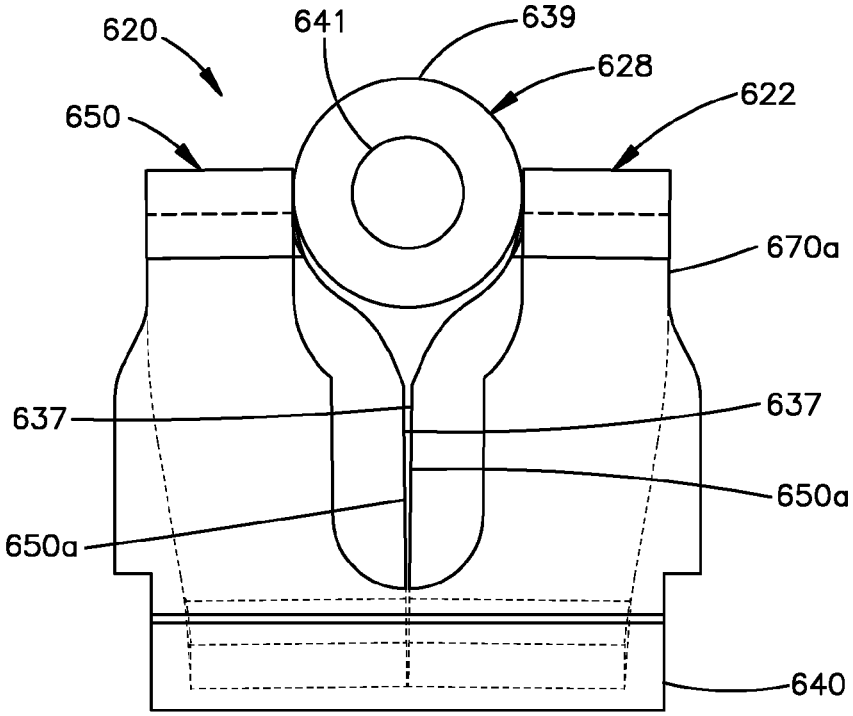
Figure 7J:
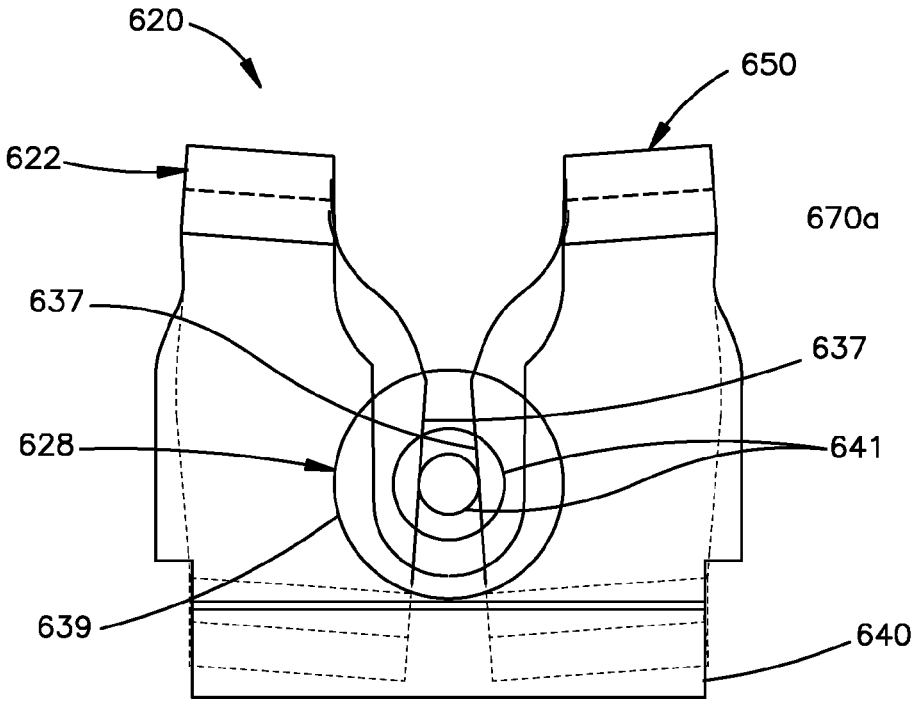
Figure 7K:
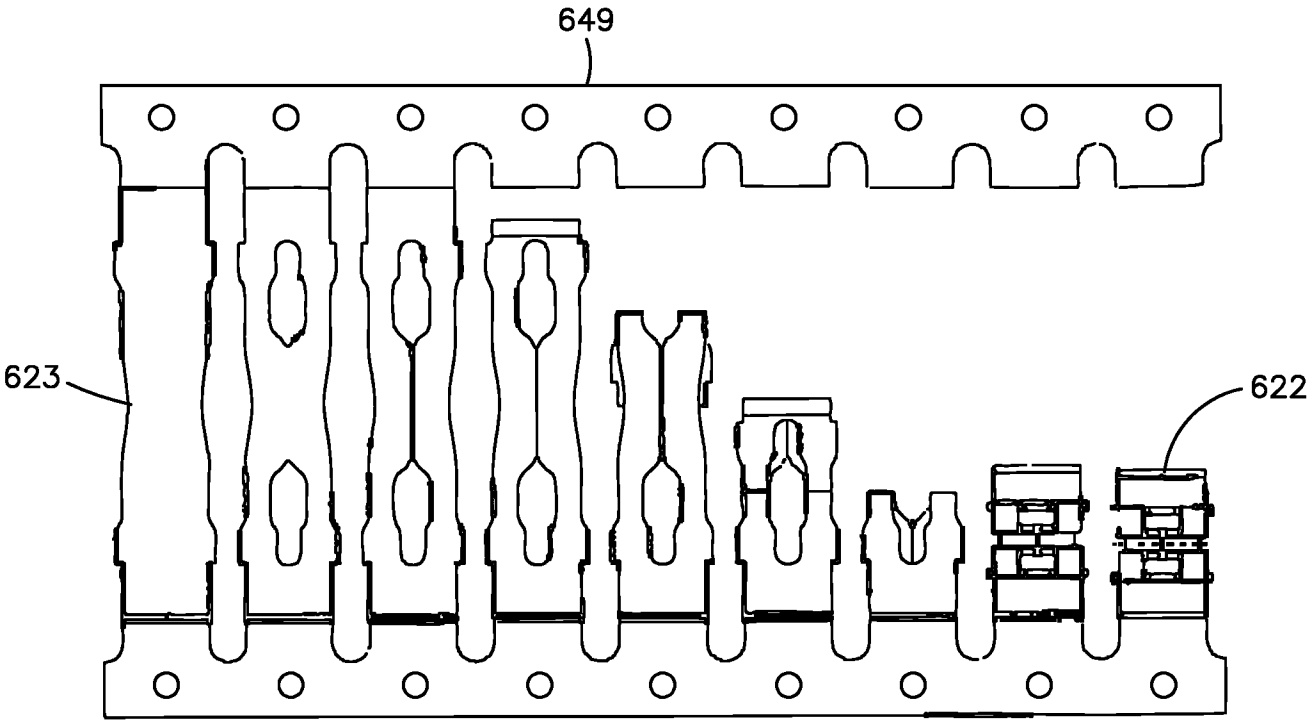
Figure 7L:
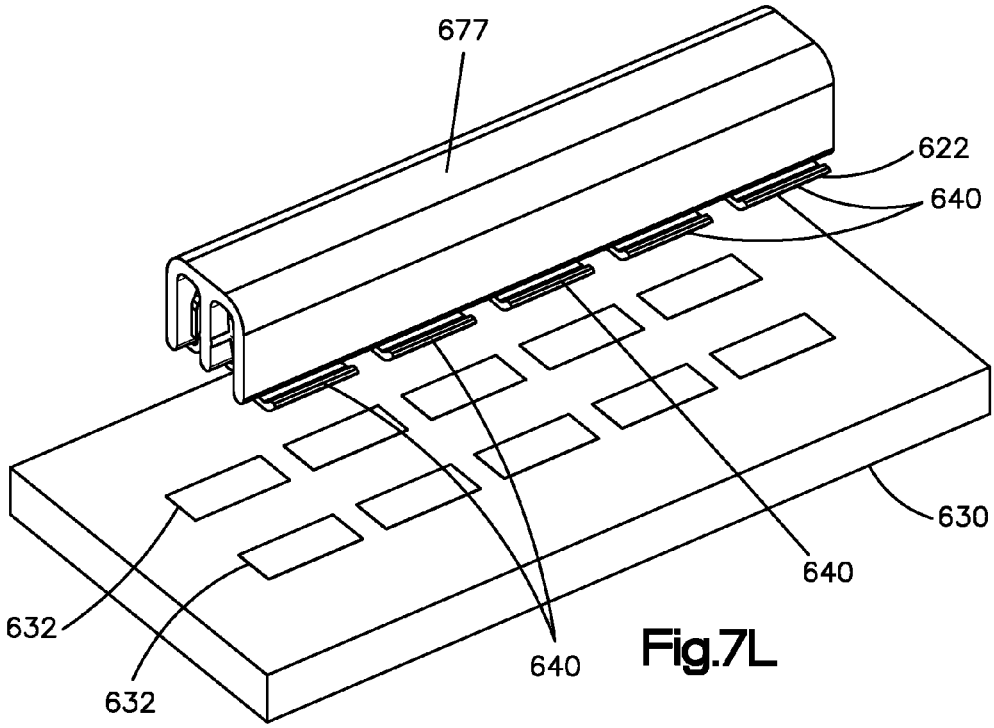
Figure 7M:
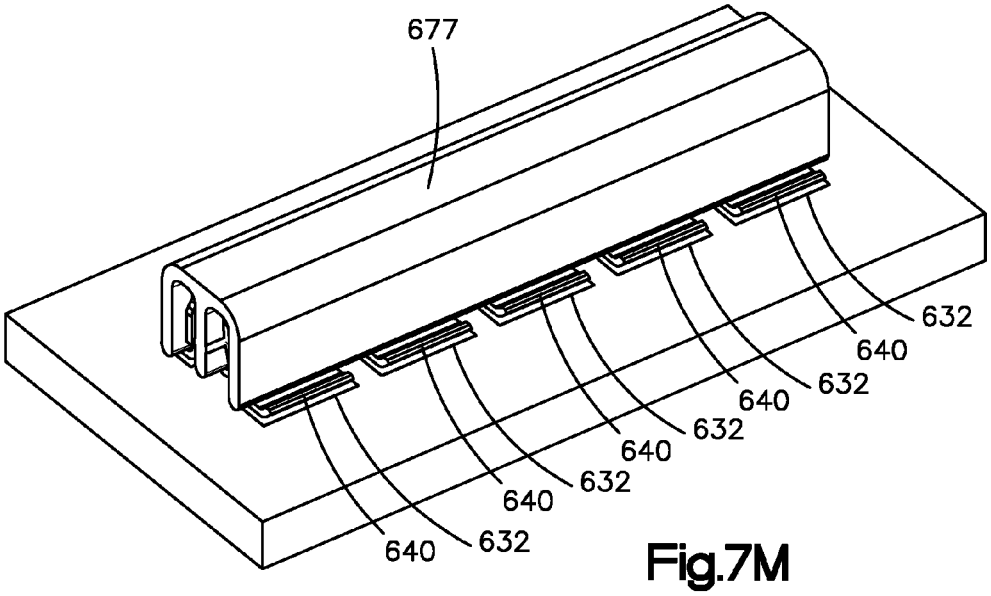
Figure 7N:
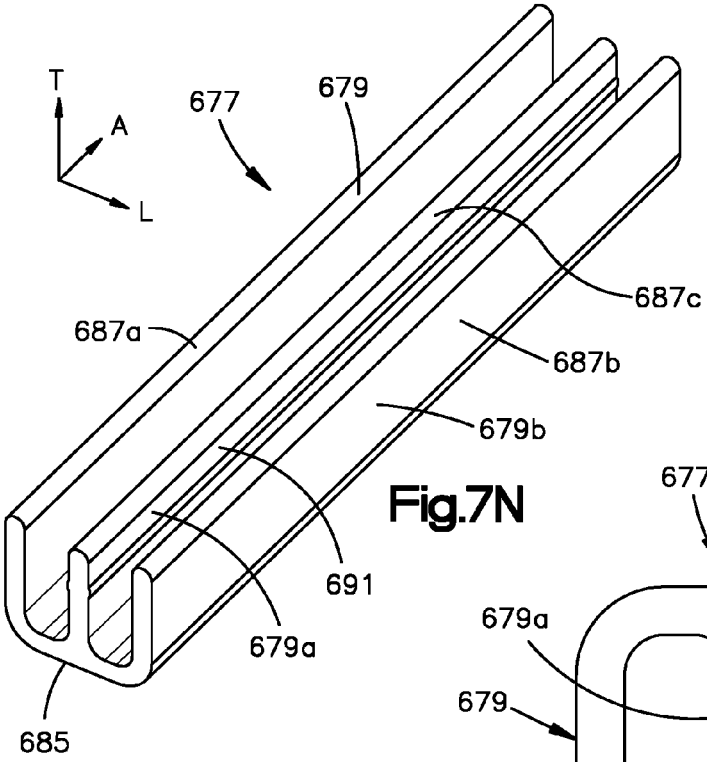
Figure 7O:
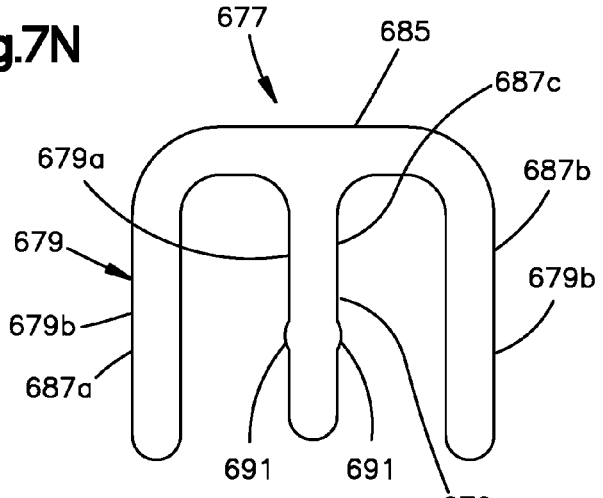
Figure 7P:
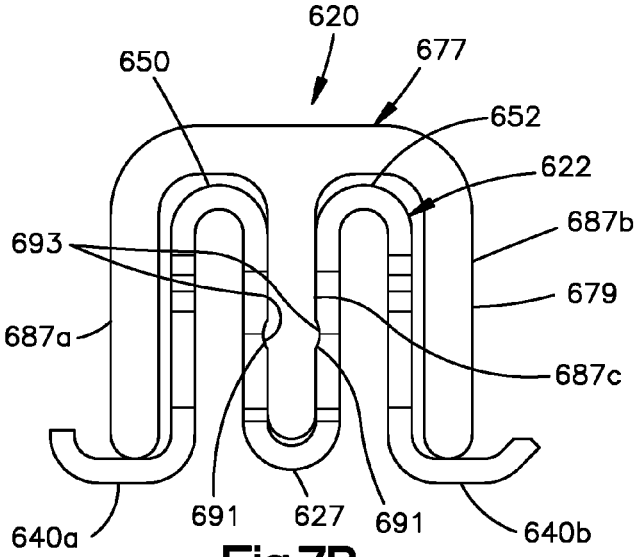
Figure 7Q:
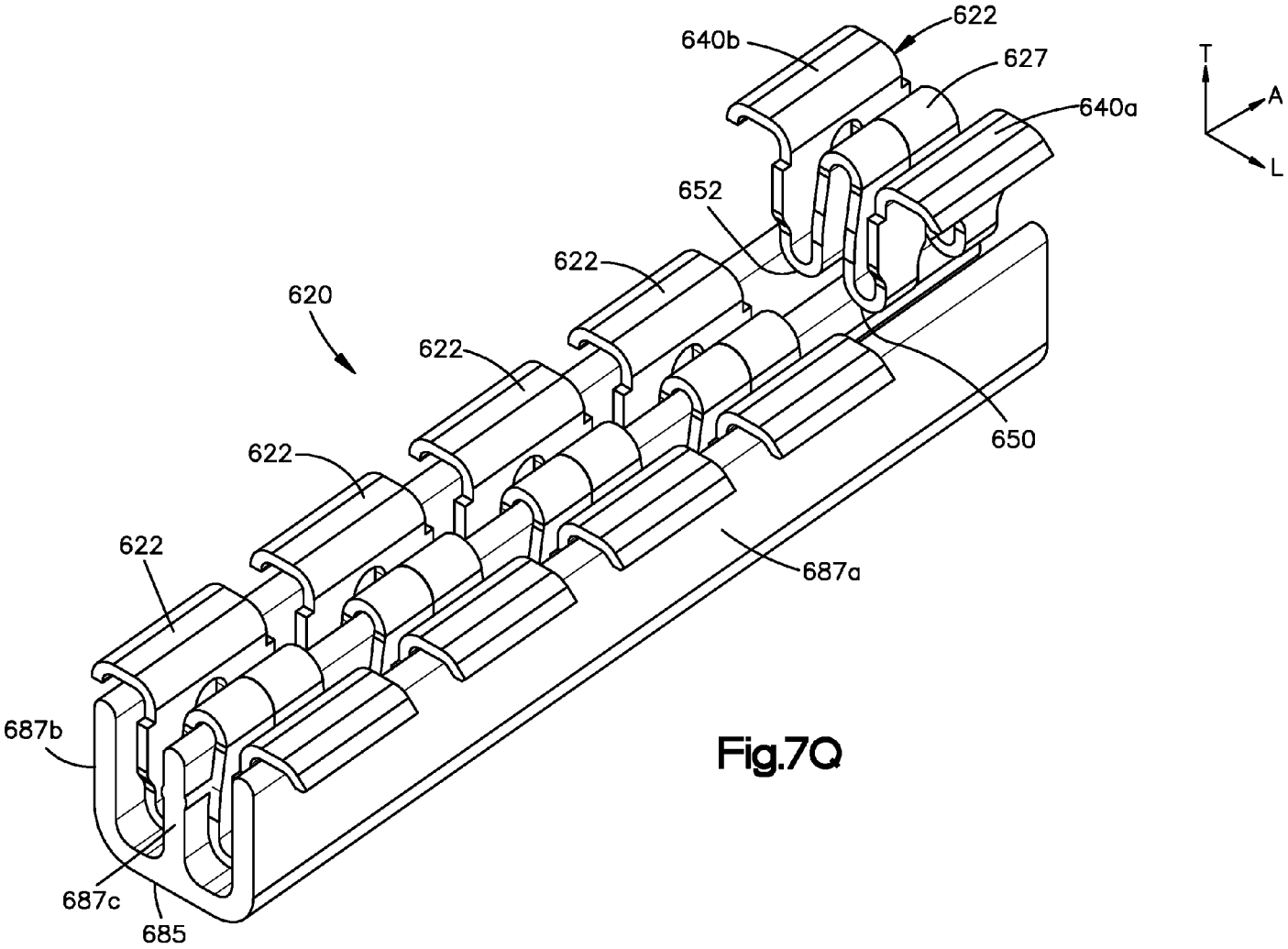
Figure 8C:
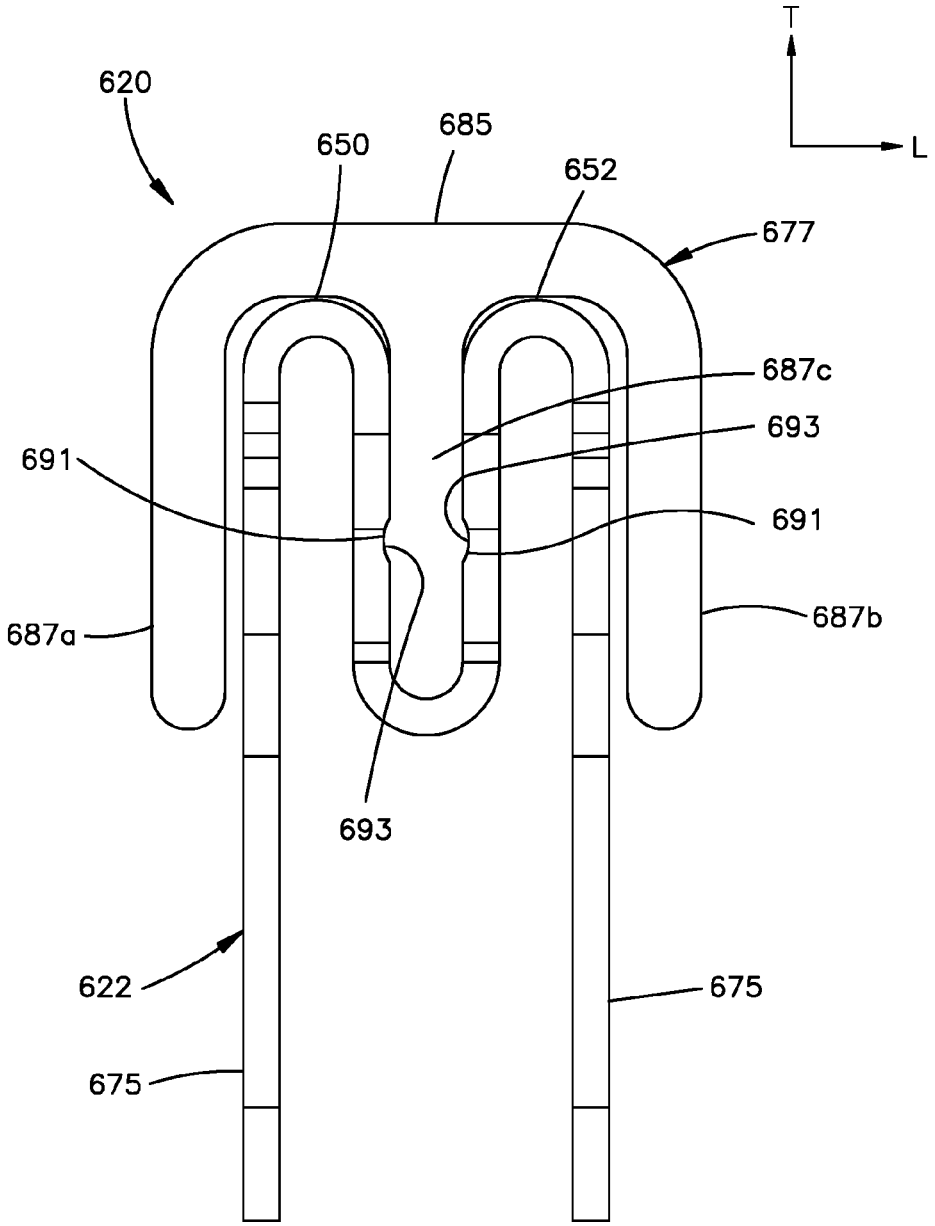
Figure 8D:
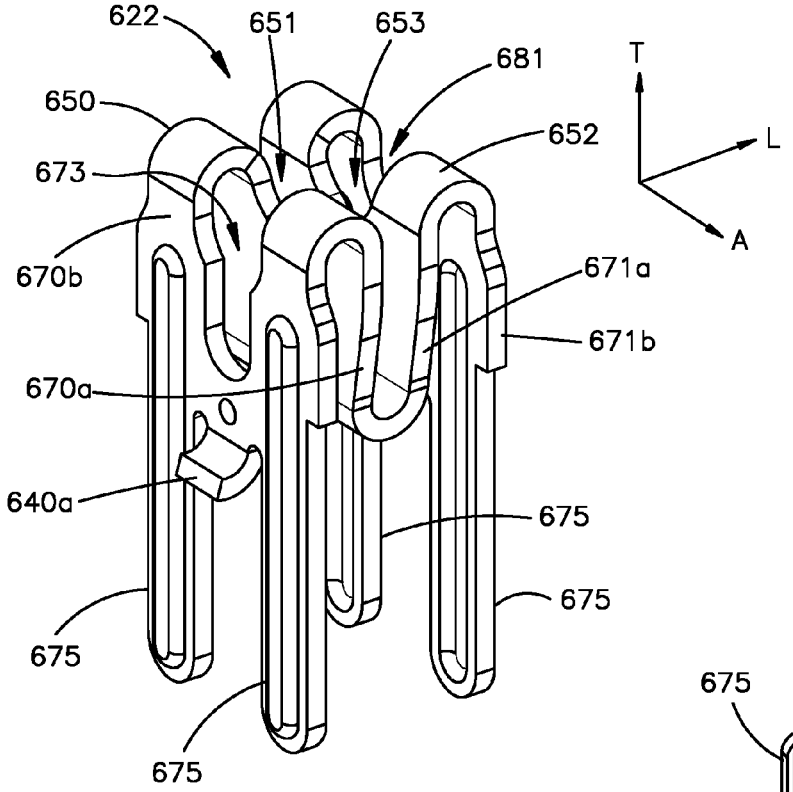
Figure 8E:
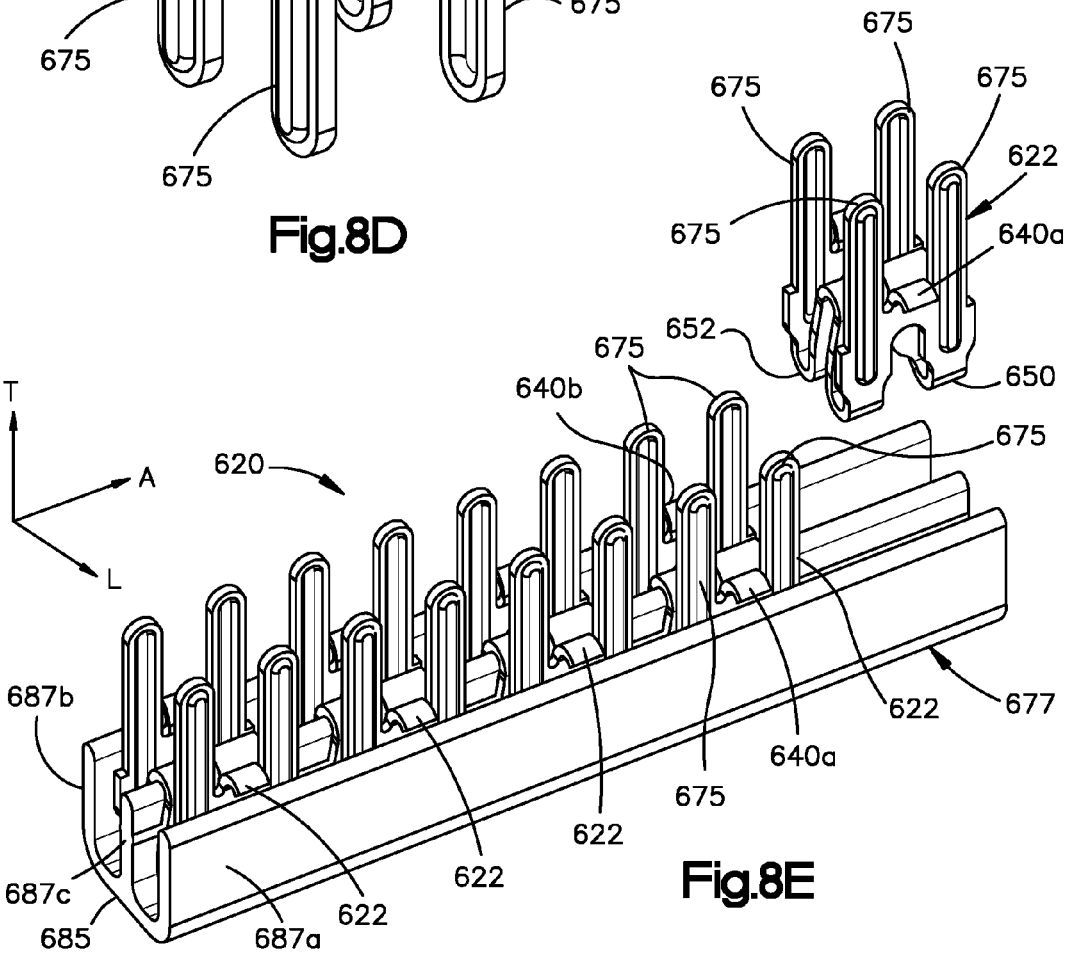
Figure 8F:
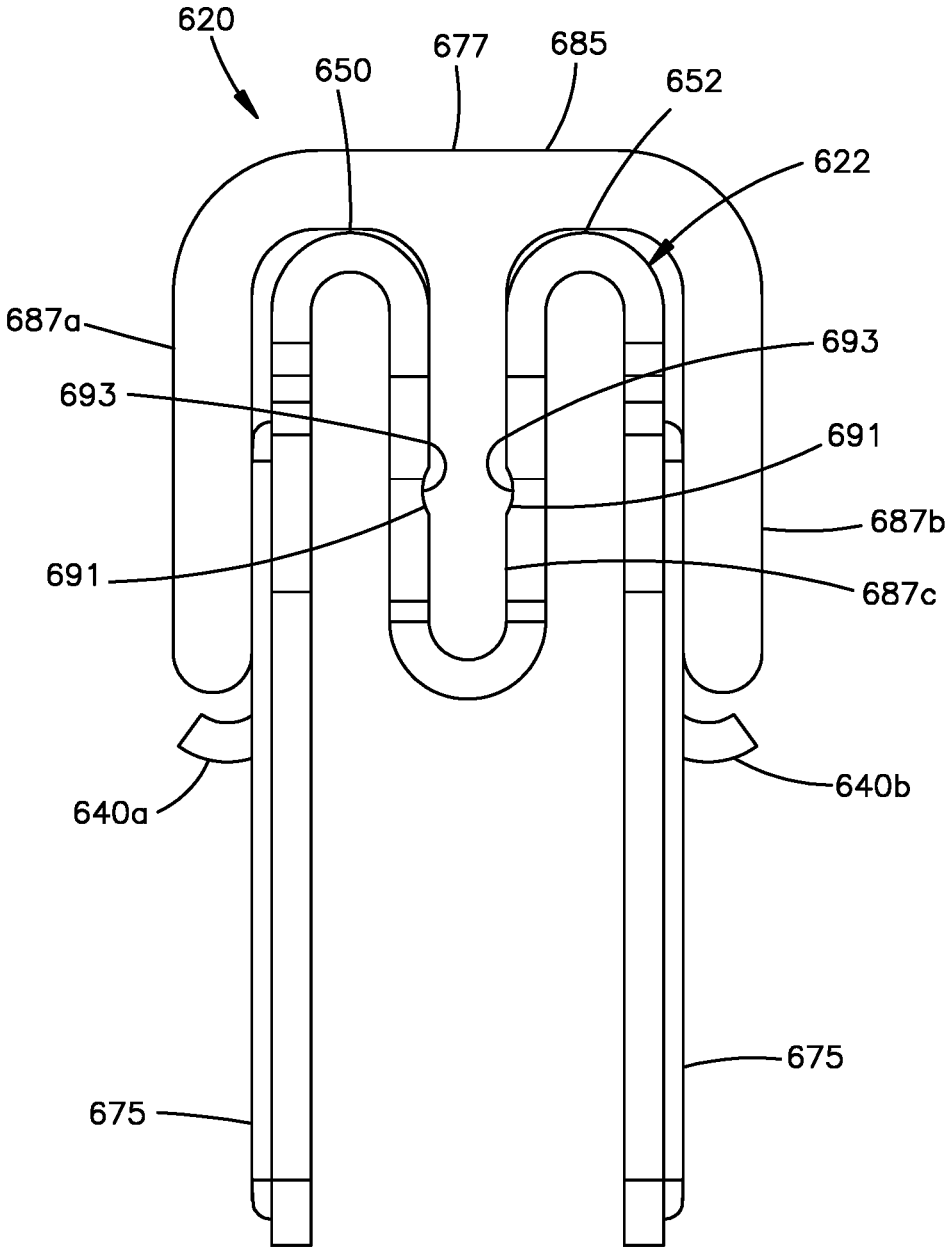
Figure 9A:
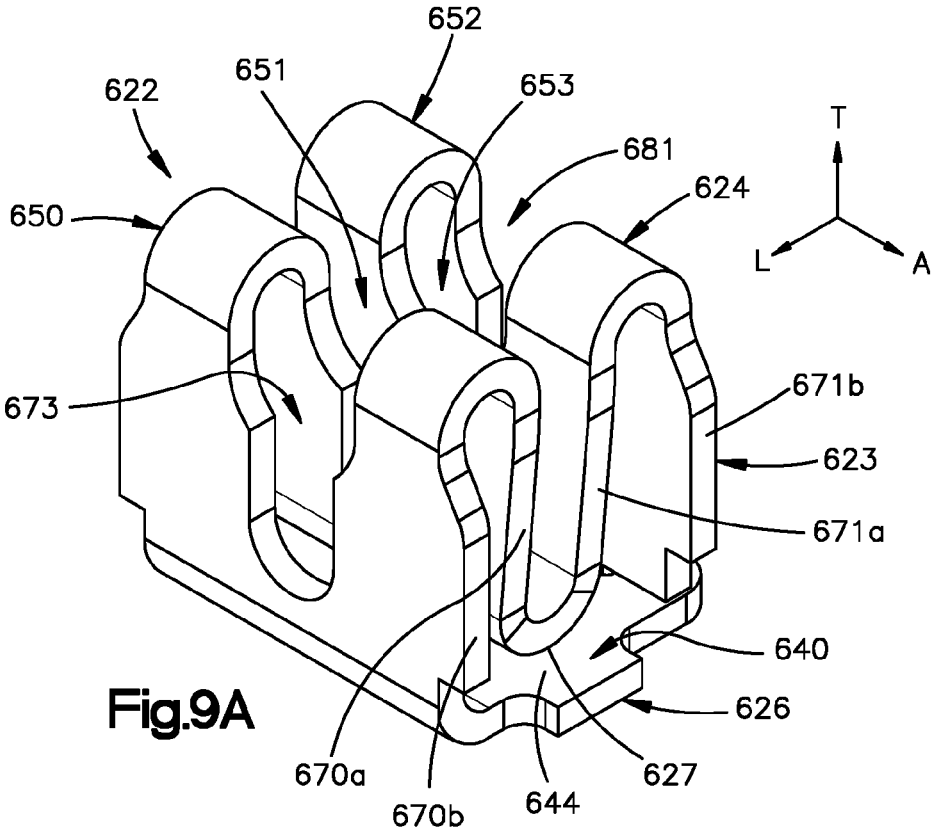
Figure 9B:
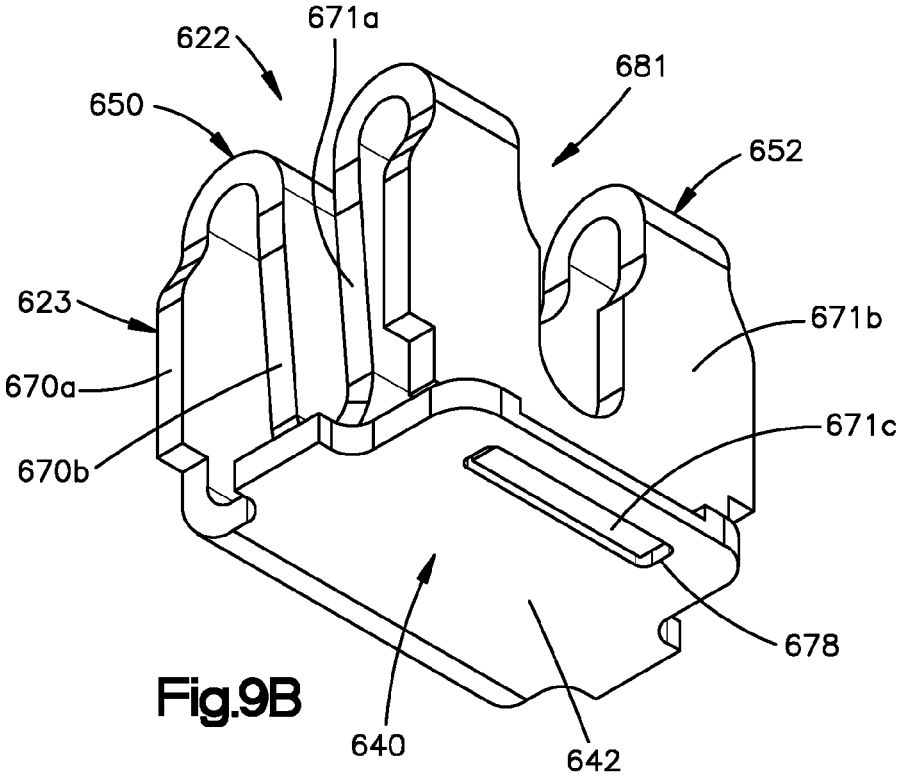
Figure 9C:
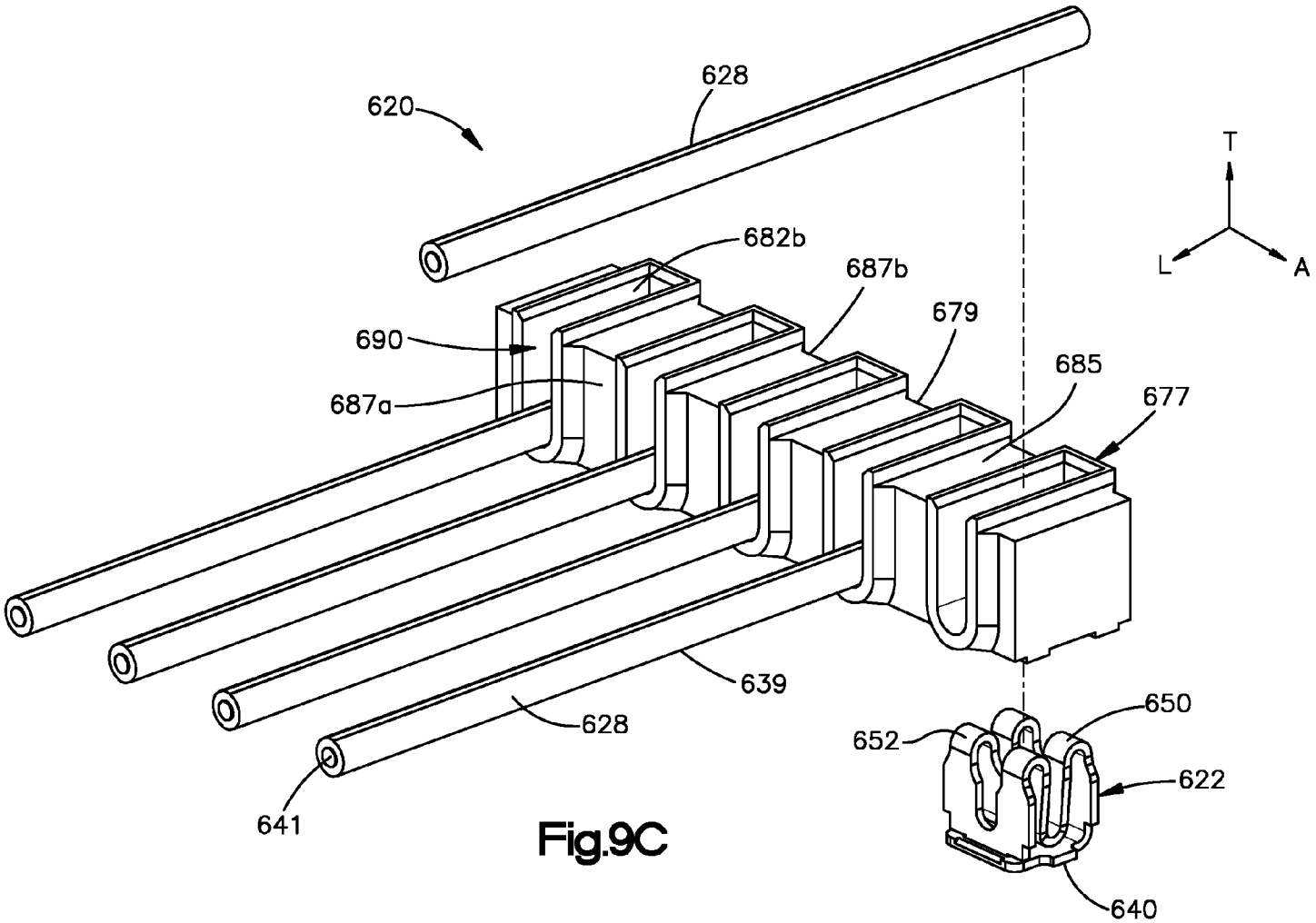
Figure 9D:
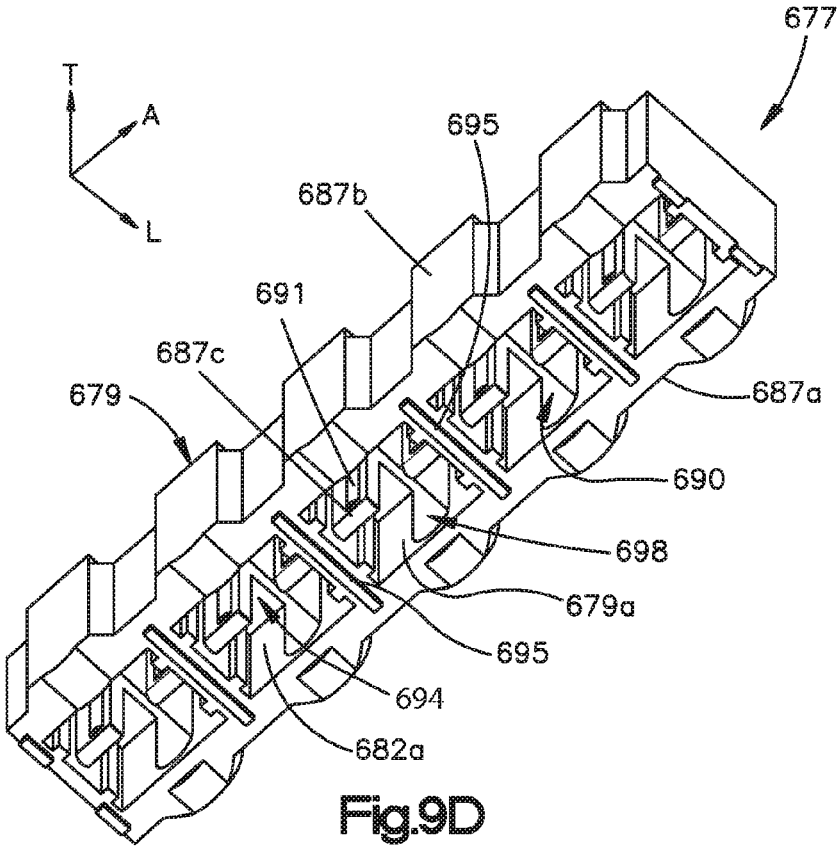
Figure 9E:
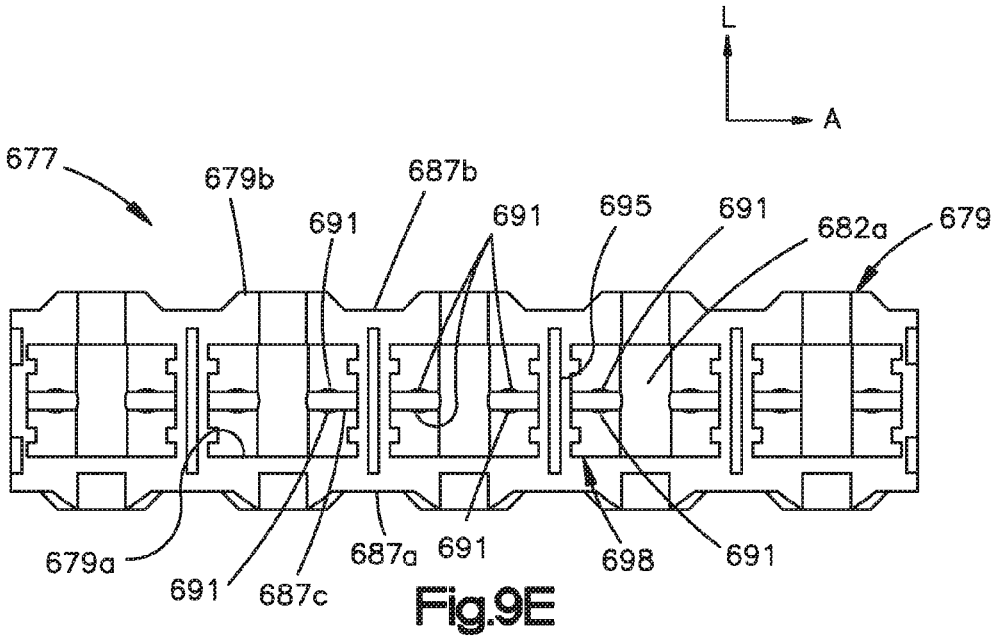

5P, aligned with a plurality of insulation displacement contacts mounted onto a printed circuit board;

FIG. 5S is a perspective view of the electrical connector assembly as illustrated in FIG. 5A, showing a housing removal tool;

FIG. 5T is a perspective view of the electrical connector assembly illustrated in FIG. 5S, showing operation of the housing removal tool;

FIG. 6A is a perspective view of an insulation displacement contact constructed in accordance with another embodiment;

FIG. 6B is another perspective view of the insulation displacement contact illustrated in FIG. 6A;

FIG. 6C is another perspective view of the insulation displacement contact illustrated in FIG. 6A;

FIG. 6D is a side elevation view of the insulation displacement contact illustrated in FIG. 6A;

FIG. 6E is a perspective view of an insulation displacement connector assembly including the insulation displacement contact illustrated in FIG. 6A and an electrical cable, showing the insulation displacement contact mated with the electrical cable;

FIG. 6F is another perspective view of the insulation displacement connector assembly illustrated in FIG. 6E;

FIG. 6G is a perspective view of a blank of sheet metal that can be bent to construct the insulation displacement contact illustrated in FIG. 6A;

FIG. 7A is a perspective view of an electrical connector assembly constructed in accordance with another embodiment, including a printed circuit board, a plurality of insulation displacement contacts configured to be mounted to the printed circuit board, and a connector housing that is configured to retain the insulation displacement contacts;

FIG. 7B is a perspective view of an insulation displacement contact illustrated in FIG. 7A;

FIG. 7C is another perspective view of an insulation displacement contact illustrated in FIG. 7A;

FIG. 7D is a side elevation view of the insulation displacement contact as illustrated in FIG. 7B;

FIG. 7E is an end elevation views of the insulation displacement contact as illustrated in FIG. 7B;

FIG. 7F is another end elevation views of the insulation displacement contact as illustrated in FIG. 7B;

FIG. 7G is a top plan view of the insulation displacement contact illustrated in FIG. 7B;

FIG. 7H is a sectional end elevation view taken along line 7H-7H of FIG. 7G;

FIG. 7I is an end elevation view of the insulation displacement contact illustrated in FIG. 7B, showing insertion of an electrical cable;

FIG. 7J is an end elevation view of the insulation displacement contact illustrated in FIG. 7I, after insertion of the electrical cable;

FIG. 7K is a top plan view of a blank of metal, shown formed into the insulation displacement contact illustrated in FIG. 7B;

FIG. 7L is a perspective view of a plurality of the insulation displacement contacts mounted to the connector housing illustrated in FIG. 7A;

FIG. 7M is a perspective view of the plurality of the insulation displacement contacts mounted to the connector housing as illustrated in FIG. 7L, showing the insulation displacement contacts mounted onto the printed circuit board;

FIG. 7N is a perspective view of the connector housing illustrated in FIG. 7A;

FIG. 7O is an end elevation view of the connector housing illustrated in FIG. 7N;

FIG. 7P is an end elevation view of the connector housing illustrated in FIG. 7O, showing the insulation displacement contact illustrated in FIG. 7B inserted into the connector housing;

FIG. 7Q is a perspective view of the connector housing illustrated in FIG. 7N, showing insertion of the insulation displacement contacts into the connector housing;

FIG. 8A is a perspective view of the insulation displacement contact illustrated in FIG. 7A, but including mounting tails in accordance with another embodiment;

FIG. 8B is a perspective view of a plurality of insulation displacement contacts as illustrated in FIG. 8A inserted into a connector housing;

FIG. 8C is a side elevation view of the insulation displacement contacts inserted into the connector housing as illustrated in FIG. 8B;

FIG. 8D is a perspective view of the insulation displacement contact illustrated in FIG. 7A, but including mounting tails in accordance with another embodiment;

FIG. 8E is a perspective view of a plurality of insulation displacement contacts as illustrated in FIG. 8D inserted into a connector housing;

FIG. 8F is a side elevation view of the insulation displacement contacts inserted into the connector housing as illustrated in FIG. 8E;

FIG. 9A is a perspective view of the insulation displacement contact as illustrated in FIG. 6A, but constructed in accordance with an alternative embodiment;

FIG. 9B is another perspective view the insulation displacement contact illustrated in FIG. 9A;

FIG. 9C is another perspective view of a connector housing configured to receive electrical cables and a plurality of insulation displacement contacts as illustrated in FIG. 9A;

FIG. 9D is a perspective view of the connector housing illustrated in FIG. 9C; and FIG. 9E is a bottom plan view of the connector housing illustrated in FIG. 9D.

DETAILED DESCRIPTION

Referring to FIGS. 1A-1E, an electrical connector assembly 20 can include at least one insulation displacement contact 22 such as a plurality of insulation displacement contacts 22 that define a mating portion 24 and a mounting portion 26. The electrical connector assembly 20 can further include at least one electrical cable 28 such as a plurality of electrical cables 28 that are configured to mate with a respective one of the insulation displacement contacts 22 at the mating portion 24, and a complementary electrical component 30 such as a substrate, for instance a printed circuit board. The insulation displacement contacts 22, and in particular the respective mounting portions 26, are configured to be mounted to a respective electrical terminal 32 of the complementary electrical component 30, which for instance can be configured as a mounting pad. Thus, the mounting portions 26 are each configured to be surface mounted, for instance soldered, welded, or the like, onto the complementary electrical component 30, for instance to the electrical terminal 32. Alternatively or additionally, the mounting portion 26 can include a projection that is configured to be inserted into an aperture of the complementary electrical component 30. The projection can be press-fit into the aperture of the complementary electrical component 30, which can be an electrically conductive plated via. When the insulation displacement contact 22 is mounted to the complementary electrical component 30 and mated with the respective electrical cable 28, the electrical cable 28 is placed in electrical communication with the complementary electrical component 30. It should be appreciated that the complementary electrical component 30, and all complementary electrical components described herein, can be a printed circuit board or any suitable constructed alternative electrical component 30 as desired.

The insulation displacement contacts 22, and all insulation displacement contacts described herein, can be made from any suitable electrically conductive material, such as a metal. Each insulation displacement contact 22 can include an electrically conductive contact body 23 that defines both the mating portion 24 and the mounting portion 26, which can be monolithic with the mating portion 24. The mating portion 24 can include at least one slot that extends into the contact body 23, and at least one piercing member 37 that at least partially defines the slot such that, when the slot receives the electrical cable 28, the piercing member 37 pierces an outer electrically insulative layer 39 of the electrical cable 28 and contacts an electrical conductor 41 of the electrical cable 28 that is disposed inside the outer electrically insulative layer 39. The outer electrically insulative layer 39, and all outer electrically insulative layers as described herein, can be made of any suitable electrically insulative material as desired. The electrical conductor 41, and all electrical conductors as described herein, can be made from any suitable electrically conductive material as desired.

The electrically conductive contact body 23 can include a base 40 that defines an outer surface and an inner surface 44 that faces opposite the outer surface along the transverse direction T. The outer surface is configured to face the electrical terminal, and can be configured as an outer contact surface 42 that is configured to contact the electrical terminal 32. For instance, the outer contact surface 42 can be surface mounted, such as soldered or welded, to the electrical terminal 32. Alternatively, the base 40 can include mounting tails that extend from the outer surface and are configured to be inserted, for instance press-fit, into vias of the complementary electrical component 30. Thus, the mounting portion 26 can be defined by the base 40, and in particular the outer contact surface 42. When the outer contact surface 42 is in contact with the electrical terminal 32, either directly or indirectly, the electrical terminal 32 in placed in electrical communication with the mounting portion 26, and thus the mating portion 24. The outer contact surface 42 and the inner surface 44 can be spaced from each other along a transverse direction T. In particular, the inner surface 44 is spaced above, or up from, the outer contact surface 42 along the transverse direction T, and the outer contact surface 42 is spaced below, or down from, the inner surface 44 along the transverse direction T.

The mating portion 24 can be defined by at least a pair of arms, including a first pair 46 of arms and a second pair 48 of arms. The first pair 46 of arms can include a first arm 50 and a second arm 52, and the second pair 48 of arms can include a third arm 54 and a fourth arm 56. The first, second, third, and fourth arms 50, 52, 54, and 56, respectively, can each extend up from the base 40 along the transverse direction T. At least a portion of the first and second arms 50 and 52 of the first pair 46 are spaced from each other along a lateral direction A, so as to define an insulation displacement slot 51 therebetween. Similarly, at least a portion of the third and fourth arms 54 and 56 of the second pair 48 are spaced from each other along the lateral direction A so as to define an insulation displacement slot 53 therebetween. Thus, the insulation displacement slot 51 can be referred to as a first insulation displacement slot, and the insulation displacement slot 53 can be referred to as a second insulation displacement slot. The lateral direction A is substantially perpendicular to the transverse direction T. The first and second insulation displacement slots 51 and 53 are spaced from each other, and are aligned with each other, along a longitudinal direction L that is substantially perpendicular to both the transverse direction T and the lateral direction A. Thus, a straight line that extends along the longitudinal direction L can pass through both the first and second insulation displacement slots 51 and 53. As used herein, the phrase "substantially perpendicular" can refer to angularly offset, and in one example perpendicular, unless otherwise indicated.

The first insulation displacement slot 51 extends through the contact body 23 between the first and second arms 50 and 52 along the longitudinal direction L. The first insulation displacement slot 51 further extends into, but not through, the contact body 23 between the first and second arms 50 and 52 in a downward direction along the transverse direction T. Thus, the first insulation displacement slot 51 is open at its upper end. Further, the first insulation displacement slot 51 is closed at its lower end that is defined by the contact body 23, for instance by one or both first and second arms 50 and 52. Similarly, the second insulation displacement slot 53 extends through the contact body 23 between the third and fourth arms 54 and 56 along the longitudinal direction L. The second insulation displacement slot 53 further extends into, but not through, the contact body 23 between the third and fourth arms 54 and 56 in a downward direction along the transverse direction T. Thus, the second insulation displacement slot 53 is open at its upper end. Further, the second insulation displacement slot 53 can be closed at its lower end that is defined by the contact body 23, for instance by one or both third and fourth arms 54 and 56. The closed lower ends of the first and second contact slots 51 and 53 can be concave, for instance curved, and in one example arcuate, in shape.

The insulation displacement contacts 22 can be mounted to the complementary electrical component 30 along a mounting direction so as to place the base 40 in contact with the electrical terminal 32. Thus, the mounting direction can be downward along the transverse direction. The electrical cable 28 can be mated to the insulation displacement contact 22 by inserting the electrical cable 28 into the first and second insulation displacement slots 51 and 53 downward along the transverse direction T. Otherwise stated, the insulation displacement slots 51 and 53, and the contact body 23, moves upward along the transverse direction T relative to the electrical cable 28 so as to mate with insulation displacement contact 22 with the electrical cable 28. Accordingly, the mating direction can be along the same direction, for instance the transverse direction T, as the mounting direction, but in opposite directions along the same direction.

The first arm 50 defines a first surface, such as a first inner surface 50*a*, and the second arm 52 defines a second surface, such as a second inner surface 52*a*, that is spaced from the first inner surface 50*a* so as to at least partially define the first insulation displacement slot 51. For instance, the first and second inner surfaces 50*a* and 52*a* can be spaced from each other along the lateral direction A such that the first insulation displacement slot 51 separates the first and second inner surfaces 50*a* and 52*a* from each other. One or both of the inner surfaces 50*a* and 52*a* can be tapered toward each other as they extend along the lateral direction A so as to define respective piercing members 37. The mating portion 24 defines a first distance from the respective piercing member 37 to the opposed inner surface across the first insulation displacement slot 51 along the lateral direction A. Otherwise stated, the mating portion 24 defines a first distance from the first inner surface 50*a* to the second inner surface 52*a* along the lateral direction A. The first distance is less than an outer dimension, which can be a diameter, of the electrical cable 28. For instance, the first distance can be less than an outer dimension, such as an outer diameter, of the outer electrically insulative layer 39, can further be less than an inner dimension, such as an inner diameter, of the outer electrically insulative layer 39, and can further be less than an outer dimension, such as a diameter, of the electrical conductor 41. Thus, when the insulation displacement contact 22 receives the electrical cable 28 in the mating direction, the cable 28, and a plurality of differently sized electrical cables, can be individually received in the first insulation displacement slot 51 such that the piercing member 37, which can be defined by one or both of the inner surfaces 50*a* and 52*a*, pierces through the outer electrically insulative layer 39 and contacts the electrical conductor 41. For instance, the piercing member 37 defined by the first pair 46 of arms can define a blade surface that slices through the electrically insulative layer 39 into the electrical conductor 41.

Similarly, the third arm 54 defines a third surface, such as a third inner surface 54*a*, and the fourth arm 56 defines a fourth surface, such as a fourth inner surface 56*a*, that is spaced from the third inner surface 54*a* so as to at least partially define the second insulation displacement slot 53. For instance, the third and fourth inner surfaces 54*a* and 56*a* can be spaced from each other along the lateral direction A such that the second insulation displacement slot 53 separates the third and fourth inner surfaces 54*a* and 56*a* from each other. One or both of the inner surfaces 54*a* and 56*a* can be tapered toward each other as they extend along the lateral direction A so as to define respective piercing members 37. The mating portion 24 defines a second distance from the respective piercing member 37 to the opposed inner surface across the second insulation displacement slot 53 along the lateral direction A. Otherwise stated, the mating portion 24 defines a second distance from the third inner surface 54*a* to the fourth inner surface 56*a* along the lateral direction A. The second distance is less than an outer dimension, which can be a diameter, of the electrical cable 28. For instance, the second distance can be less than an outer dimension, such as an outer diameter, of the outer electrically insulative layer 39, can further be less than an inner dimension, such as an inner diameter, of the outer electrically insulative layer 39, and can further be less than an outer dimension, such as a diameter, of the electrical conductor 41. Thus, when the insulation displacement contact 22 receives the electrical cable 28 in the mating direction, the cable 28, and a plurality of differently sized electrical cables, can be individually received in the second insulation displacement slot 53 such that the piercing member 37, which can be defined by one or both of the inner surfaces 54*a* and 56*a*, pierces through the outer electrically insulative layer 39 and contacts the electrical conductor 41. For instance, the piercing member 37 defined by the second pair 48 of arms can define a blade surface that slices through the electrically insulative layer 39 into the electrical conductor 41.

With continuing reference to FIGS. 1A-1E, the first arm 50 adjoins the base 40 at a first interface 60. Similarly, the second arm 52 adjoins the base 40 at a second interface 62. Similarly, the third arm 54 adjoins to the base 40 at a third interface 64. Similarly, the fourth arm 56 adjoins to the base 40 at a fourth interface 66. The first arm 50, the second arm 52, the third arm 54, the fourth arm 56, and the base 40 can all be monolithic with each other or attached to the base 40 as desired, such that the interfaces 60-66 are defined by bent regions of the contact body 23. The first interface 60 can be elongate along the longitudinal direction L. Similarly, the third interface 64 can be elongate along the longitudinal direction L. The first and third interfaces 60 and 64 can be spaced from each other along the lateral direction A. The second interface 62 can be elongate along the lateral direction A. Similarly, the fourth interface 66 can be elongate along the lateral direction A. The second and fourth interfaces 62 and 66 can be spaced from each other along the longitudinal direction L. Thus, the first and third interfaces 60 and 64 can be parallel to each other. The second and fourth interfaces 62 and 66 can be parallel to each other and perpendicular to the first and third interfaces 60 and 64.

The first arm 50 can include a first region 70*a* that adjoins the base 40 at the first interface 60, and a second region 70*b* that extends from the first region 70*a*. For instance, the first arm 50 can be bent such that the second region 70*b* is angularly offset, for instance perpendicular, with respect to the first region 70*a*. In accordance with one embodiment, the first region 70*a* can be oriented substantially within a first plane that is defined by the longitudinal direction L and the transverse direction T. The second region 70*b* can be oriented substantially within a second plane that is defined by the lateral direction A and the transverse direction T. The second arm 52 can be oriented substantially within the second plane such that the inner surfaces 50*a* and 52*a* are aligned with each other along the lateral direction A so as to define the first insulation displacement slot 51.

Similarly, the third arm 54 can include a first region 72*a* that adjoins the base 40 at the third interface 64, and a second region 72*b* that extends from the first region 72*a*. For instance, the third arm 54 can be bent such that the second region 72*b* is angularly offset, for instance perpendicular, with respect to the first region 72*a*. In accordance with one embodiment, the first region 72*a* can be oriented substantially within a first plane that is defined by the longitudinal direction L and the transverse direction T. The second region 72*b* can be oriented substantially within a second plane that is defined by the lateral direction A and the transverse direction T. Thus, the first region 70*a* of the first arm 50 can be parallel to the first region 72*a* of the third wall. Similarly, the second region 70*b* of the first arm 50 can be parallel to the second region 72*b* of the second wall. The fourth arm 56 can be oriented substantially within the second plane of the second region 72*b* of the third arm 54 so that the inner surfaces 54*a* and 56*a* are aligned with each other along the lateral direction A so as to define the second insulation displacement slot 53.

Figure 1A:
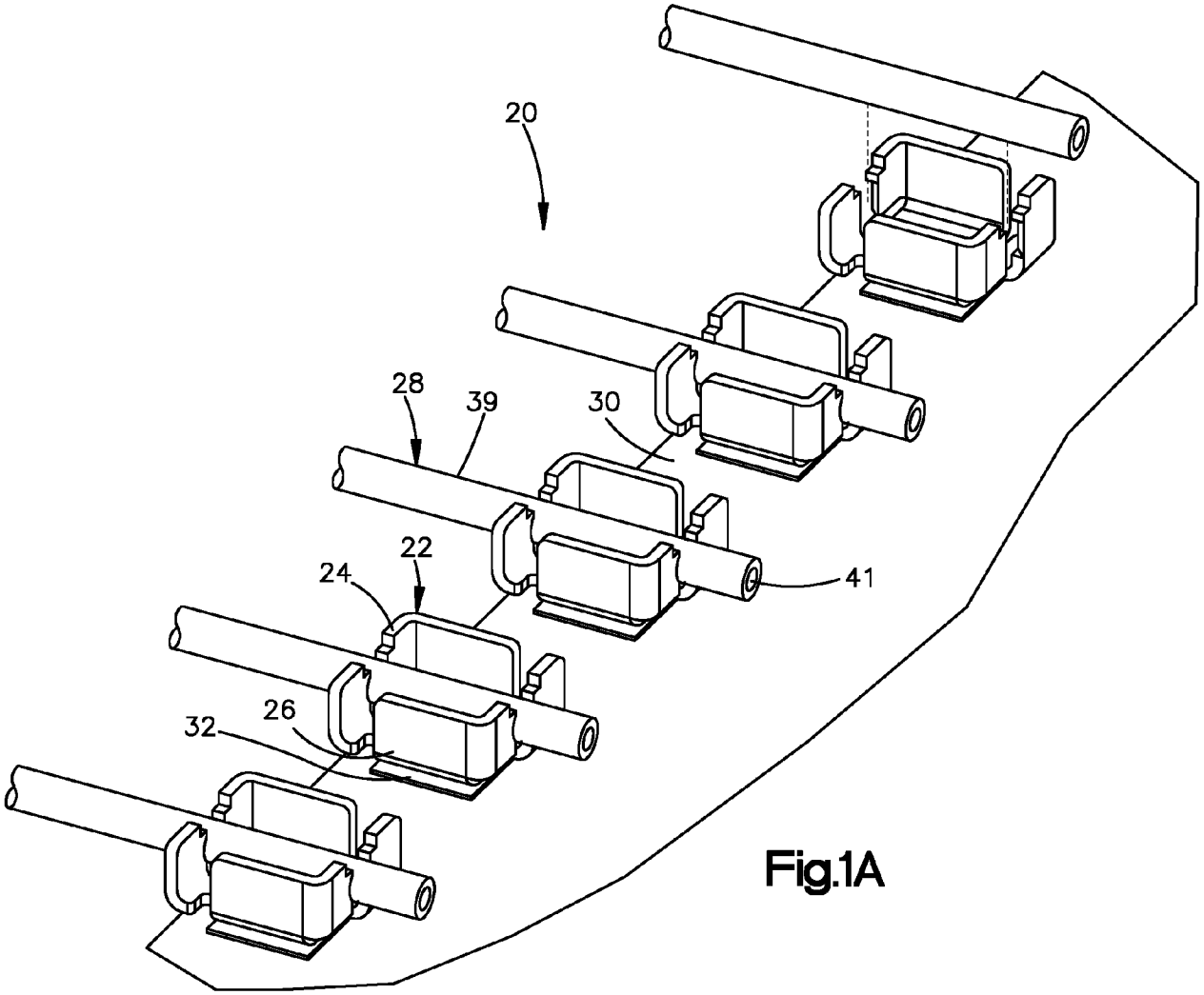
FIG. 1A is a perspective view of an electrical connector assembly constructed in accordance with one embodiment, including a printed circuit board, a plurality of electrical cables, and a plurality of insulation displacement contacts configured to be mounted to the printed circuit board.
Figure 1B:
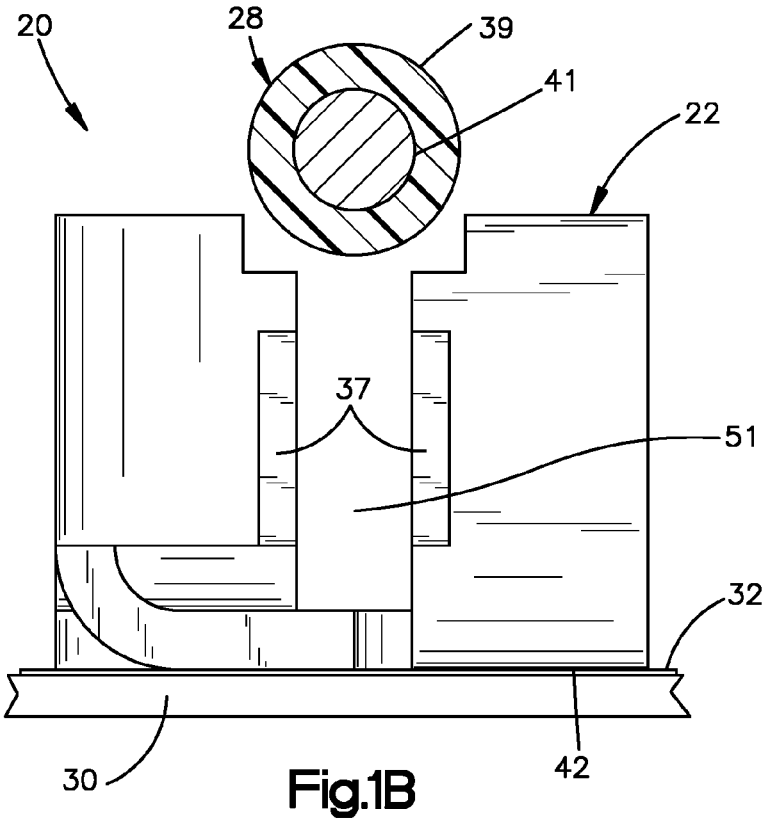
FIG. 1B is an end elevation view of an insulation displacement contact as illustrated in FIG. 1, showing insertion of a respective electrical cable into the insulation displacement contact.
Figure 1C:
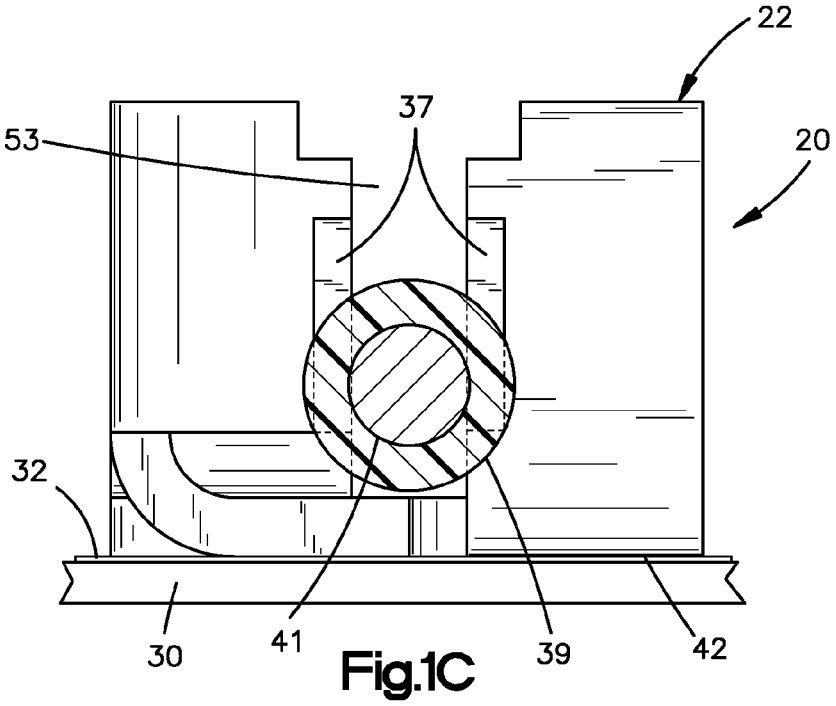
FIG. 1C is an end elevation view as illustrated in FIG. 1B, showing the respective electrical cable inserted into the insulation displacement contact.
Figure 1D:
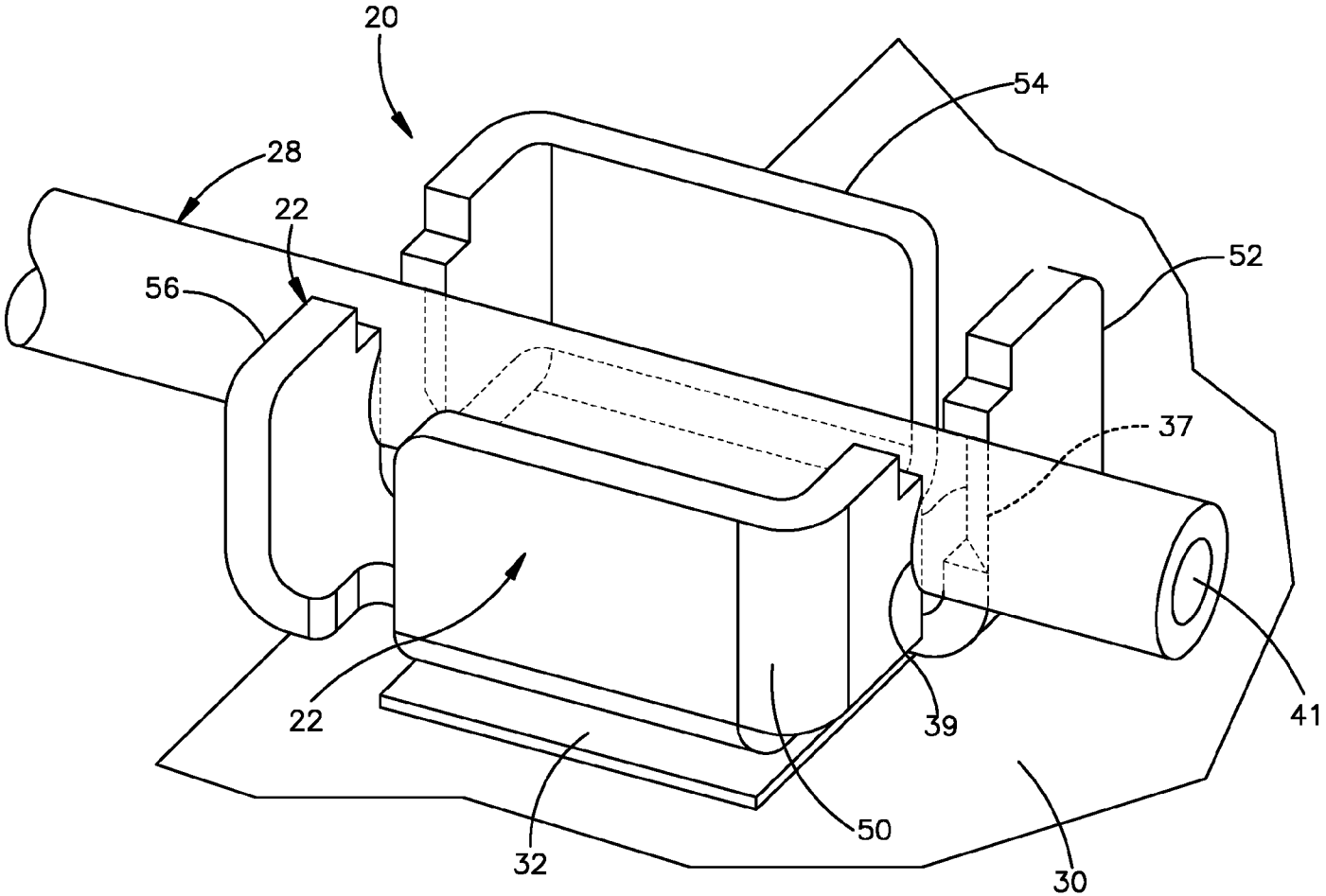
FIG. 1D is a perspective view of the insulation displacement contact as illustrated in FIG. 1C.
Figure 1E:
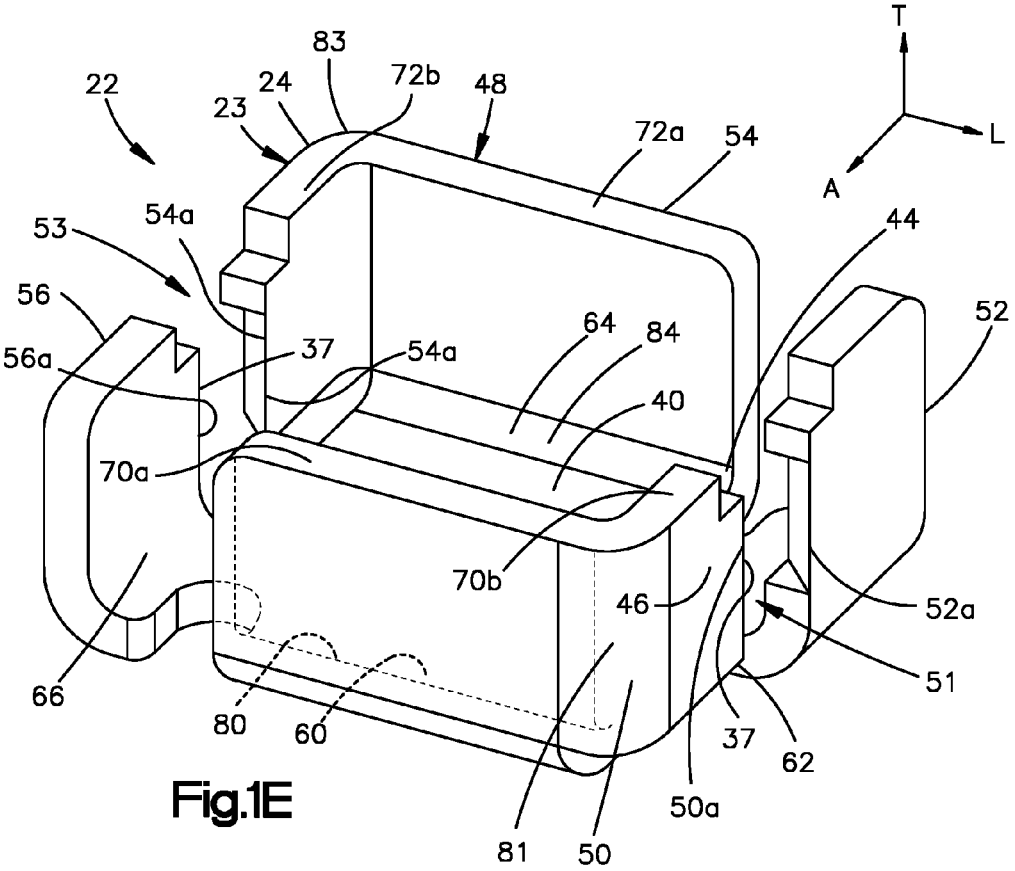
FIG. 1E is a perspective view of the insulation displacement contact illustrated in FIG. 1B.
Figure 1F:
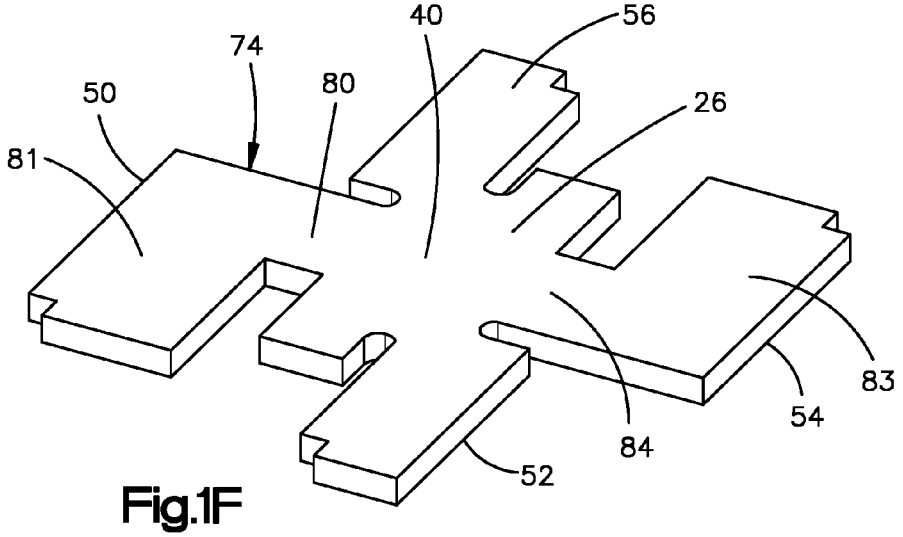
FIG. 1F is a perspective view of a blank of sheet metal that can be bent to construct the insulation displacement contact illustrated in FIGS. 1A-1E.
Figure 2A:
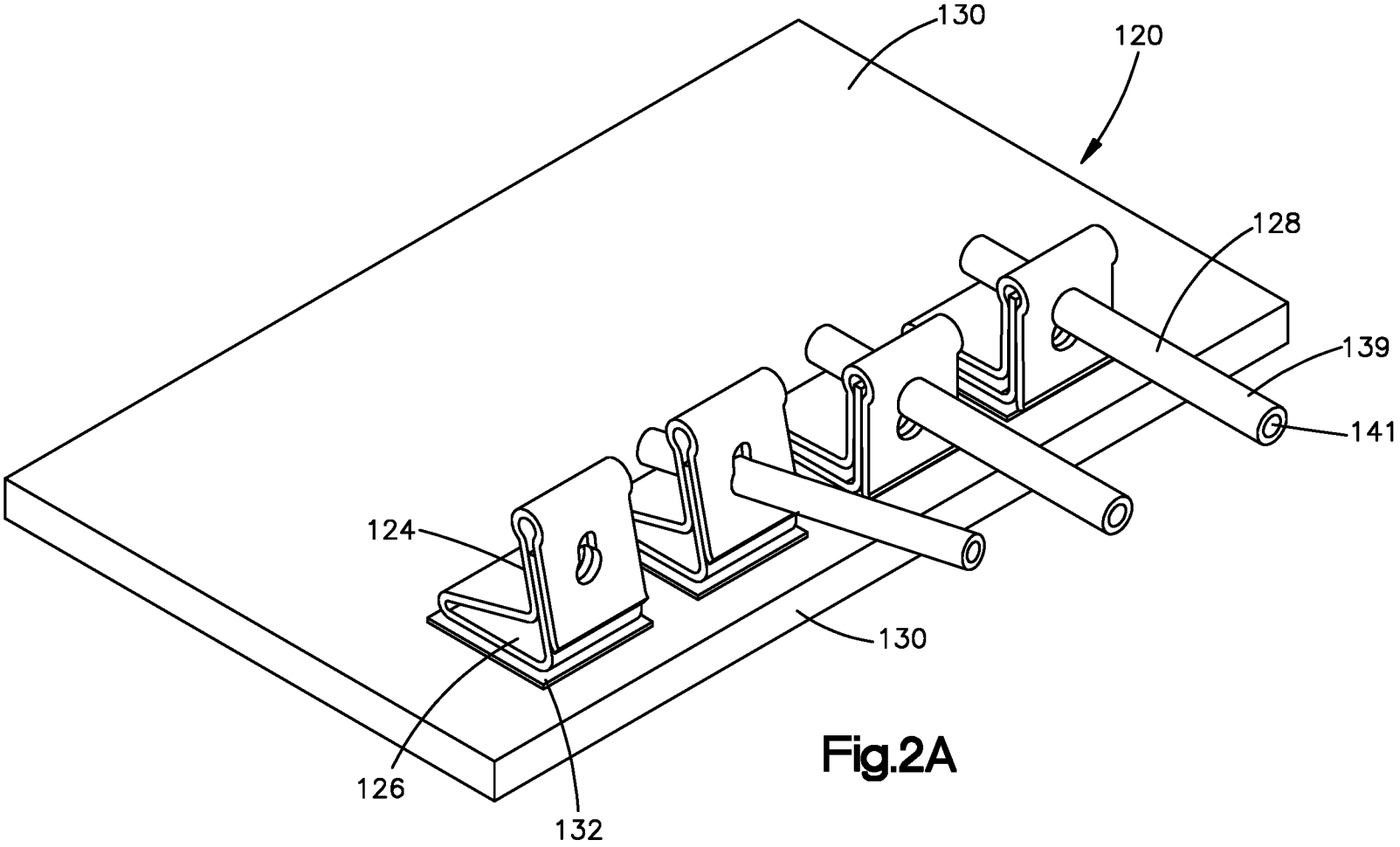
FIG. 2A is a perspective view of an electrical connector assembly constructed in accordance with another embodiment, including a printed circuit board, a plurality of electrical cables, and a plurality of insulation displacement contacts configured to be mounted to the printed circuit board.
Figure 2C:
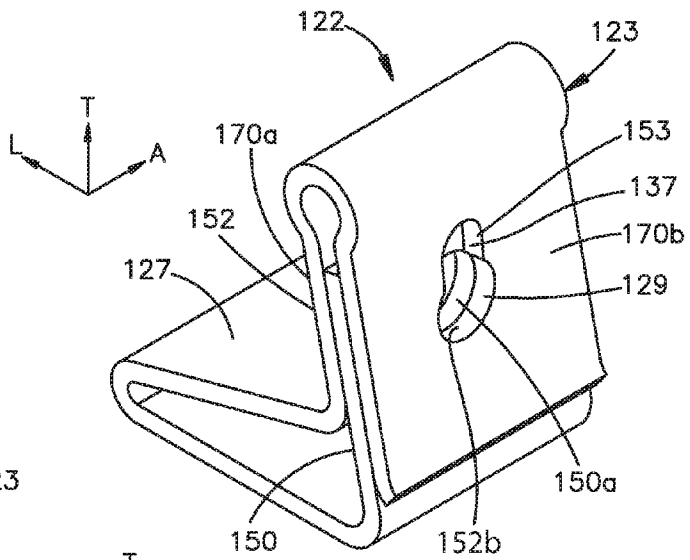
FIG. 2C is another perspective view of the insulation displacement contact illustrated in FIG. 2B.
Figure 2B:
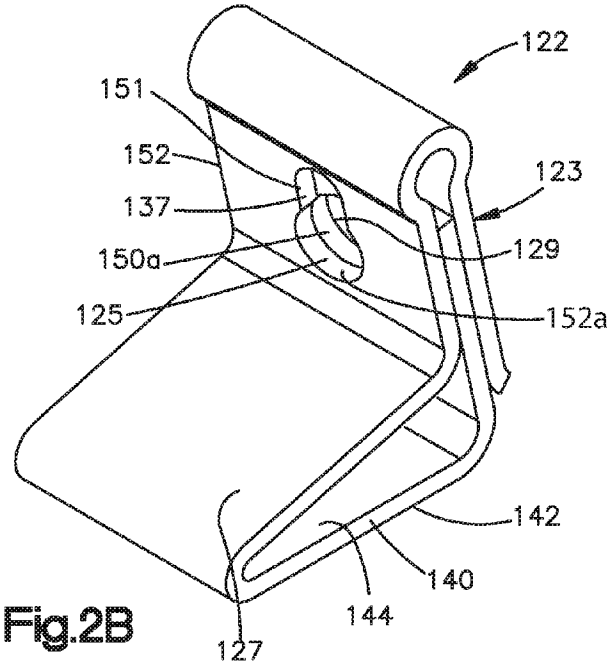
FIG. 2B is a perspective view of an insulation displacement contact illustrated in FIG. 2A.
Figure 2D:
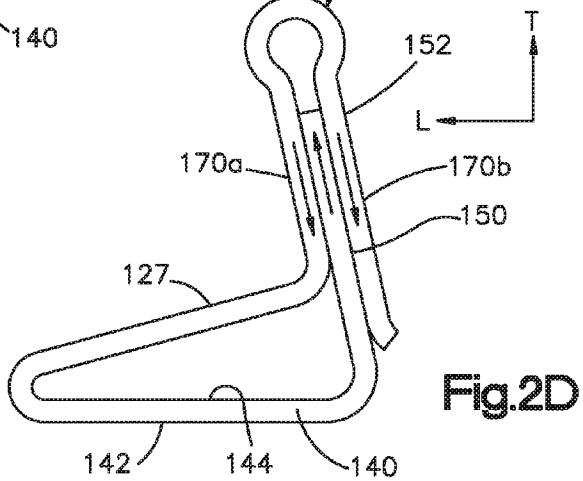
FIG. 2D is a side elevation view of the insulation displacement contact illustrated in FIGS. 2B-2C.
Figure 2E:
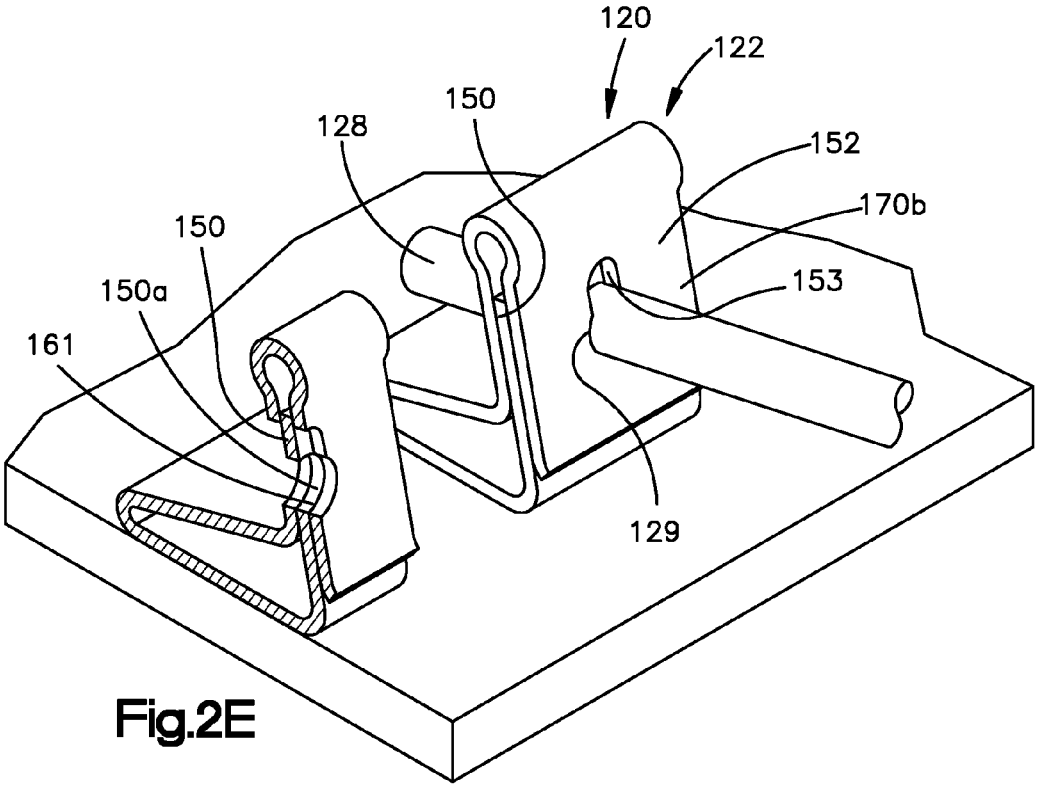
FIG. 2E is an enlarged perspective view of a portion of the electrical connector assembly illustrated in FIG. 2A, showing an electrical cable inserted into one of the insulation displacement contacts.
Figure 2F:
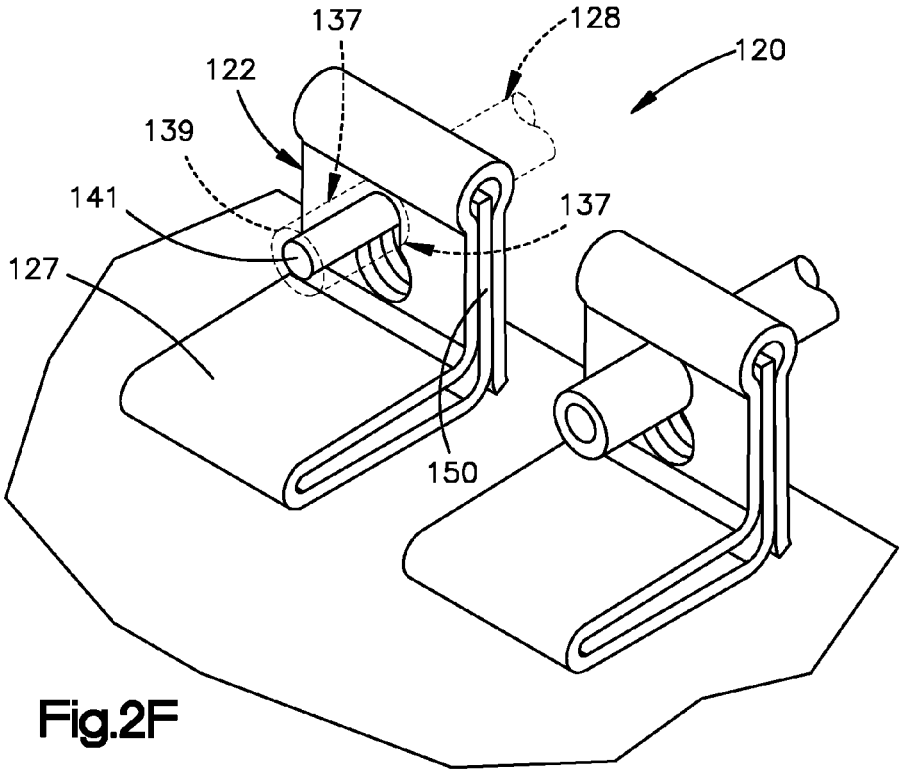
FIG. 2F is another enlarged perspective view of a portion of the electrical connector assembly illustrated in FIG. 2E, showing the insulation displacement contact attached to the inserted electrical cable.

Referring now to FIG. 1F, the insulation displacement contact 22 can be fabricated from a single sheet of conductive material, such as metal, that can be stamped or otherwise formed into a blank 74, which can be substantially planar or otherwise shaped as desired. The blank 74 can define the base 40 that, in turn, defines the mounting portion 26, the first arm 50 that extends out from a first side of the base 40, the third arm 56 that extends out from a second side of the base that is opposite the first side of the base 40 along the lateral direction A, the second arm 52 that extends out from a first end of the base 40, and the fourth arm 56 that extends out from a second end of the base that is opposite the first end of the base 40 along the longitudinal direction L. Thus, the first and third arms 50 and 54 extend out along opposite directions from the base 40, for instance along the lateral direction A. The first and third arms 50 and 54 can further be offset with respect to each other along the longitudinal direction L. The second and fourth arms 52 and 56 extend out along opposite directions from the base 40, for instance along the longitudinal direction L. The second and fourth arms 52 and 56 can further be offset with respect to each other along the lateral direction A.

A method of assembling the insulation displacement contact 22 can include the step of bending the first arm 50 at a first bend location 80 so as to define the first interface 60, and bending the first arm 50 about a bend location 81 that is oriented in the transverse direction T so as to define the first and second regions 70*a* and 70*b*, respectively. The method can further include the step of bending the second arm 52 at a second bend location so as to define the second interface 62. Thus, the first and second inner surfaces 50*a* and 52*a* of the first pair 46 of arms can be disposed at the first end of the contact body 23. Similarly, the method of assembling the insulation displacement contact 22 can include the step of bending the third arm 54 at a third bend location 84 so as to define the third interface 64, and bending the third arm 54 about a bend location 83 that is oriented in the transverse direction T so as to define the first and second regions 72*a* and 72*b*, respectively. The method can further include the step of bending the fourth arm 56 at a fourth bend location so as to define the fourth interface 66. Thus, the first and second inner surfaces 54*a* and 56*a* of the second pair 48 of arms can be disposed at the second end of the contact body 23.

Referring again to FIGS. 1A-1E, during operation, as the electrical cable 28 is inserted in the first insulation displacement slots 51, the first arm 50 can resiliently elastically flex along the lateral direction A with respect to the base 40 about the first interface 60, which is elongate along the longitudinal direction L. The second arm 52 does not flex with respect to the base 40 about the second interface 62, which is elongate along a direction perpendicular to the longitudinal direction L. Thus, the first arm 50 can flex away from the second arm 52 along the lateral direction A. Similarly, as the electrical cable 28 is inserted in the second insulation displacement slot 53, the third arm 54 can resiliently elastically flex along the lateral direction A with respect to the base 40 about the third interface 64, which is elongate along the longitudinal direction L. The fourth arm 56 does not flex with respect to the base 40 about the fourth interface 66, which is elongate along a direction perpendicular to the longitudinal direction L. Thus, the third arm 54 can flex away from the fourth arm 56 along the lateral direction A. The piercing member 37 of each of the first and second pairs 46 and 48 of arms can pierce the outer electrically insulative layer 39 of the electrical cable 28 and contact the electrical conductor 41 in the manner described above.

Thus, a method can be provided for placing the electrical cable 28 in electrical communication with the complementary electrical component 30. The method can include the step of inserting the electrical cable 28 into the first and second insulation displacement slots 51 and 53 defined by the mating portion 24, each of the first and second slots 51 and 53 at least partially defined by at least one piercing member 37, such that the piercing member 37 pierces the outer electrically insulative layer 39 of the electrical cable 28 and contacts the electrical conductor 41. The electrical cable 28 can be inserted into either one of the first and second insulation displacement slots 51 and 53 before the other one of the first and second insulation displacement slots 51 and 53, or can be inserted substantially simultaneously into the first and second insulation displacement slots 51 and 53. During the insertion step, the electrical cable can apply a force to a respective at least one of the walls that defines the first and second insulation displacement slots 51 and 53 that causes the respective at least one of the walls to resiliently elastically flex away from the other one of the walls that defines the first and second insulation displacement slots 51 and 53. For instance, the second and fourth arms 52 and 56 can be constructed as described herein with respect to the first and third arms 50 and 54, respectively. It should be further appreciated that the insulation displacement contact 22 can include both the first and second insulation displacement slots 51 and 53, or just the first insulation displacement slot 51 as desired. The method can further include the step of placing the mounting portion 26 of the insulation displacement contact 22 in electrical communication with the complementary electrical component 30 so as to establish electrical communication between the electrical conductor and the complementary electrical component. The placing step can further include the step of contacting the contact pad, and thus the electrical terminal 32, of the complementary electrical component 30 with the mounting portion 26 so as to place the mounting portion 26 and the complementary electrical component 30 in electrical communication with each other. The method can include the step of applying electrical current between the electrical cable and the complementary electrical component 30. The method can include the step of transmitting data between the electrical cable and the complementary electrical component 30.

A method can further be provided for selling one or more of the insulation displacement contacts 22 or the electrical connector assembly 20, the method including the steps of teaching to a third party one or more up to all of the above-described method steps, the insulative displacement contact 22 or the electrical connector assembly 20 or one or more up to all of the components thereof, and selling to the third party at least one or more up to all of the insulative displacement contact 22 or the electrical connector assembly 20 or one or more up to all of the components thereof.

Referring now to FIGS. 2A-2F, an electrical connector assembly 120 is identified with reference numerals corresponding to like elements of the electrical connector assembly 20 incremented by 100. The electrical connector assembly 120 can include at least one insulation displacement contact 122 such as a plurality of insulation displacement contacts 122 that define a mating portion 124 and a mounting portion 126. The electrical connector assembly 120 can further include at least one electrical cable 128 such as a plurality of electrical cables 128 that are configured to mate with a respective one of the insulation displacement contacts 122 at the mating portion 124, and a complementary electrical component 130 such as a substrate, for instance a printed circuit board. The insulation displacement contacts 122, and in particular the respective mounting portions 126, are configured to be mounted to a respective electrical terminal 132 of the complementary electrical component 130, which for instance can be configured as a mounting pad. Thus, the mounting portions 126 are each configured to be surface mounted, for instance soldered, welded, or the like, onto the complementary electrical component 130, for instance to the electrical terminal 132.

Alternatively or additionally, the mounting portion 126 can include a projection that is configured to be inserted into an aperture of the complementary electrical component 130. The projection can be press-fit into the aperture of the complementary electrical component 130, which can be an electrically conductive plated via. When the insulation displacement contact 122 is mounted to the complementary electrical component 130 and mated with the respective electrical cable 128, the electrical cable 128 is placed in electrical communication with the complementary electrical component 130. It should be appreciated that the complementary electrical component 130, and all complementary electrical components described herein, can be a printed circuit board or any suitable constructed alternative electrical component 130 as desired.

The insulation displacement contacts 122, and all insulation displacement contacts described herein, can be made from any suitable electrically conductive material, such as a metal. Each insulation displacement contact 122 can include an electrically conductive contact body 123 that defines both the mating portion 124 and the mounting portion 126, which can be monolithic with the mating portion 124. The mating portion 124 can include at least one slot that extends into the contact body 123, and at least one piercing member 137 that at least partially defines the slot such that, when the slot receives the electrical cable 128, the piercing member 137 pierces an outer electrically insulative layer 139 of the electrical cable 128 and contacts an electrical conductor 141 of the electrical cable 128 that is disposed inside the outer electrically insulative layer 139. The outer electrically insulative layer 139, and all outer electrically insulative layers as described herein, can be made of any suitable electrically insulative material as desired. The electrical conductor 141, and all electrical conductors as described herein, can be made from any suitable electrically conductive material as desired.

The electrically conductive contact body 123 can include a base 140 that defines an outer surface and an inner surface 144 that faces opposite the outer surface along the transverse direction T. The outer surface is configured to face the electrical terminal, and can be configured as an outer contact surface 142 that is configured to contact the electrical terminal 132. For instance, the outer contact surface 142 can be surface mounted, such as soldered or welded, to the electrical terminal 132. Alternatively, the base 140 can include mounting tails that extend from the outer surface and are configured to be inserted, for instance press-fit, into vias of the complementary electrical component 130. Thus, the mounting portion 126 can be defined by the base 140, and in particular the outer contact surface 142. When the outer contact surface 142 is in contact with the electrical terminal 132, either directly or indirectly, the electrical terminal 132 in placed in electrical communication with the mounting portion 126, and thus the mating portion 124. The outer contact surface 142 and the inner surface 144 can be spaced from each other along a transverse direction T. In particular, the inner surface 144 is spaced above, or up from, the outer contact surface 142 along the transverse direction T, and the outer contact surface 142 is spaced below, or down from, the inner surface 144 along the transverse direction T.

The mating portion 124 can include a first arm 150 that includes at least one surface 150*a* that defines a carrier aperture 161 extending through the first arm 150. For instance, the carrier aperture 161 can extend through the first arm 150 along a direction that is angularly offset with respect to the transverse direction T, for instance along a longitudinal direction L that is perpendicular to the transverse direction T. The mating portion 124 can further include a second arm 152 that includes at least one surface 152*a* that defines an insulation displacement slot 151 extending through the second arm 152, at least a portion of the at least one surface 152*a* of the second arm 152 defining a piercing member 137 that pierces the outer electrically insulative layer 139 of the electrical cable 128 and contacts an electrical conductor 141 of the electrical cable 128 that is disposed in the insulation displacement slot 151. During operation, one of the first and second arms 150 and 152 is movable with respect to the other of the first and second arms 150 and 152 between 1) a first position whereby the carrier aperture 161 is out of alignment with the insulation displacement slot 151, and 2) a second position whereby the carrier aperture 161 is aligned with the insulation displacement slot 151. For instance, the second arm 152 can be movable with respect to the base 140 and the first arm 150 between the first position and the second position. In particular, the second arm 152 can be movable with respect to the first arm 150 along a direction toward the base 140 from the first position to the second position. Because the carrier aperture 161 can be sized and shaped substantially equal to (e.g., slightly greater than) the outer surface of the outer electrically insulative layer 139 of the electrical cable 128 (for instance arc shaped or circular), the at least one surface 150*a* of the first arm 150 is configured to cause the electrical cable 128 to be stationary with the first arm 150 as the second arm 152 moves from the first position to the second position, which causes the electrical cable 128 to be inserted into the insulation displacement slot 151.

The at least one surface 152*a* of the second arm 152 can further define a retention aperture 125 that extends through the second arm 152 and is open to the insulation displacement slot 151. The insulation displacement slot 151 defines a first cross-sectional dimension along a lateral direction A, and the retention aperture 125 defines a second cross-sectional dimension along the lateral direction A that is greater than the first cross-sectional dimension. Thus, it can be said that the insulation displacement slot 151 and the retention aperture 125 extend through the second arm 152 along a second direction that is angularly offset with respect to the transverse direction T, and the first and second cross-sectional dimensions are in a third direction that is angularly offset with respect to each of the transverse direction T and the second direction. The second direction can be the longitudinal direction L, and the third direction can be the lateral direction A. The retention aperture 125 can be sized to receive the electrical cable 128 such that the at least one surface 152*a* retains the electrical cable 128 such that the electrical cable 128 is movable from the retention aperture 125 into the insulation displacement slot 151.

In accordance with one embodiment, the retention aperture 125 is spaced from the base 140 a first distance along the transverse direction T, and the insulation displacement slot 151 is spaced from the base 140 a second distance along the transverse direction T that is greater than the first distance. The at least one surface 152*a* that defines the retention aperture 125 can define a constant curvature at the retention aperture 125. For instance, the retention aperture 125 can be shaped substantially arcuate or circular to correspond to the outer diameter of the outer electrically insulative layer 139, and can be sized substantially equal to (e.g., slightly greater than) the outer electrically insulative layer 139. The inner surface 152*a* that defines the insulation displacement slot 151 is elongate, for instance in the transverse direction T away from the base 140 from the retention aperture 125, at the insulation displacement slot 151. The insulation displacement slot 151 can be elongate along the transverse direction T. Thus, the retention aperture 125 and the insulation displacement slot 151 can combine to define a keyhole shape, or the retention aperture can define any alternative shape or can be open. The lateral direction A can be substantially perpendicular with respect to each of the longitudinal direction L and the transverse direction T. Reference to the lateral direction A, the longitudinal direction L, and the transverse direction T, unless otherwise indicated, can refer to that direction or to any direction having the respective lateral direction A, longitudinal direction L, or transverse direction T, as a directional component thereof. When the second arm 152 is in the first position, the carrier aperture 161 can be aligned with the retention aperture 125, for instance in the longitudinal direction L. Thus, the electrical cable 128 extends through the carrier aperture 161 and the retention aperture 125. When the second arm 152 moves to the second position, the first arm 150 prevents the electrical cable 128 from moving with the second arm, thereby causing the electrical cable 128 to move from the retention aperture 125 into the insulation displacement slot 151.

In accordance with one embodiment, the first arm 150 extends out with respect to the base 140, and the second arm 152 extends out from the base 140. For instance, second arm can extend out indirectly from the base. In this regard, the insulation displacement contact 122 can include a bridge 127 that extends between, and is connected between, the base 140 and the second arm 152. The first arm 150 can extend out from the base 140, and in particular out from a first end of the base 140. The bridge 127 can extend out from a second end of the base 140 that is spaced from the first end of the base 140 along the longitudinal direction L. Thus, the first and second arms 150 and 152 extend from opposite ends of the base 140.

With continuing reference to FIGS. 2A-2F, the second arm 152 defines a first region 170*a* and a second region 170*b* that is spaced from the first region 170*a* such that the first arm 150 is disposed between the first and second regions 170*a* and 170*b* along the longitudinal direction. The first region 170*a* can include the at least one surface 152*a*, and thus the insulation displacement slot 151 and the retention aperture 125. The first region 170*a* can extend from the bridge 127 away from the base 140, and the second region can extend from the first region 170*a* toward the base 140. The second region 170*b* can terminate above the base 140. The bridge 127 can define a flexible support wall that extends between the base 140 and the first region 170*a*, so as to render the second arm 152 flexible with respect to the first arm 150 and movable between the first and second positions.

The second region 170*b* can include second at least one surface 152*b* that defines a second insulation displacement slot 153 that extends through the through the second arm 152, in particular at the second region 170*b*, for instance along the longitudinal direction L. The at least one surface 152*a* of the second arm 152 defining a piercing member 137 that pierces the outer electrically insulative layer 139 of the electrical cable 128 and contacts an electrical conductor 141 of the electrical cable 128 that is disposed in the insulation displacement slot 153. During operation, the one of the first and second arms 150 and 152 is movable with respect to the other of the first and second arms 150 and 152 between 1) a first position whereby the carrier aperture 161 is out of alignment with the second insulation displacement slot 153, and 2) a second position whereby the carrier aperture 161 is aligned with the second insulation displacement slot 153. For instance, the second arm 152 can be movable with respect to the base 140 and the first arm 150 between the first position and the second position. In particular, the second arm 152 can be movable with respect to the first arm 150 along a direction toward the base 140 from the first position to the second position. Because the carrier aperture 161 can be sized and shaped substantially equal to (e.g., slightly greater than) the outer surface of the outer electrically insulative layer 139 of the electrical cable 128 (for instance arc shaped or circular), the at least one surface 150*a* of the first arm 150 is configured to cause the electrical cable 128 to be stationary with the first arm 150 as the second arm 152 moves from the first position to the second position, which causes the electrical cable 128 to be inserted into the insulation displacement slots 151 and 153.

The surface 152*a* of the second arm 152 can further define a second retention aperture 129 that extends through the second arm 152, and in particular the second region 170*b*, and is open to the second insulation displacement slot 153. The second insulation displacement slot 153 defines a first cross-sectional dimension along a lateral direction A, and the second retention aperture 129 defines a second cross-sectional dimension along the lateral direction A that is greater than the first cross-sectional dimension of the second insulation displacement slot 153. Thus, it can be said that the second insulation displacement slot 153 and the second retention aperture 129 extend through the second arm 152, and in particular the second region 170*b*, along a second direction that is angularly offset with respect to the transverse direction T, and the first and second cross-sectional dimensions are in a third direction that is angularly offset with respect to each of the transverse direction T and the second direction. The second direction can be the longitudinal direction L, and the third direction can be the lateral direction A. The second retention aperture 129 can be sized to receive the electrical cable 128 such that the second at least one surface 152*b* retains the electrical cable 128 such that the electrical cable 128 is movable from the second retention aperture 129 into the second insulation displacement slot 153. The first cross-sectional dimension of the each of first and second insulation displacement slots 151 and 153 can be substantially equal to each other, and the second cross-sectional dimension of each of the retention apertures 125 and 129 can be substantially equal to each other. Further, the first and second insulation displacement slots 151 and 153 can be aligned with each other, for instance along the longitudinal direction L, and the first and second retention apertures 125 and 129 can also be aligned with each other, for instance along the longitudinal direction L.

In accordance with one embodiment, the second retention aperture 129 is spaced from the base 140 a first distance along the transverse direction T, and the insulation displacement slot 153 is spaced from the base 140 a second distance along the transverse direction T that is greater than the first distance. The second at least one surface 152*b* that defines the second retention aperture 125 can define a constant curvature at the second retention aperture 129. For instance, the second retention aperture 129 can be shaped substantially arcuate or circular to correspond to the outer diameter of the outer electrically insulative layer 139, and can be sized substantially equal to (e.g., slightly greater than) the outer electrically insulative layer 139. The second at least one surface 152*b* that defines the second insulation displacement slot 153 is elongate, for instance in the transverse direction T away from the base 140 from the second retention aperture 129, at the second insulation displacement slot 153. The second insulation displacement slot 153 can be elongate along the transverse direction T. Thus, the second retention aperture 129 and the second insulation displacement slot 153 can combine to define a keyhole shape, or the retention aperture can define any alternative shape or can be open. When the second arm 152 is in the first position, the carrier aperture 161 can be aligned with the retention apertures 125 and 129, for instance in the longitudinal direction L. Thus, the electrical cable 128 extends through the carrier aperture 161 and the retention apertures 125 and 129. When the second arm 152 moves to the second position, the first arm 150 prevents the electrical cable 128 from moving with the second arm 152, thereby causing the electrical cable 128 to move from the retention apertures 125 and 129 into the insulation displacement slots 151 and 153. It should be appreciated that the insulation displacement contact can define first and second insulation displacement slots 151 and 153, or one of the insulation displacement slots 151 and 153 can be configured as a retention slot that does not provide for insulation displacement and contact with the electrical conductor 141. For instance, the second insulation displacement slot 153 can be configured as a strain relief aperture that compresses against or pierces into the outer electrically insulative layer 139 so as to provide a force against the outer electrically insulative layer 139 that resists a pull-out force against the electrical cable 128 and prevents the pull-out force from being transferred to the connection of the piercing member of the insulation displacement slot 151 against the surface 150*a* of the electrical conductor 141.

A method can be provided for placing the electrical cable 128 in electrical communication with the complementary electrical component 130. The method can include the steps of placing the mounting portion 126 of the insulation displacement contact 122 in electrical communication with the complementary electrical component 130. The method can further include the step of inserting the electrical cable 128 in the carrier aperture 161 of the first arm 150 of the insulation displacement contact 122, and the retention aperture 125 of the second arm 152 of the insulation displacement contact 122, the second arm 152 disposed adjacent the first arm 150. The method can further include the step of moving the second arm 152 relative to the first arm 150 such that the carrier aperture 161 causes the electrical cable to move from the retention aperture 125 to the insulation displacement slot 151 of the second arm 152 that is open to the retention aperture 125. The method can further include the step of, during the moving step, causing at least a portion of the at least one surface 152*a* of the second arm 152 that at least partially defines the insulation displacement slot 151 to pierce the outer electrically insulative layer 139 of the electrical cable 128 and physically and electrically contact the electrical conductor 141 of the electrical cable 128.

The method, and all methods of placing an electrical cable in communication with a complementary electrical component, unless otherwise noted, can include the step of applying electrical current between the electrical cable and the complementary electrical component. Further, the method, and all methods of placing an electrical cable in communication with a complementary electrical component, unless otherwise noted, can include the step of applying a data signal between the electrical cable and the complementary electrical component.

A method can further be provided for selling the insulative displacement contact 122 or the electrical connector assembly 120. The method can include the step of teaching to a third party one or more up to all of the method steps; and selling to the third party the insulative displacement contact 122 or the electrical connector assembly 120.

Figure 3A:
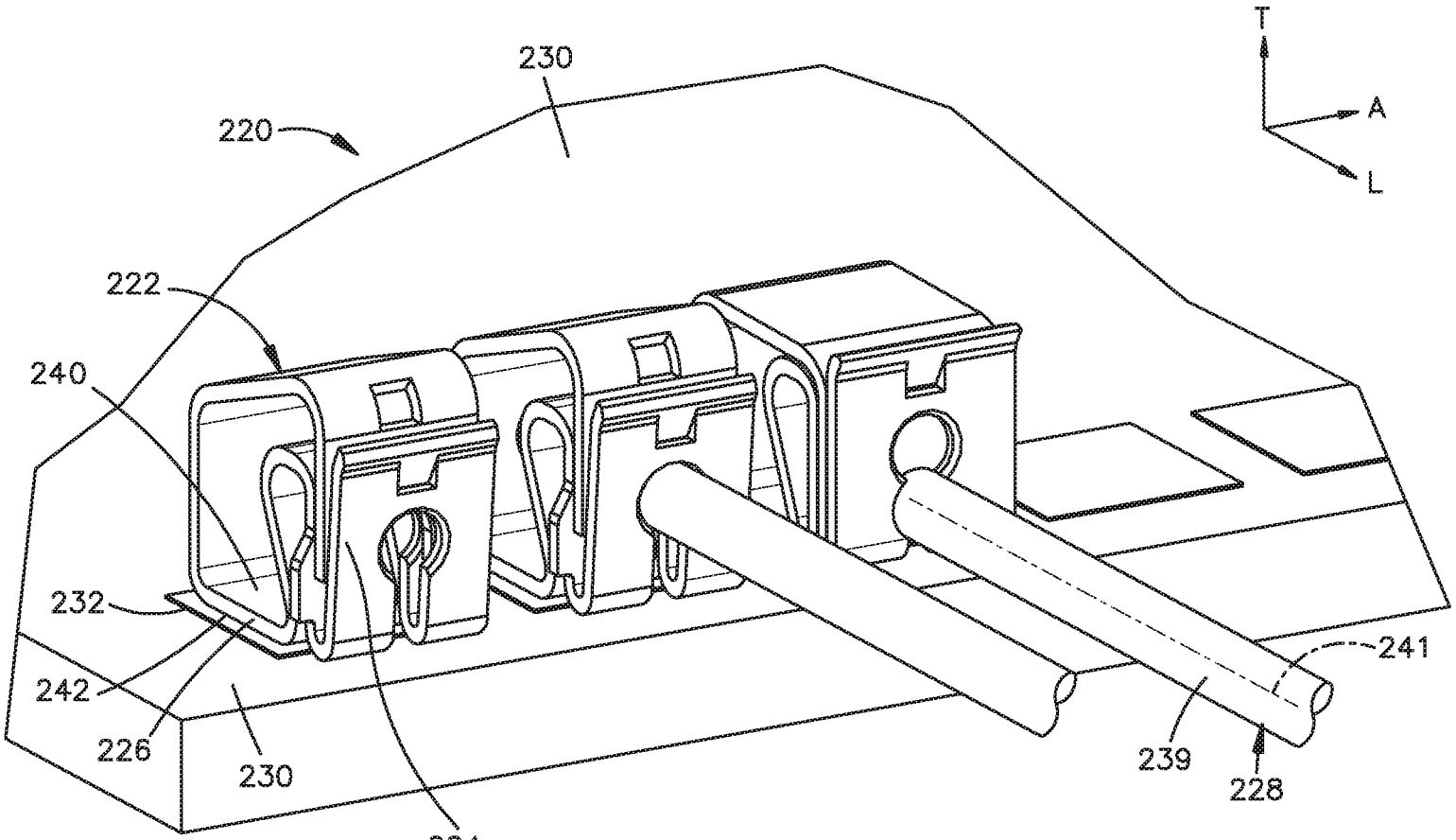
FIG. 3A is a perspective view of an electrical connector assembly constructed in accordance with another embodiment, including a printed circuit board, a plurality of electrical cables, and a plurality of insulation displacement contacts configured to be mounted to the printed circuit board.
Figure 3B:
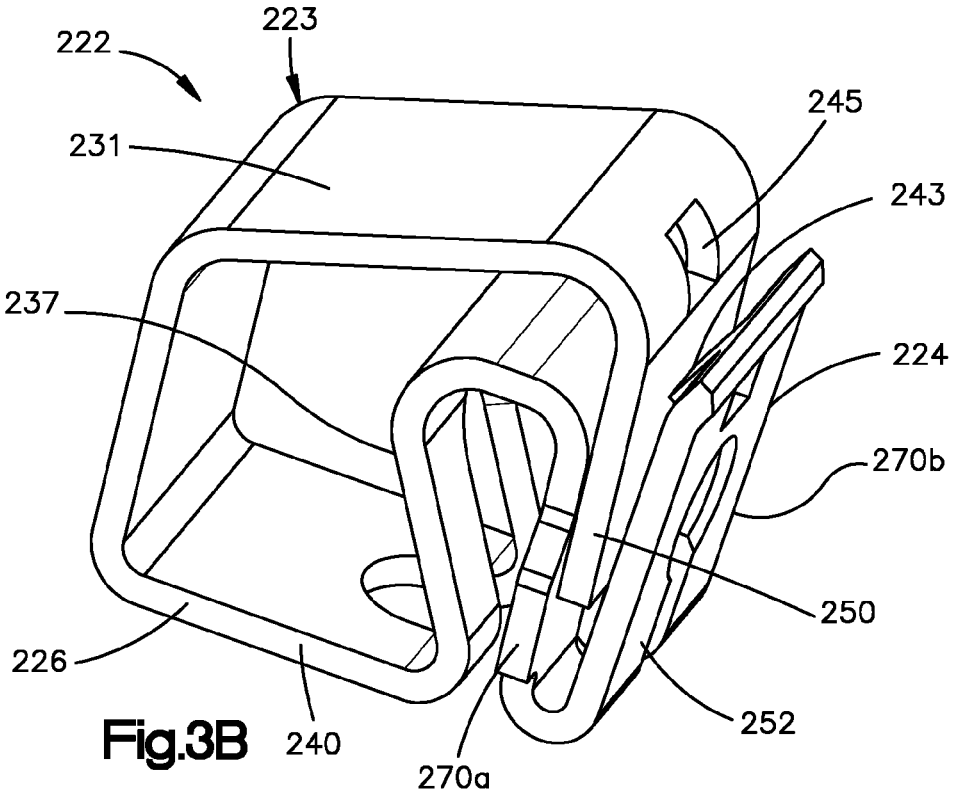
FIG. 3B is a perspective view of an insulation displacement contact illustrated in FIG. 3A, shown in an unactuated configuration.
Figure 3C:
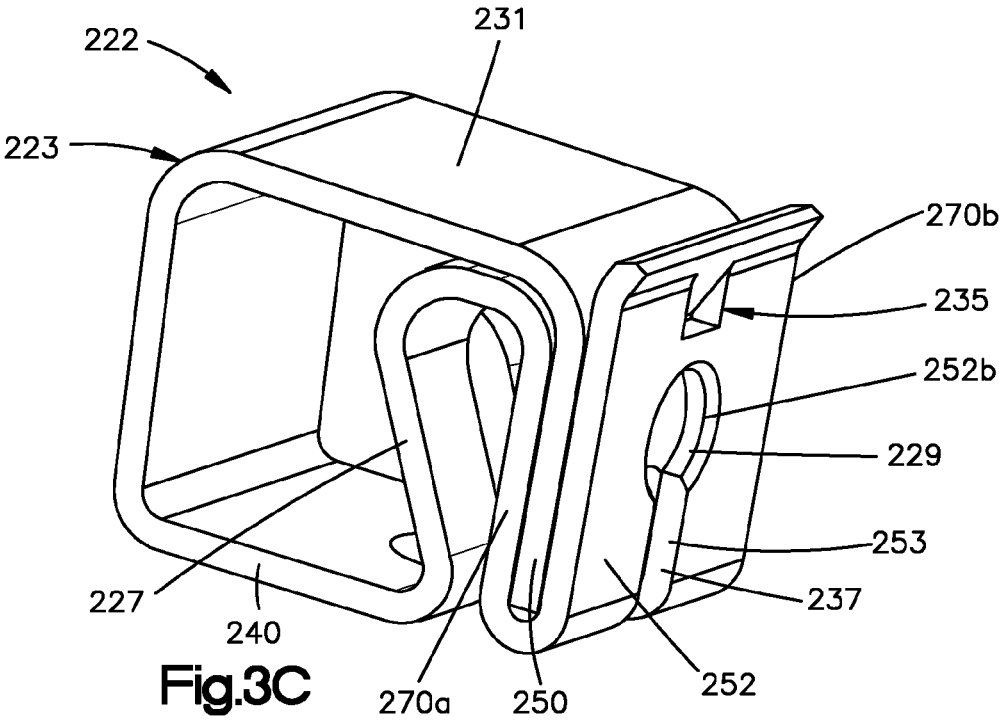
FIG. 3C is a perspective view of the insulation displacement contact illustrated in FIG. 3B, shown in an actuated configuration.
Figure 3D:
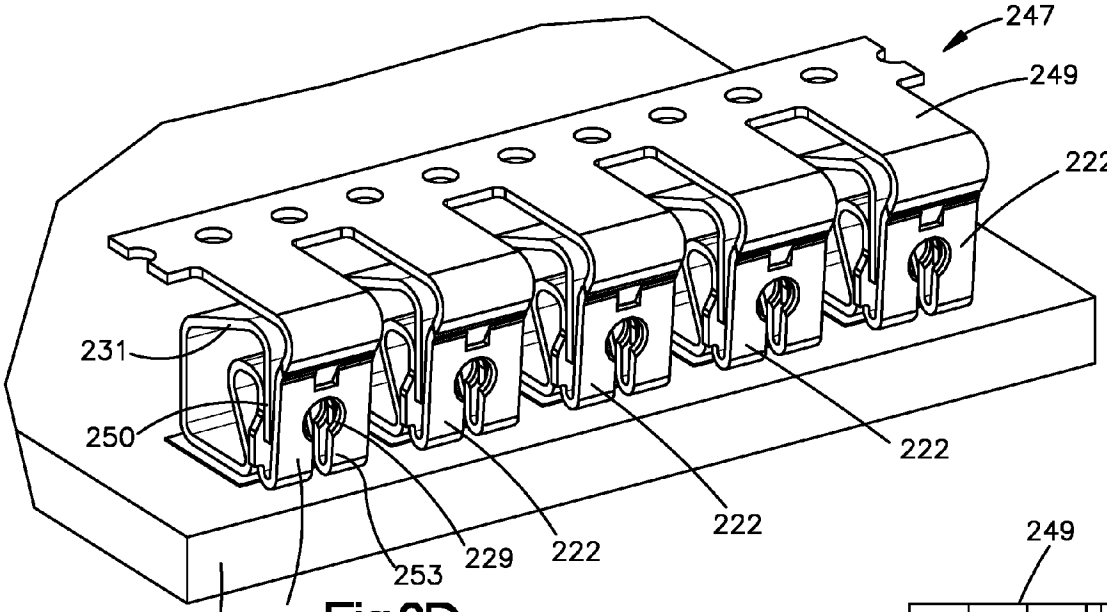
FIG. 3D is a perspective view of the electrical connector assembly illustrated in FIG. 3A, showing the insulation displacement contacts attached to a common carrier strip.
Figure 3E:
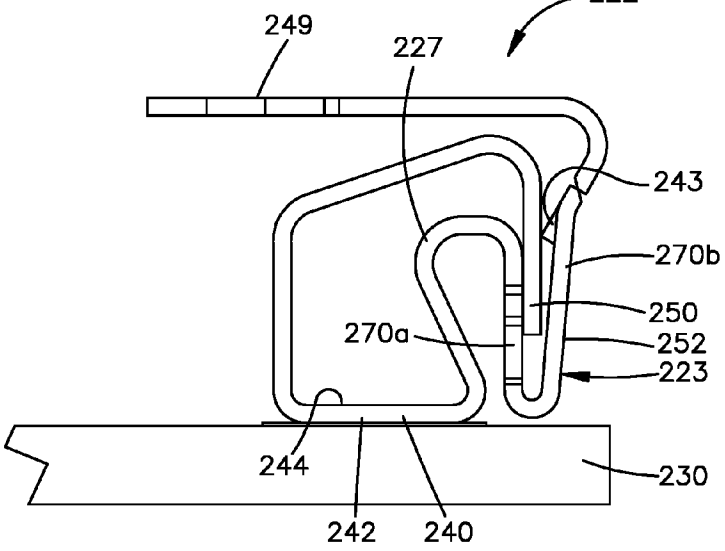
FIG. 3E is a side elevation view of the electrical connector assembly illustrated in FIG. 3D.
Figure 3F:
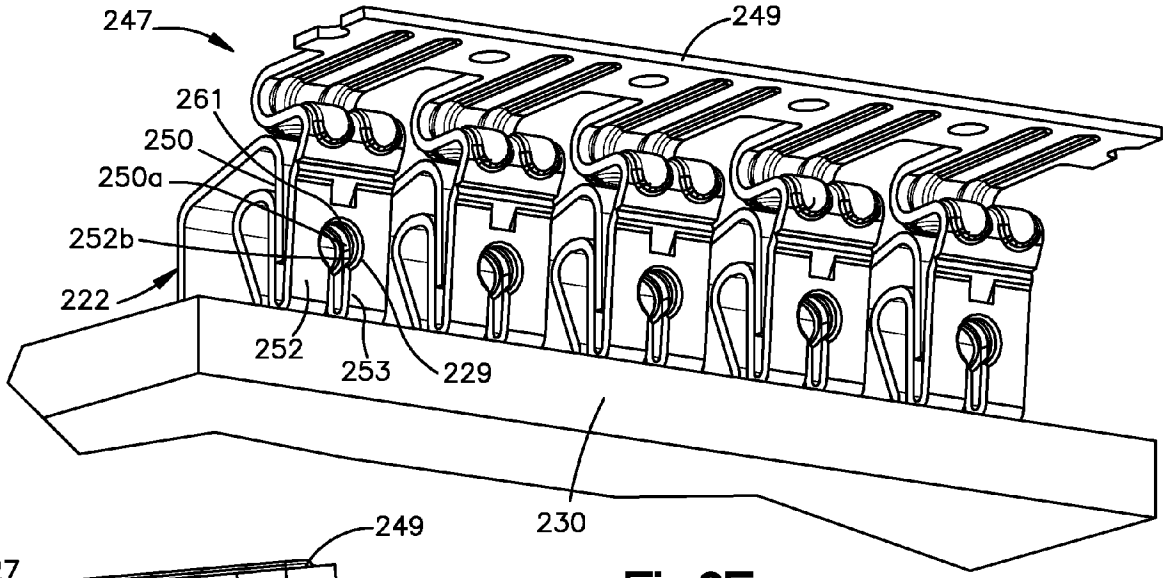
FIG. 3F is a perspective view of the electrical connector assembly illustrated in FIG. 3D, showing the carrier strip constructed as a lever configured to actuate the insulation displacement contacts from the unactuated configuration to the actuated configuration.
Figure 3G:
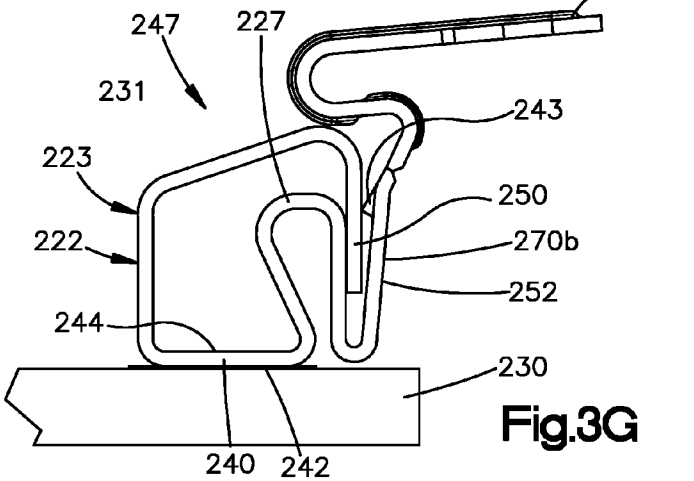
FIG. 3G is a side elevation view of the electrical connector assembly illustrated in FIG. 3F.

Referring now to FIGS. 3A-3C, an electrical connector assembly 220 is identified with reference numerals corresponding to like elements of the electrical connector assembly 120 incremented by 100. The electrical connector assembly 220 can include at least one insulation displacement contact 222 such as a plurality of insulation displacement contacts 222 that define a mating portion 224 and a mounting portion 226. The electrical connector assembly 220 can further include at least one electrical cable 228 such as a plurality of electrical cables 228 that are configured to mate with a respective one of the insulation displacement contacts 222 at the mating portion 224, and a complementary electrical component 230 such as a substrate, for instance a printed circuit board. The insulation displacement contacts 222, and in particular the respective mounting portions 226, are configured to be mounted to a respective electrical terminal 232 of the complementary electrical component 230, which for instance can be configured as a mounting pad. Thus, the mounting portions 226 are each configured to be surface mounted, for instance soldered, welded, or the like, onto the complementary electrical component 230, for instance to the electrical terminal 232.

Alternatively or additionally, the mounting portion 226 can include a projection that is configured to be inserted into an aperture of the complementary electrical component 230. The projection can be press-fit into the aperture of the complementary electrical component 230, which can be an electrically conductive plated via. When the insulation displacement contact 222 is mounted to the complementary electrical component 230 and mated with the respective electrical cable 228, the electrical cable 228 is placed in electrical communication with the complementary electrical component 230. It should be appreciated that the complementary electrical component 230, and all complementary electrical components described herein, can be a printed circuit board or any suitable constructed alternative electrical component 230 as desired.

The insulation displacement contacts 222, and all insulation displacement contacts described herein, can be made from any suitable electrically conductive material, such as a metal. Each insulation displacement contact 222 can include an electrically conductive contact body 223 that defines both the mating portion 224 and the mounting portion 226, which can be monolithic with the mating portion 224. The mating portion 224 can include at least one slot that extends into the contact body 223, and at least one piercing member 237 that at least partially defines the slot such that, when the slot receives the electrical cable 228, the piercing member 237 pierces an outer electrically insulative layer 239 of the electrical cable 228 and contacts an electrical conductor 241 of the electrical cable 228 that is disposed inside the outer electrically insulative layer 239. The outer electrically insulative layer 239, and all outer electrically insulative layers as described herein, can be made of any suitable electrically insulative material as desired. The electrical conductor 241, and all electrical conductors as described herein, can be made from any suitable electrically conductive material as desired.

The electrically conductive contact body 223 can include a base 240 that defines an outer surface and an inner surface 244 that faces opposite the outer surface along the transverse direction T. The outer surface is configured to face the electrical terminal, and can be configured as an outer contact surface 242 that is configured to contact the electrical terminal 232. For instance, the outer contact surface 242 can be surface mounted, such as soldered or welded, to the electrical terminal 232. Alternatively, the base 240 can include mounting tails that extend from the outer surface and are configured to be inserted, for instance press-fit, into vias of the complementary electrical component 230. Thus, the mounting portion 226 can be defined by the base 240, and in particular the outer contact surface 242. When the outer contact surface 242 is in contact with the electrical terminal 232, either directly or indirectly, the electrical terminal 232 in placed in electrical communication with the mounting portion 226, and thus the mating portion 224. The outer contact surface 242 and the inner surface 244 can be spaced from each other along a transverse direction T. In particular, the inner surface 244 is spaced above, or up from, the outer contact surface 242 along the transverse direction T, and the outer contact surface 242 is spaced below, or down from, the inner surface 244 along the transverse direction T.

The mating portion 224 can include a first arm 250 that includes at least one surface 250*a* that defines a carrier aperture 261 extending through the first arm 250. The carrier aperture 261, and all carrier apertures of the type described herein unless otherwise indicated, can substantially surround the electrical cable 228, or be defined by a surface that is configured to apply a force to the electrical cable 228 that moves the electrical cable 228 into an insulation displacement slot. For instance, the carrier aperture 261 can extend through the first arm 250 along a direction that is angularly offset with respect to the transverse direction T, for instance along a longitudinal direction L that is perpendicular to the transverse direction T. The mating portion 224 can further include a second arm 252 that includes at least one surface 252*a* that defines an insulation displacement slot 251 extending through the second arm 252, at least a portion of the at least one surface 252*a* of the second arm 252 defining a piercing member 237 that pierces the outer electrically insulative layer 239 of the electrical cable 228 and contacts an electrical conductor 241 of the electrical cable 228 that is disposed in the insulation displacement slot 251. During operation, one of the first and second arms 250 and 252 is movable with respect to the other of the first and second arms 250 and 252 between 1) a first position whereby the carrier aperture 261 is out of alignment with the insulation displacement slot 251, and 2) a second position whereby the carrier aperture 261 is aligned with the insulation displacement slot 251. For instance, the first arm 250 can be movable with respect to the base 240 and the second arm 252 between the first position and the second position. In particular, the first arm 250 can be movable with respect to the second arm 252 along a downward direction toward the base 240 from the first position to the second position. Because the carrier aperture 261 can be sized and shaped substantially equal to (e.g., slightly greater than) the outer surface of the outer electrically insulative layer 239 of the electrical cable 228 (for instance arc shaped or circular), the electrical cable 228 disposed in the carrier aperture 261 moves with the first arm downward toward the base 240 as the first arm moves downward toward the base 240 from the first position to the second position. As the electrical cable 228 moves with the first arm from the first position to the second position, the electrical cable 228 moves into the insulation displacement slot 251 of the second arm 252.

Figure 3H:
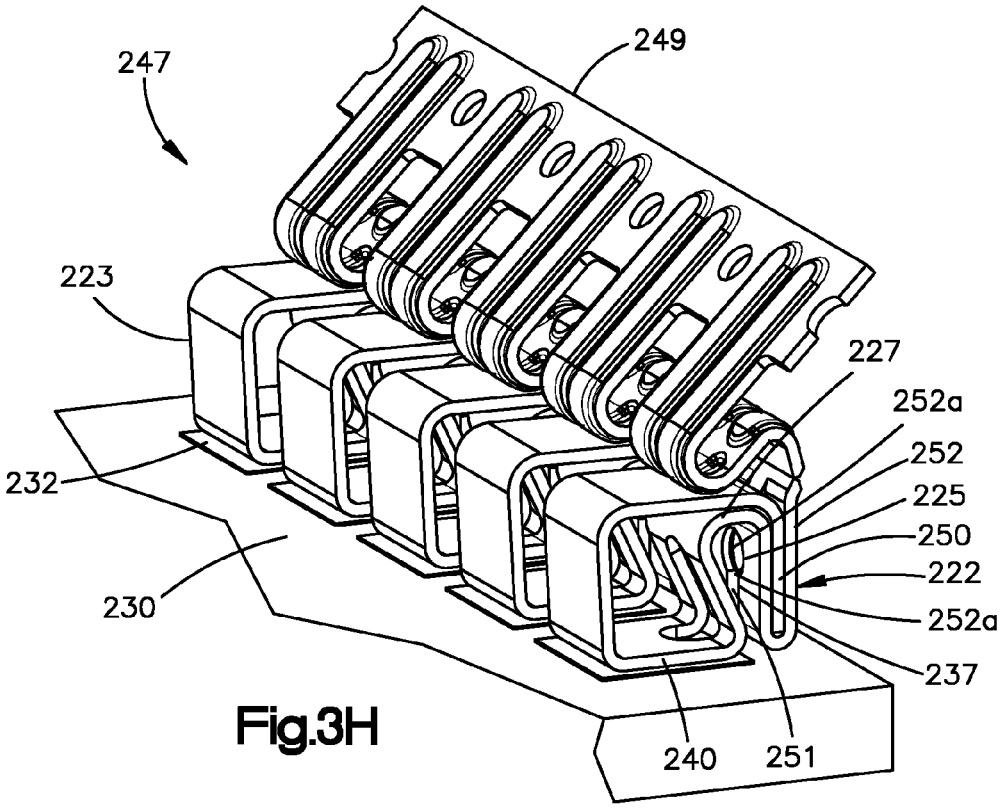
FIG. 3H is another perspective view of the electrical connector assembly illustrated in FIG. 3F, but shown in the actuated configuration.

The at least one surface 252*a* of the second arm 252 can further define a retention aperture 225 (see FIG. 3H) that extends through the second arm 252 and is open to the insulation displacement slot 251. The insulation displacement slot 251 defines a first cross-sectional dimension along a lateral direction A, and the retention aperture 225 defines a second cross-sectional dimension along the lateral direction A that is greater than the first cross-sectional dimension. Thus, it can be said that the insulation displacement slot 251 and the retention aperture 225 extend through the second arm 252 along a second direction that is angularly offset with respect to the transverse direction T, and the first and second cross-sectional dimensions are in a third direction that is angularly offset with respect to each of the transverse direction T and the second direction. The second direction can be the longitudinal direction L, and the third direction can be the lateral direction A. The retention aperture 225 can be sized to receive the electrical cable 228 so that the at least one surface 252*a* retains the electrical cable 228 when the first arm 250 is in the first position.

In accordance with one embodiment, the retention aperture 225 is spaced from the base 240 a first distance along the transverse direction T, and the insulation displacement slot 251 is spaced from the base 240 a second distance along the transverse direction T that is less than the first distance. The at least one surface 252*a* that defines the retention aperture 225 can define a constant curvature at the retention aperture 225. For instance, the retention aperture 225 can be shaped substantially arcuate or circular to correspond to the outer diameter of the outer electrically insulative layer 239, and can be sized substantially equal to (e.g., slightly greater than) the outer electrically insulative layer 239. The at least one surface 252*a* that defines the insulation displacement slot 251 is elongate, for instance in the transverse direction T toward the base 240 from the retention aperture 225, at the insulation displacement slot 251. The insulation displacement slot 251 can be elongate along the transverse direction T. Thus, the retention aperture 225 and the insulation displacement slot 251 can combine to define a keyhole shape, or the retention aperture can define any alternative shape or can be open. The lateral direction A can be substantially perpendicular with respect to each of the longitudinal direction L and the transverse direction T. When the first arm 250 is in the first position, the carrier aperture 261 can be aligned with the retention aperture 225, for instance in the longitudinal direction L. Thus, the electrical cable 228 extends through the carrier aperture 261 and the retention aperture 225. When the first arm 250 moves to the second position, the first arm 250 urges the electrical cable 228 to move from the retention aperture 225 into the insulation displacement slot 251.

In accordance with one embodiment, the first arm 250 extends out with respect to the base 240, and the second arm 252 extends out from the base 240. For instance, one or both of the first and second arms 250 and 252 can extend out indirectly from the base 240. In this regard, the insulation displacement contact 222 can include a first bridge 231 that extends out from the base 240, such as a first end of the base 240, along the transverse direction T, and can further extend along the longitudinal direction L to the first arm 250, such that the first arm is cantilevered and extends down from the first bridge 231 along the transverse direction. The first bridge 231 can be configured as a flexible support wall that is configured to flex with respect to the base 240 as the first arm 250 moves from the first position to the second position. The insulation displacement contact can further include a second bridge 227 that extends between, and is connected between, the base 240 and the second arm 252. The second bridge 227 can extend out from a second end of the base 240 that is spaced from the first end of the base 240 along the longitudinal direction L. The insulation displacement contact 222 can include an opening that extends through the second bridge 227, for instance along the longitudinal direction L, that is sized to receive the electrical cable 228. Thus, the electrical cable can extend through the second bridge 227 when the electrical cable 228 is mated to the insulation displacement contact 222. It should be appreciated, in accordance with one embodiment, that the first and second arms 250 and 252 extend from opposite ends of the base 240. The second bridge 227 can define a stop surface that is configured to contact the first bridge 231 when the first arm 250 is in the second position.

With continuing reference to FIGS. 3A-3C, the second arm 252 defines a first region 270*a* and a second region 270*b* that is spaced from the first region 270*a*, for instance along the longitudinal direction L, such that the first arm 250 is disposed between the first and second regions 270*a* and 270*b* along the longitudinal direction L. The first region 270*a* can include the at least one surface 252*a*, and thus the insulation displacement slot 251 and the retention aperture 225. The first region 270*a* can extend from the second bridge 227 downward along the transverse direction T and toward the base 240, and the second region 270*b* can extend upward from the first region 270*a* along the transverse direction T away from the base 240. The second region 270*b* can include a second at least one surface 252*b* that defines a second insulation displacement slot 253 that extends through the through the second arm 252, in particular at the second region 270*b*, for instance along the longitudinal direction L. The at least one second surface 252*b* of the second arm 252 defining a piercing member 237 that pierces the outer electrically insulative layer 239 of the electrical cable 228 and contacts an electrical conductor 241 of the electrical cable 228 that is disposed in the second insulation displacement slot 253.

The second at least one inner surface 252*b* of the second arm 252 can further define a second retention aperture 229 that extends through the second arm 252, and in particular the second region 270*b*, and is open to the second insulation displacement slot 253. The second insulation displacement slot 253 defines a first cross-sectional dimension along a lateral direction A, and the second retention aperture 229 defines a second cross-sectional dimension along the lateral direction A that is greater than the first cross-sectional dimension of the second insulation displacement slot 253. Thus, it can be said that the second insulation displacement slot 253 and the second retention aperture 229 extend through the second arm 252, and in particular the second region 270*b*, along a second direction that is angularly offset with respect to the transverse direction T, and the first and second cross-sectional dimensions are in a third direction that is angularly offset with respect to each of the transverse direction T and the second direction. The second direction can be the longitudinal direction L, and the third direction can be the lateral direction A. The second retention aperture 229 can be sized to receive the electrical cable 228 such that the second at least one surface 252*b* retains the electrical cable 228 such that the electrical cable 228 is movable from the second retention aperture 229 into the second insulation displacement slot 253. The first cross-sectional dimension of the each of first and second insulation displacement slots 251 and 253 can be substantially equal to each other, and the second cross-sectional dimension of each of the retention apertures 225 and 229 can be substantially equal to each other. Further, the first and second insulation displacement slots 251 and 253 can be aligned with each other, for instance along the longitudinal direction L, and the first and second retention apertures 225 and 229 can also be aligned with each other, for instance along the longitudinal direction L.

In accordance with one embodiment, the second retention aperture 229 is spaced from the base 240 a first distance along the transverse direction T, and the insulation displacement slot 253 is spaced from the base 240 a second distance along the transverse direction T that is less than the first distance. The second at least one surface 252*b* that defines the second retention aperture 229 can define a constant curvature at the second retention aperture 229. For instance, the second retention aperture 229 can be shaped substantially arcuate or circular to correspond to the outer diameter of the outer electrically insulative layer 239, and can be sized substantially equal to (e.g., slightly greater than) the outer electrically insulative layer 239. The second at least one surface 252*b* that defines the second insulation displacement slot 253 is elongate, for instance downward along the transverse direction T toward the base 240 from the second retention aperture 229, at the second insulation displacement slot 253. The second insulation displacement slot 253 can thus be elongate along the transverse direction T. Thus, the second retention aperture 229 and the second insulation displacement slot 253 can combine to define a keyhole shape, or the retention aperture can define any alternative shape or can be open.

When the first arm 250 is in the first position, the carrier aperture 261 can be aligned with the retention apertures 225 and 229, for instance in the longitudinal direction L. Thus, the electrical cable 228 extends through the carrier aperture 261 and the retention apertures 225 and 229. When the first arm 250 moves to the second position, the first arm causes the electrical cable 228 to move from the first and second retention apertures 225 and 229 into the respective first and second insulation displacement slots 251 and 253. It should be appreciated that the insulation displacement contact 222 can define first and second insulation displacement slots 251 and 253, or one of the insulation displacement slots 251 and 253 can be configured as a retention slot that does not provide for insulation displacement and contact with the electrical conductor 241. For instance, the second insulation displacement slot 253 can be configured as a strain relief aperture that compresses against or pierces into the outer electrically insulative layer 239 so as to provide a force against the outer electrically insulative layer 239 that resists a pull-out force against the electrical cable 228 and prevents the pull-out force from being transferred to the connection of the piercing member of the insulation displacement slot 251 against the electrical conductor 241.

With continuing reference to FIGS. 3A-3C, the insulation displacement contact 222 can include a lock mechanism 235 that is movable between an engaged configuration and a disengaged configuration. When the lock mechanism 235 is in the engaged configuration, the lock mechanism 235 prevents movement of the first arm 250 from the second position toward the first position. When the lock mechanism 235 is in the disengaged configuration, the lock mechanism 235 does not prevent movement of the first arm 250 from the second position toward the first position. For instance, the lock mechanism 235 can include complementary engagement members on each of the first and second arms 250 and 252 that are configured to engage when the lock mechanism 235 is in the engaged configuration, so as to interfere with each other and prevent movement of the first arm from the second position toward the first position. The complementary engagement members are configured, in response to a removal force, to disengage so as to remove the interference.

Figure 3I:
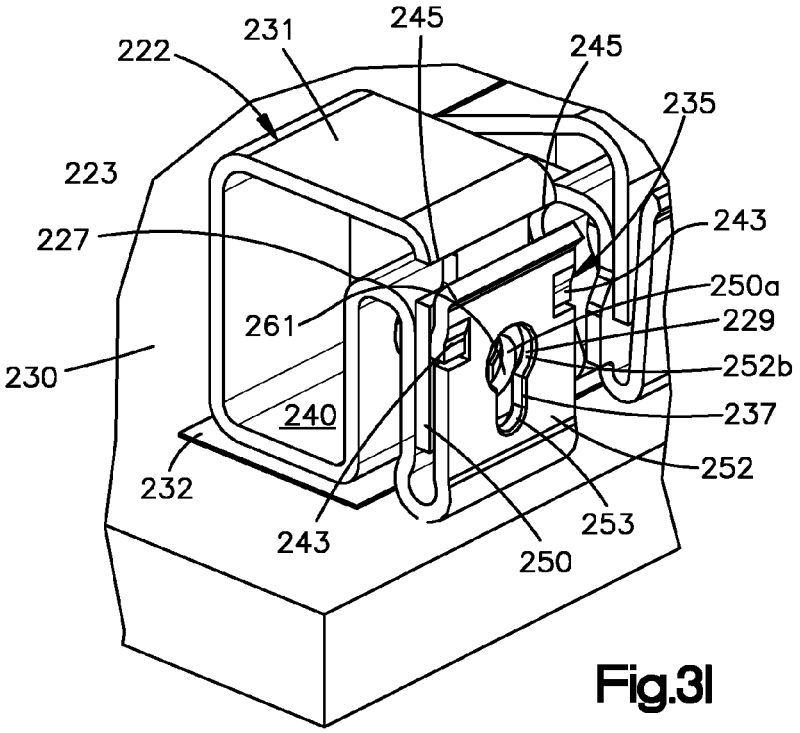
FIG. 3I is a perspective view of the insulation displacement contact illustrated in FIG. 3B, but including a latch assembly constructed in accordance with an alternative embodiment.
Figure 3J:
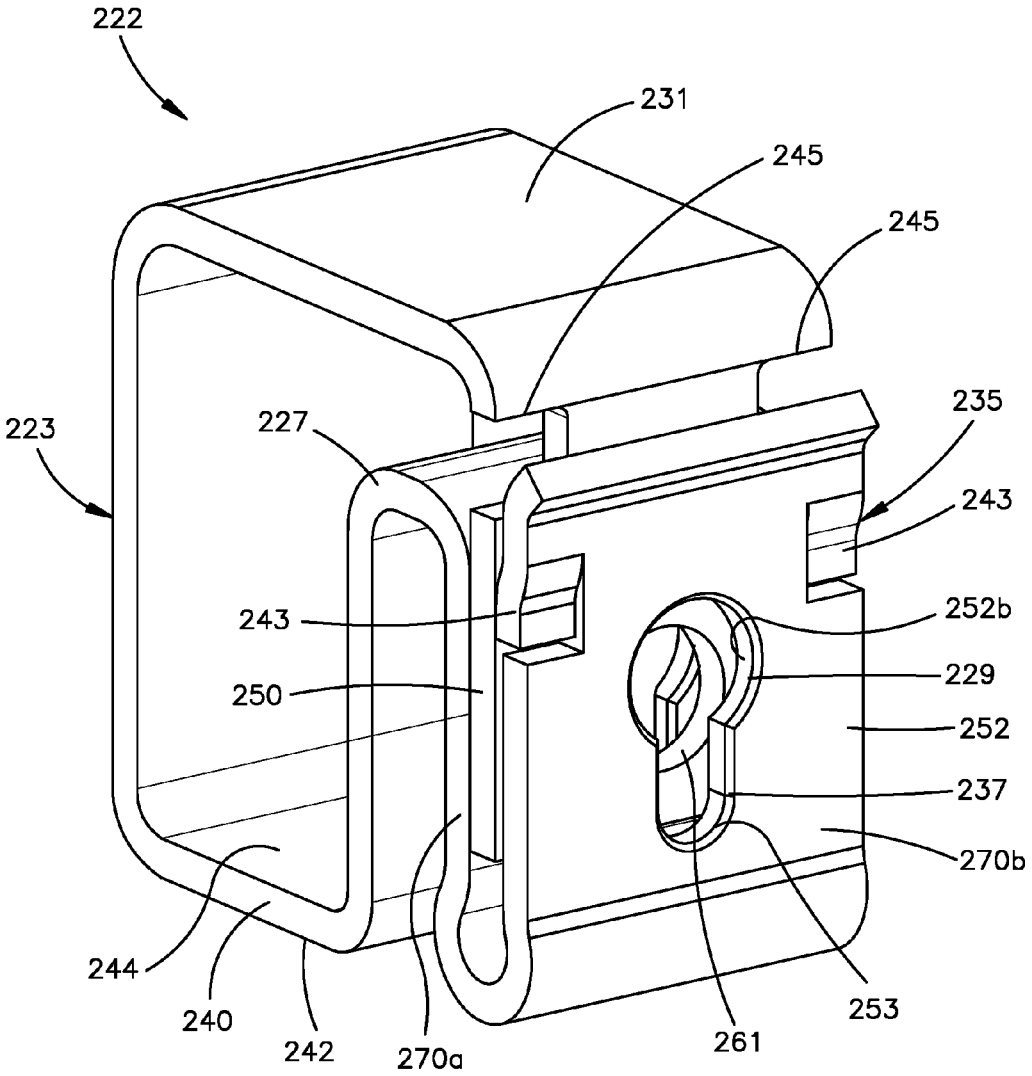
FIG. 3J is another perspective view of the insulation displacement contact illustrated in FIG. 3I.

For instance, in accordance with one embodiment, the lock mechanism 235 can include at least one engagement member of the second arm 252 that can be configured as a protrusion 243 that can protrude from the second region 270*b* toward the first arm 250, though could alternatively protrude from the first region 270*a* toward the first arm 250. The lock mechanism 235 can further include at least one engagement member of the first arm 250 that can be configured as a recess, such as a window 245 that extends at least into or through the first arm 250. When the one of the first and second arms 250 and 252, for instance the first arm 250 as illustrated in FIGS. 3A-3C, is in the first position, the protrusion 243 is not disposed in the window 245, and the first and second arms 250 and 252 are movable with respect to each other. However, when the one of the first and second arms 250 and 252, for instance the first arm 250 as illustrated in FIGS. 3A-3C, is in the second position, the protrusion 243 is extends into the window 245 so as to interfere with the first arm 250 to prevent movement of the first arm 250 with respect to the second arm 252 from the second position toward the first position. Alternatively, the at least one engagement member of the first arm 250 can be a protrusion, and the at least one engagement member of the second arm 252 can be a window. Further, as illustrated in FIGS. 3I-3J, the second arm 252 can include first and second engagement members configured as protrusions 243, and the first arm 250 can similarly include first and second engagement members configured as windows 245 that are configured to receive the corresponding ones of the first and second protrusions 243 when the first arm 250 is in the first position.

Referring now to FIGS. 3D-3H, the electrical connector assembly 220 can include an insulation displacement contact assembly 247 including a plurality of the insulation displacement contacts 222 of the insulation displacement contacts made from a single monolithic structure of stock material, such as a sheet of metal, that is formed to define all of the insulation displacement contacts spaced from each other along the lateral direction A. The single monolithic structure can further include a carrier strip 249 that is flexible and movable from an unactuated position to an actuated position. Movement of the carrier strip 249 to the actuated position causes the carrier strip 249 to urges the first arm to move from the first position to the second position. In this regard, the carrier strip 249 is configured as a lever that is flexed to the engaged position, and biases the first arm 250 to move from the first position to the second position. The carrier strip 249 can extend from the second arm 252, and in particular from the second region 270*b* of the second arm 252 in accordance with one embodiment.

A method can be provided for placing the electrical cable 228 in electrical communication with the complementary electrical component 230. The method can include the steps of placing the mounting portion 226 of the insulation displacement contact 222 in electrical communication with the complementary electrical component 230. The method can further include the step of inserting the electrical cable 228 in the carrier aperture 261 of the first arm 250 of the insulation displacement contact 222, and the retention aperture 225 of the second arm 252 of the insulation displacement contact 222, the second arm 252 disposed adjacent the first arm 250. The method can further include the step of moving the first arm 250 relative to the second arm 252 such that the carrier aperture 261 causes the electrical cable to move from the retention aperture 225 to the insulation displacement slot 251 of the second arm 252 that is open to the retention aperture 225. Thus, it should be appreciated that at least one, including both, of the first and second arms 250 and 252 can be movable relative to the other of the first and second arms 250 and 252 from the first position to the second position such that the carrier aperture 261 causes the electrical cable to move from the retention aperture 225 to the insulation displacement slot 251 of the second arm 252 that is open to the retention aperture 225. The method can further include the step of, during the moving step, causing at least a portion of the at least one surface 252*a* of the second arm 252 that at least partially defines the insulation displacement slot 251 to pierce the outer electrically insulative layer 239 of the electrical cable 228 and physically and electrically contact the electrical conductor 241 of the electrical cable 228.

The method, and all methods of placing an electrical cable in communication with a complementary electrical component, unless otherwise noted, can include the step of applying electrical current between the electrical cable and the complementary electrical component. Further, the method, and all methods of placing an electrical cable in communication with a complementary electrical component, unless otherwise noted, can include the step of applying a data signal between the electrical cable and the complementary electrical component.

A method can further be provided for selling the insulation displacement contact 222 or the electrical connector assembly 220. The method can include the step of teaching to a third party one or more up to all of the method steps; and selling to the third party the insulation displacement contact 222 or the electrical connector assembly 220.

Figure 4A:
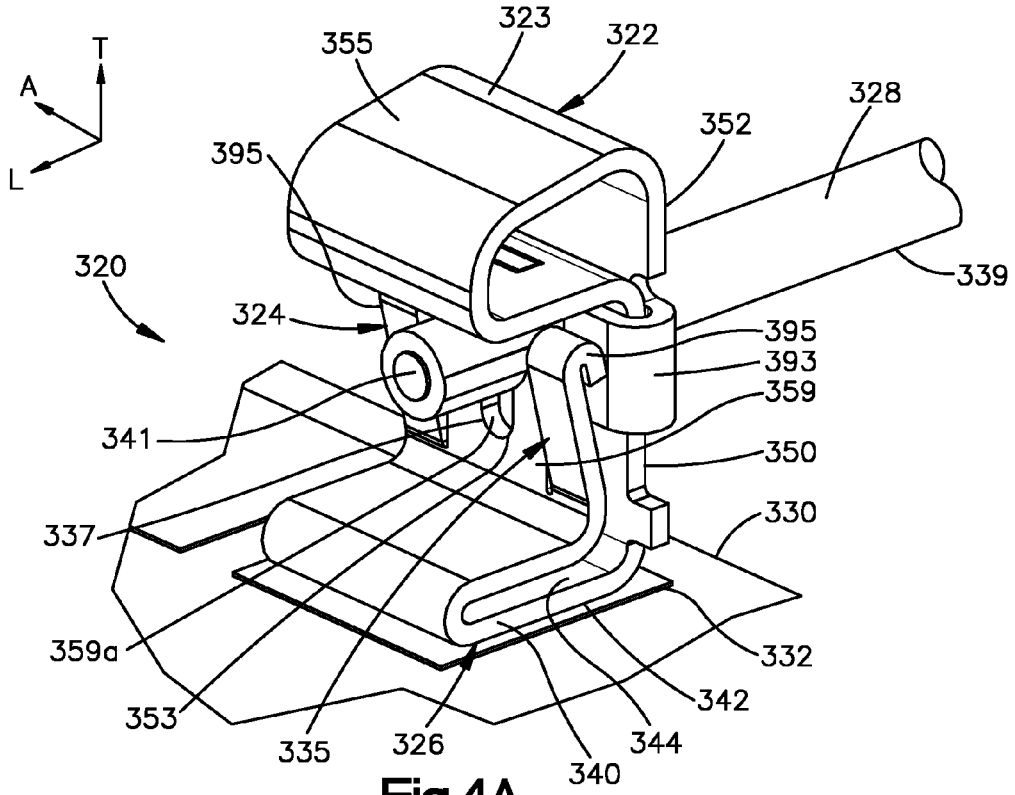
FIG. 4A is a perspective view of an electrical connector assembly constructed in accordance with another embodiment, including a printed circuit board, a plurality of electrical cables, and a plurality of insulation displacement contacts configured to be mounted to the printed circuit board.
Figure 4B:
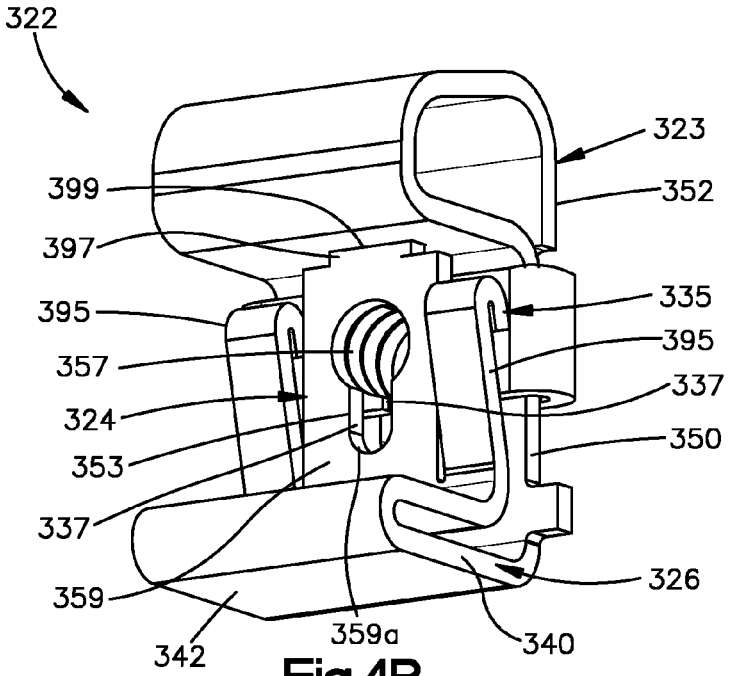
FIG. 4B is a perspective view of the insulation displacement contact illustrated in FIG. 4A.
Figure 4C:
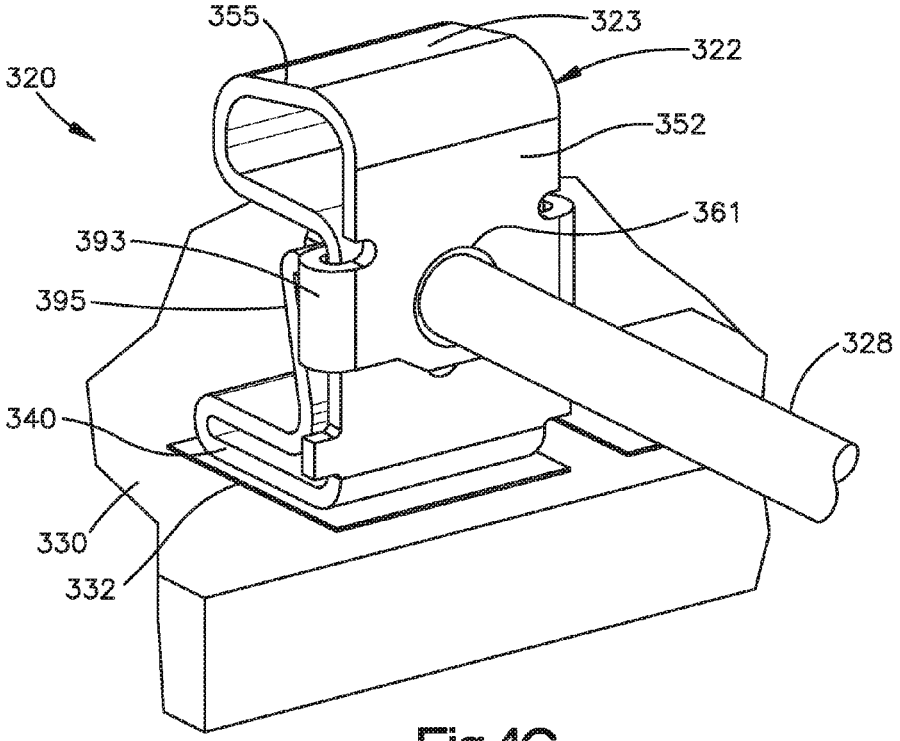
FIG. 4C is a perspective view of the insulation displacement contact illustrated in FIG. 4B, shown having received an electrical cable in an unactuated configuration.
Figure 4D:
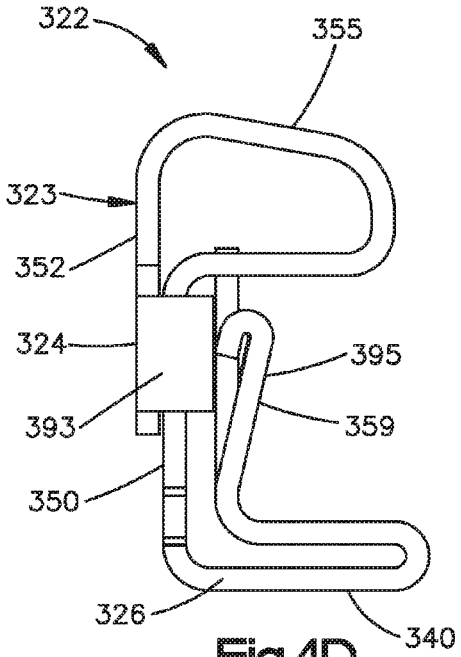
FIG. 4D is a side elevation view of the insulation displacement contact illustrated in FIG. 4C.
Figure 4E:
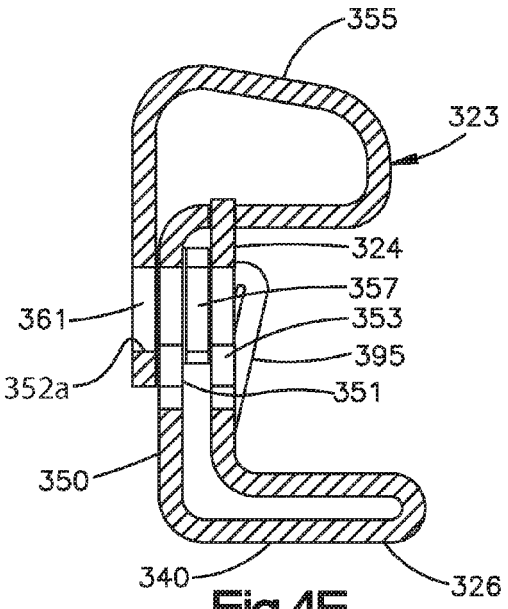
FIG. 4E is a sectional side elevation view of the insulation displacement contact illustrated in FIG. 4C.
Figure 4G:
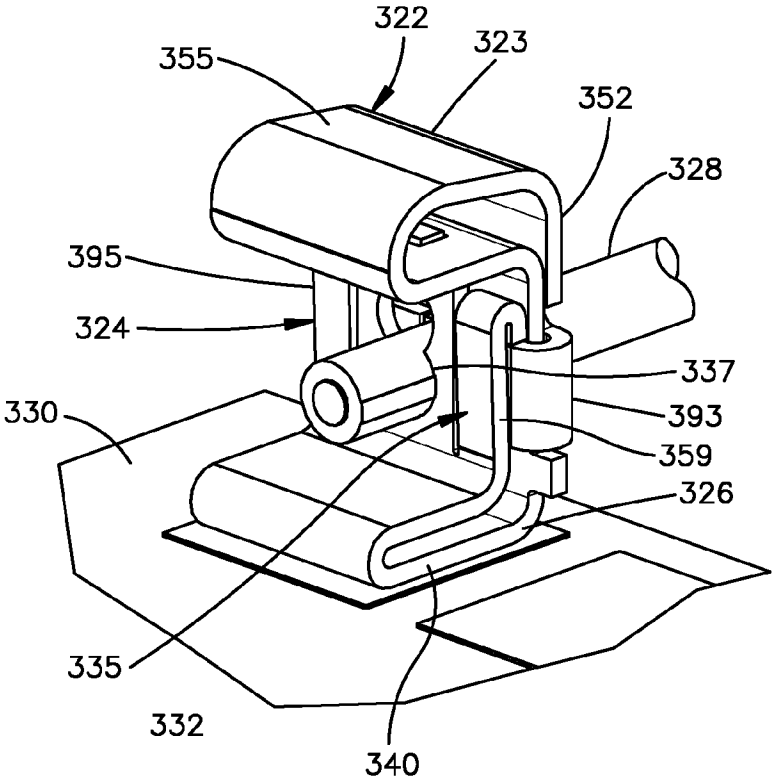
FIG. 4G is another perspective view of the insulation displacement contact illustrated in FIG. 4F.
Figure 4F:
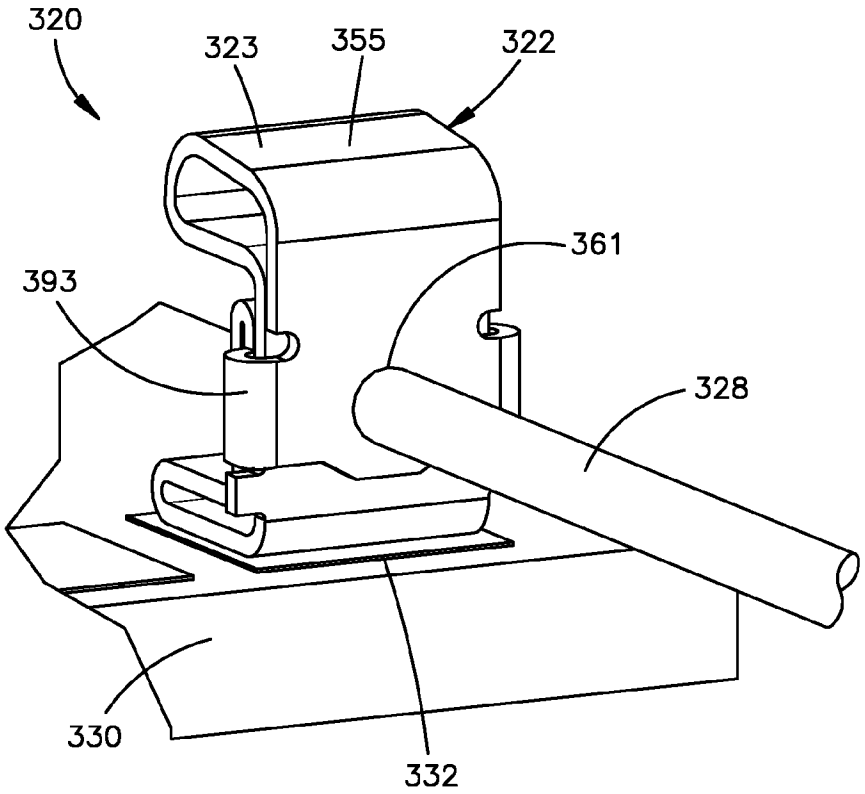
FIG. 4F is a perspective view of the insulation displacement contact illustrated in FIG. 4C, shown in an actuated configuration and mated to the electrical cable.
Figure 4I:
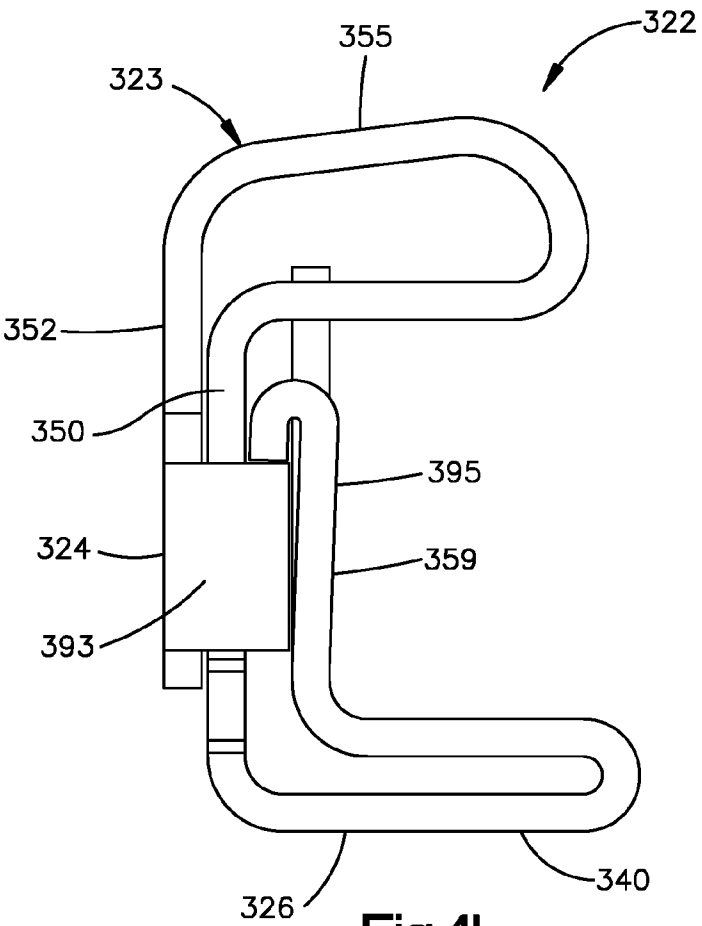
FIG. 4I is a side elevation view of the insulation displacement contact illustrated in FIG. 4F.
Figure 4H:
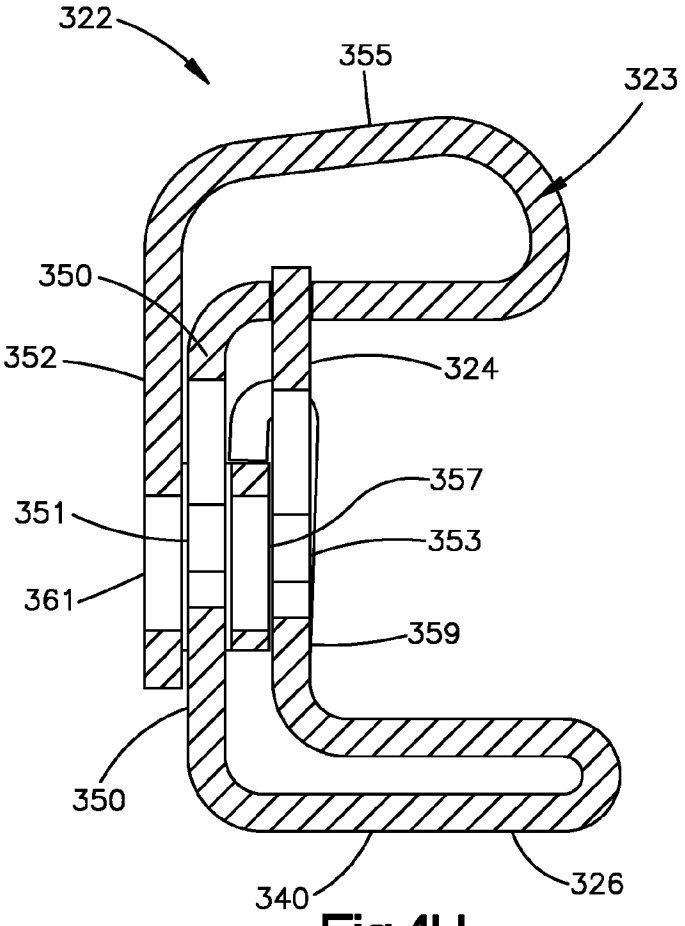
FIG. 4H is a sectional side elevation view of the insulation displacement contact illustrated in FIG. 4F.
Figure 4K:
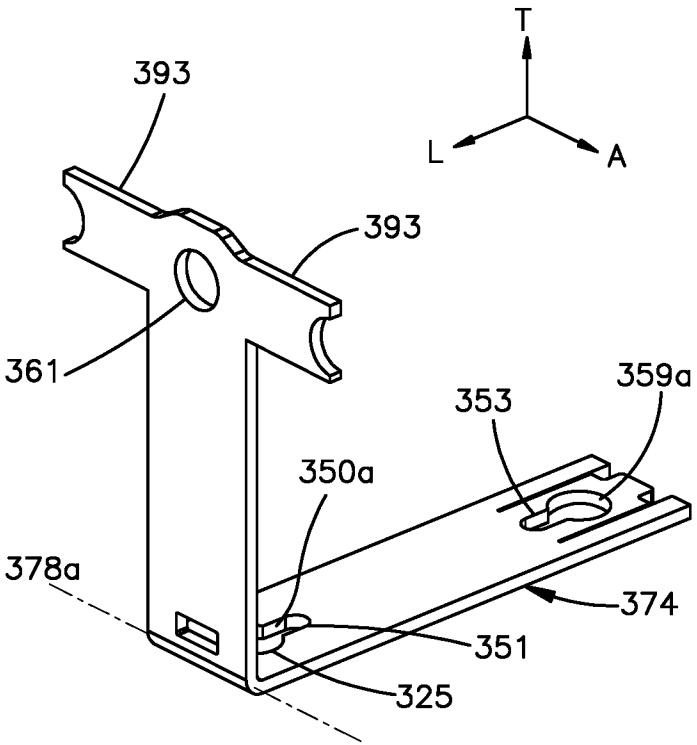
FIG. 4K is a perspective view of the sheet metal illustrated in FIG. 4J, bent to show a first stage in forming of the insulation displacement contact illustrated in FIGS. 4B-4D.
Figure 4J:
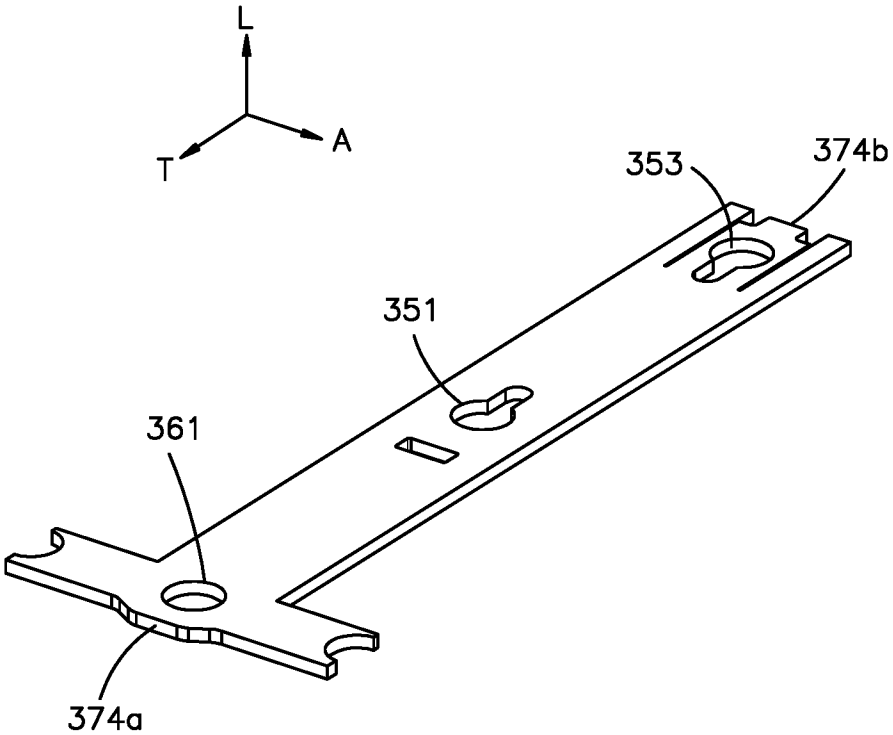
FIG. 4J is a perspective view of a blank of sheet metal that is configured to be bent to construct the insulation displacement contact illustrated in FIGS. 4B-4D.
Figures 4L, 4M:
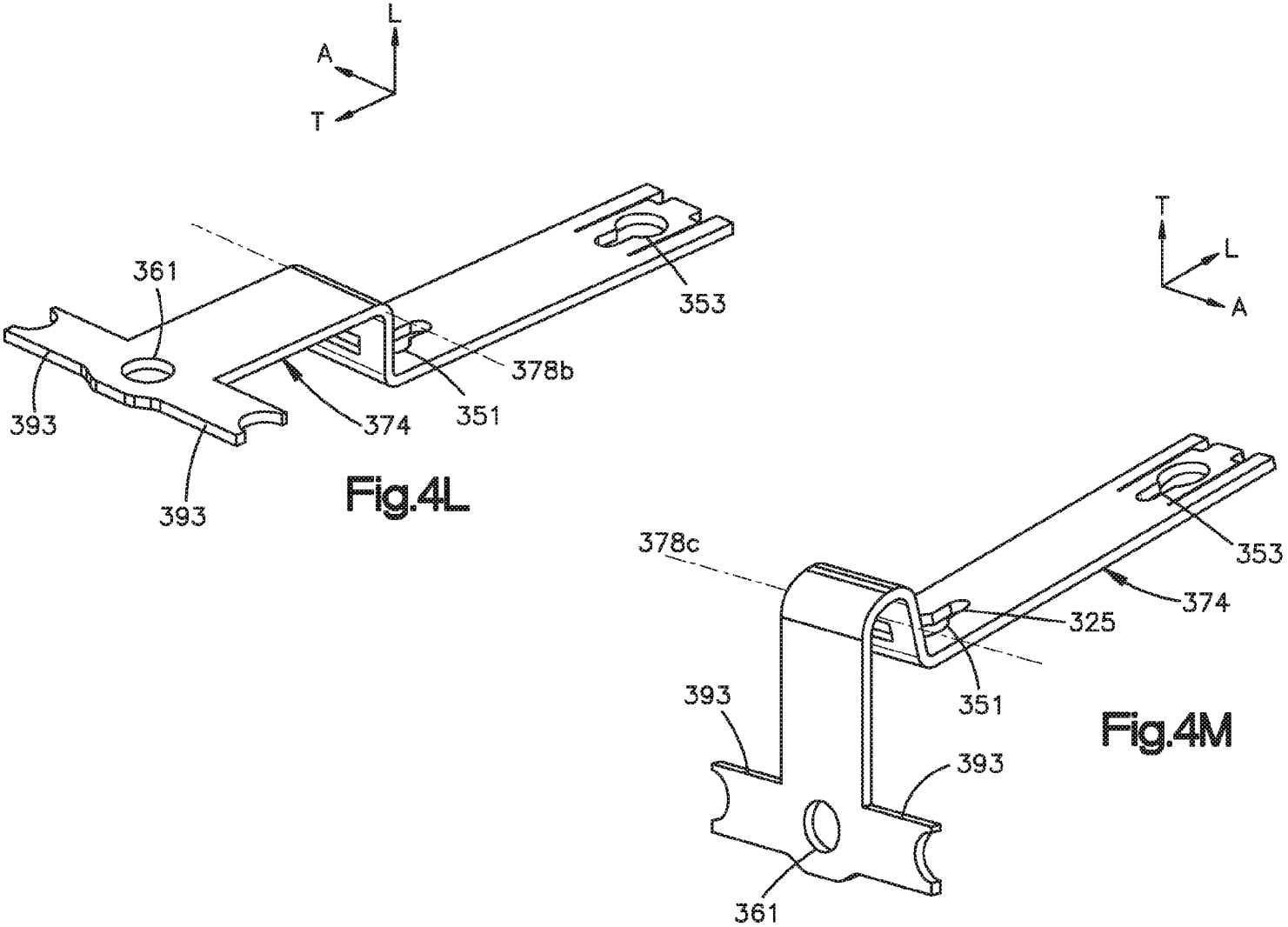
FIG. 4L is a perspective view of the sheet metal illustrated in FIG. 4K, but further bent to show another stage in forming of the insulation displacement contact illustrated in FIGS. 4B-4D.
FIG. 4M is a perspective view of the sheet metal illustrated in FIG. 4L, but further bent to show another stage in forming of the insulation displacement contact illustrated in FIGS. 4B-4D.
Figure 4P:
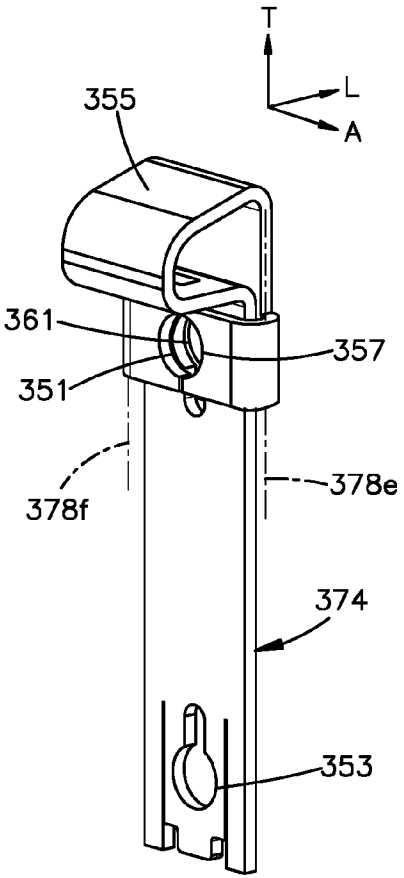
FIG. 4P is a perspective view of the sheet metal illustrated in FIG. 4O, but further bent to show another stage in forming of the insulation displacement contact illustrated in FIGS. 4B-4D.
Figure 4O:
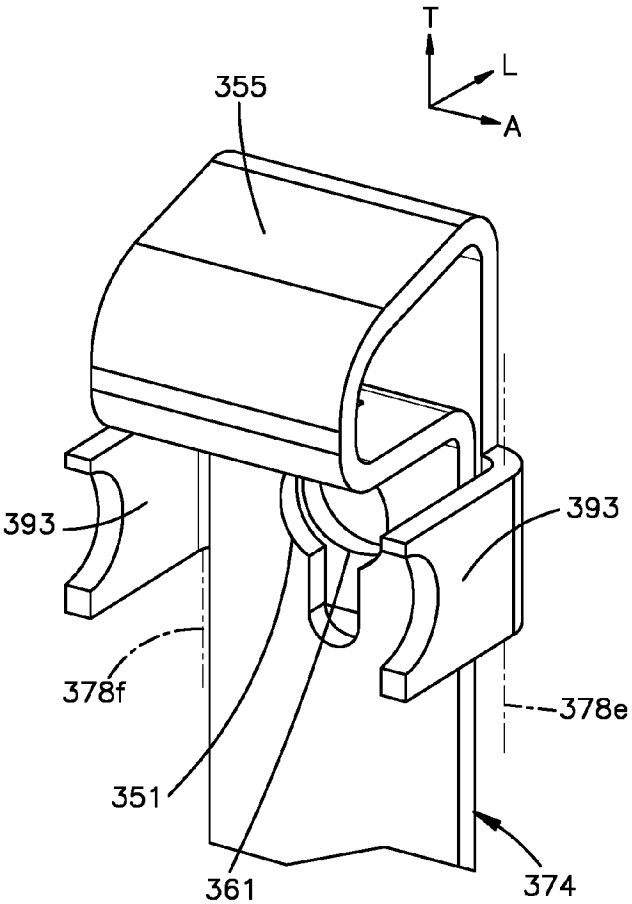
FIG. 4O is a perspective view of the sheet metal illustrated in FIG. 4N, but further bent to show another stage in forming of the insulation displacement contact illustrated in FIGS. 4B-4D.
Figure 4N:
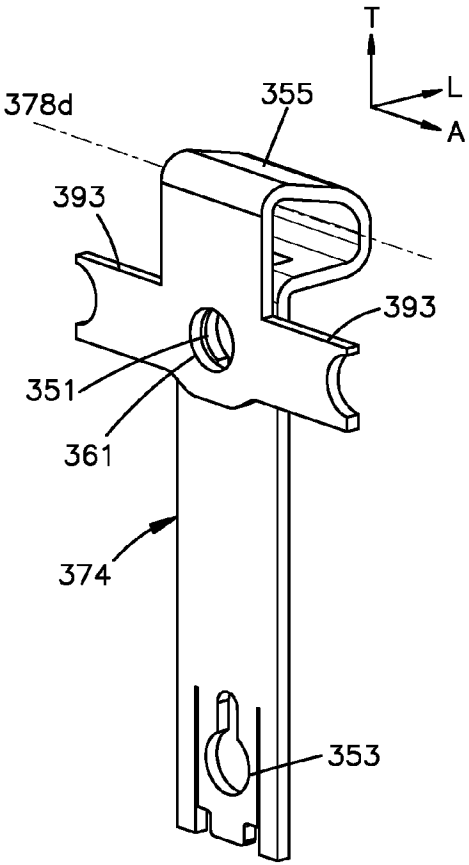
FIG. 4N is a perspective view of the sheet metal illustrated in FIG. 4M, but further bent to show another stage in forming of the insulation displacement contact illustrated in FIGS. 4B-4D.
Figure 4S:
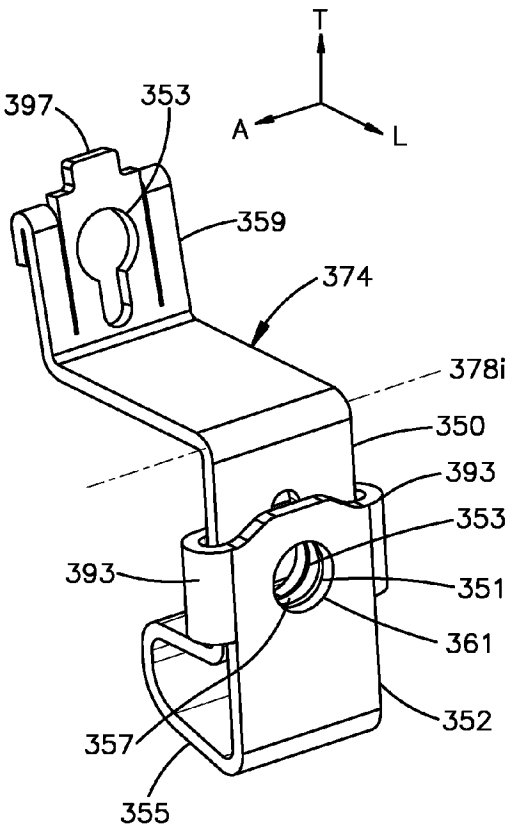
FIG. 4S is a perspective view of the sheet metal illustrated in FIG. 4R, but further bent to show another stage in forming of the insulation displacement contact illustrated in FIGS. 4B-4D.
Figure 4R:
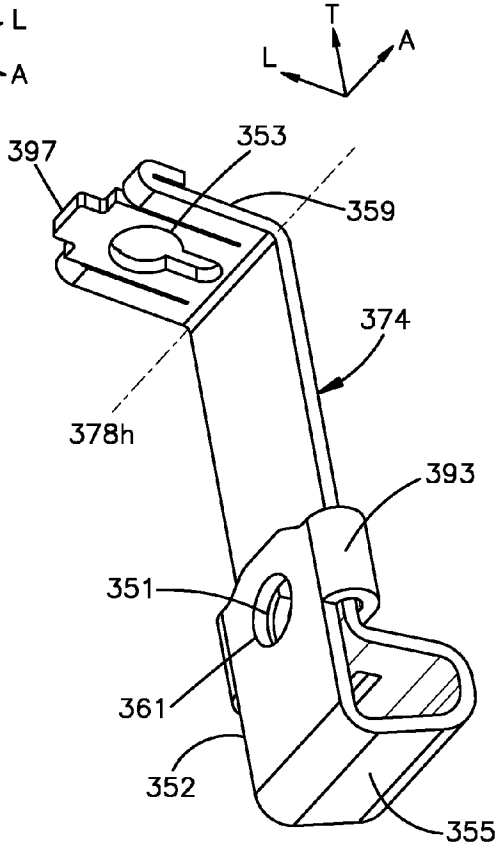
FIG. 4R is a perspective view of the sheet metal illustrated in FIG. 4Q, but further bent to show another stage in forming of the insulation displacement contact illustrated in FIGS. 4B-4D.
Figure 4Q:
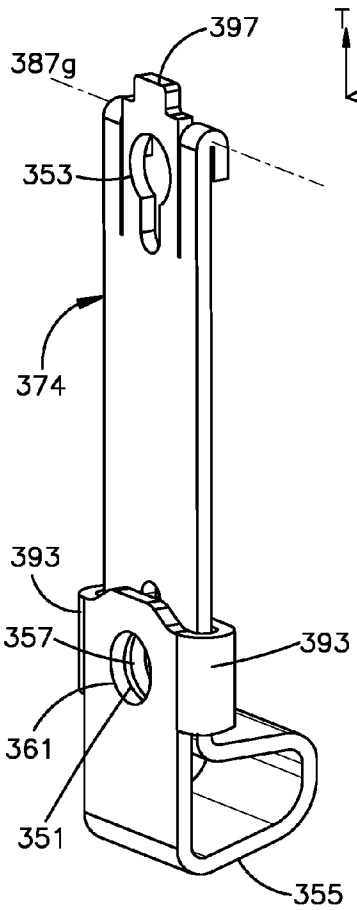
FIG. 4Q is a perspective view of the sheet metal illustrated in FIG. 4P, but further bent to show another stage in forming of the insulation displacement contact illustrated in FIGS. 4B-4D.
Figure 4T:
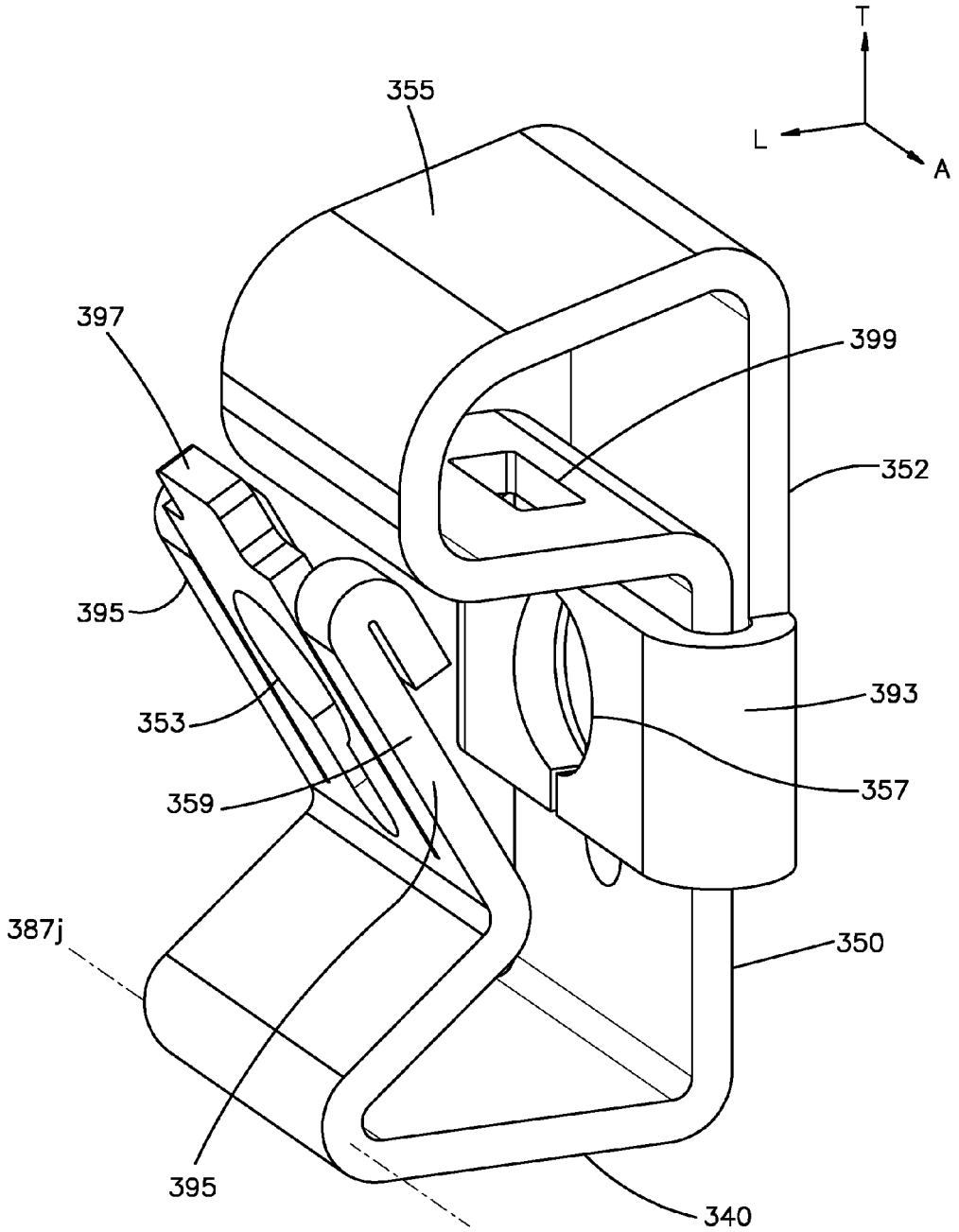
FIG. 4T is a perspective view of the sheet metal illustrated in FIG. 4S, but further bent to show another stage in forming of the insulation displacement contact illustrated in FIGS. 4B-4D.

Referring now to FIGS. 4A-4T, an electrical connector assembly 320 can include at least one insulation displacement contact 322 such as a plurality of insulation displacement contacts 322 that define a mating portion 324 and a mounting portion 326. The electrical connector assembly 320 can further include at least one electrical cable 328 such as a plurality of electrical cables 328 that are configured to mate with a respective one of the insulation displacement contacts 322 at the mating portion 324, and a complementary electrical component 330 such as a substrate, for instance a printed circuit board. The insulation displacement contacts 322, and in particular the respective mounting portions 326, are configured to be mounted to a respective electrical terminal 332 of the complementary electrical component 330, which for instance can be configured as a mounting pad. Thus, the mounting portions 326 are each configured to be surface mounted, for instance soldered, welded, or the like, onto the complementary electrical component 330, for instance to the electrical terminal 332. Alternatively or additionally, the mounting portion 326 can include a projection that is configured to be inserted into an aperture of the complementary electrical component 330. The projection can be press-fit into the aperture of the complementary electrical component 330, which can be an electrically conductive plated via. When the insulation displacement contact 322 is mounted to the complementary electrical component 330 and mated with the respective electrical cable 328, the electrical cable 328 is placed in electrical communication with the complementary electrical component 330. It should be appreciated that the complementary electrical component 330, and all complementary electrical components described herein, can be a printed circuit board or any suitable constructed alternative electrical component 330 as desired.

The insulation displacement contacts 322, and all insulation displacement contacts described herein, can be made from any suitable electrically conductive material, such as a metal. Each insulation displacement contact 322 can include an electrically conductive contact body 323 that defines both the mating portion 324 and the mounting portion 326, which can be monolithic with the mating portion 324. The mating portion 324 can include at least one slot that extends into the contact body 323, and at least one piercing member 337 that at least partially defines the slot such that, when the slot receives the electrical cable 328, the piercing member 337 pierces an outer electrically insulative layer 339 of the electrical cable 328 and contacts an electrical conductor 341 of the electrical cable 328 that is disposed inside the outer electrically insulative layer 339. The outer electrically insulative layer 339, and all outer electrically insulative layers as described herein, can be made of any suitable electrically insulative material as desired. The electrical conductor 341, and all electrical conductors as described herein, can be made from any suitable electrically conductive material as desired.

The electrically conductive contact body 323 can include a base 340 that defines an outer surface and an inner surface 344 that faces opposite the outer surface along the transverse direction T. The outer surface is configured to face the electrical terminal, and can be configured as an outer contact surface 342 that is configured to contact the electrical terminal 332. For instance, the outer contact surface 342 can be surface mounted, such as soldered or welded, to the electrical terminal 332. Alternatively, the base 340 can include mounting tails that extend from the outer surface and are configured to be inserted, for instance press-fit, into vias of the complementary electrical component 330. Thus, the mounting portion 326 can be defined by the base 340, and in particular the outer contact surface 342. When the outer contact surface 342 is in contact with the electrical terminal 332, either directly or indirectly, the electrical terminal 332 in placed in electrical communication with the mounting portion 326, and thus the mating portion 324. The outer contact surface 342 and the inner surface 344 can be spaced from each other along a transverse direction T. In particular, the inner surface 344 is spaced above, or up from, the outer contact surface 342 along the transverse direction T, and the outer contact surface 342 is spaced below, or down from, the inner surface 344 along the transverse direction T.

The mating portion 324 can include a first arm 350 that extends from the mounting portion 326. The first arm 350 includes at least one surface 350*a* that defines a first insulation displacement slot 351 extending through the first arm 350, for instance along the longitudinal direction L. The at least one surface 350*a* can further define a piercing member 337 that pierces the outer electrically insulative layer 339 of the electrical cable 328 and contacts the electrical conductor 341 when the electrical cable 328 is disposed in the first insulation displacement slot 351. The mating portion 324 can further include a second arm 352 that includes at least one surface 352*a* that defines a first carrier aperture 361 extending through the second arm 352, for instance along the longitudinal direction L. The second arm 352 is movable with respect to the first arm 350 from a first position, whereby the carrier aperture 361 is out of alignment with the insulation displacement slot, for instance with respect to the longitudinal direction L, to a second position whereby the carrier aperture 361 is aligned with the insulation displacement slot 351, for instance with respect to the longitudinal direction L.

The first arm 350 can away from the base 340, for instance substantially along the transverse direction T. The insulation displacement contact 322 can further include a hinge 355 that extends from the first arm 350, for instance the upper end of the first arm 350. The second arm 352 can extend down from the hinge 355, for instance substantially along the transverse direction T, so that the second arm 352 is positioned adjacent the first arm 350 along the longitudinal direction L. The hinge 355 is flexible, and is configured to flex as the second arm 352 moves along the downward direction toward the base 340 along the transverse direction T. It should be appreciated throughout this disclosure that reference to the base can apply equally, unless otherwise indicated, to the complementary electrical component when the insulation displacement contact is mounted to the complementary electrical component. Thus, movement toward the base and away from the base can be equivalent to movement toward the complementary component and away from the complementary electrical component when the insulation displacement contact is mounted to the complementary electrical component. Similarly, a distance from the base can apply to a distance from the complementary component when the insulation displacement contact is mounted to the complementary electrical component.

The at least one surface 350*a* of the first arm 350 further defines a retention aperture 325 that extends through the first arm 350 along the longitudinal direction L and is open to the insulation displacement slot 351. The insulation displacement slot 351 defines a first cross-sectional dimension along a lateral direction A, and the retention aperture 325 defines a second cross-sectional dimension along the lateral direction A that is greater than the first cross-sectional dimension. Thus, it can be said that the insulation displacement slot 351 and the retention aperture 325 extend through the first arm 350 along a second direction that is angularly offset with respect to the transverse direction T, and the first and second cross-sectional dimensions are in a third direction that is angularly offset with respect to each of the transverse direction T and the second direction. The second direction can be the longitudinal direction L, and the third direction can be the lateral direction A. The retention aperture 325 can be sized to receive the electrical cable 328 such that the at least one surface 350*a* retains the electrical cable 328 therein. Thus, the electrical cable 328 is movable from the retention aperture 325 into the insulation displacement slot 351 as the second arm 352 moves from the first position to the second position. In this regard, it should be appreciated that the carrier aperture 361 and the retention aperture 325 are aligned with each other along the longitudinal direction L when the first arm 350 is in the first position, and the carrier aperture 361 is aligned with the insulation displacement slot 351 when the first arm 350 is in the second position.

In accordance with one embodiment, the retention aperture 325 is spaced from the base 340 a first distance along the transverse direction T, and the insulation displacement slot 351 is spaced from the base 340 a second distance along the transverse direction T that is less than the first distance. The at least one surface 350*a* that defines the retention aperture 325 can define a constant curvature at the retention aperture 325. For instance, the retention aperture 325 can be shaped substantially arcuate or circular to correspond to the outer diameter of the outer electrically insulative layer 339, and can be sized substantially equal to (e.g., slightly greater than) the outer electrically insulative layer 339. The at least one surface 352*a* that defines the insulation displacement slot 351 is elongate, for instance in the transverse direction T toward the base 340 from the retention aperture 325, at the insulation displacement slot 351. The insulation displacement slot 351 can be elongate along the transverse direction T. Thus, the retention aperture 325 and the insulation displacement slot 351 can combine to define a keyhole shape, or the retention aperture 325 can be otherwise shaped or open. The lateral direction A can be substantially perpendicular with respect to each of the longitudinal direction L and the transverse direction T. When the second arm 352 is in the first position, the carrier aperture 361 can be aligned with the retention aperture 325, for instance in the longitudinal direction L. Thus, the electrical cable 328 can be inserted through the carrier aperture 361 and the retention aperture 325. When the second arm 352 moves to the second position, the first arm 350 prevents the electrical cable 328 from moving with the second arm, thereby causing the electrical cable 328 to move from the retention aperture 325 into the insulation displacement slot 351.

The insulation displacement contact 322, and in particular the mating portion 324, can include at least one finger 393 that extends from the second arm 352. For instance, the insulation displacement contact 322, and in particular the mating portion 324, can include first and second fingers 393 that extend out from opposed sides of the second arm 352 that are spaced from each other along the lateral direction A. Each of the first and second fingers 393 extends from the second arm 352 around opposed sides of the first arm 350, and extend laterally inward toward each other so as to define a second carrier aperture 357. For instance, each of the first and second fingers 393 can define a surface, such as an end surface that faces the end surface of the other of the first and second fingers 393 so as to define the second carrier aperture 357, which can be sized and shaped as described herein with respect to the carrier aperture 361. While the fingers 393 cooperate to define the second carrier aperture 357, it should be appreciated that one of the fingers 393 can define the carrier aperture 357. Thus, it can be said that at least one finger defines the second carrier aperture 357. The second carrier aperture 357 can be aligned with the first carrier aperture 361. The first arm 350 is disposed between the carrier aperture 361 of the second arm 352 and the second carrier aperture 357.

Because the fingers 393 extend from the second arm 352, the fingers 393 move along with the second arm 352 as the second arm 352 moves from the first position to the second position. The second carrier aperture 357 is inline with the carrier aperture 361 of the second arm 352 both when the second arm 352 is in the first position and when the second arm 352 is in the second position. It should thus be further appreciated that the second carrier aperture 357 is aligned with the retention aperture 325 when the second arm 352 in the first position, and the carrier aperture 357 of the second arm 352 is aligned with the insulation displacement slot 351 when the second arm 352 is in the second position. Accordingly, during operation, when the second arm 352 is in the first position, the electrical cable 328 is inserted through the carrier aperture 361, which can be referred to as a first carrier aperture, through the retention aperture 325 of the first arm 350, and through the second carrier aperture 357 of the at least one finger 393. The second arm 352 can then be moved from the first position to the second position, which causes the surfaces of the second arm 352 and the at least one finger 393 that defines the respective first and second carrier apertures 361 and 357, respectively, to bias the electrical cable 328 to move, in this example downward, from the retention aperture 325 into the insulation displacement slot 351. It should be appreciated that while the insulation displacement contact 322 can define first and second carrier apertures as described herein, the at least one finger 393 can define an engagement member of a lock mechanism 335, as will now be described, without defining a carrier aperture.

With continuing reference to FIGS. 4A-4T, the insulation displacement contact 322 can include a lock mechanism 335 that is movable between an engaged configuration and a disengaged configuration. When the lock mechanism 335 is in the engaged configuration, the lock mechanism 335 prevents movement of the second arm 352 from the second position toward the first position. When the lock mechanism 335 is in the disengaged configuration, the lock mechanism 335 does not prevent movement of the second arm 352 from the second position toward the first position. For instance, the lock mechanism 335 can include complementary engagement members that are configured to engage when the lock mechanism 335 is in the engaged configuration, so as to interfere with each other and prevent movement of the second arm 352 from the second position toward the first position. The complementary engagement members are configured, in response to a removal force, to disengage so as to remove the interference.

For instance, in accordance with one embodiment, the lock mechanism 335 can include at least one engagement member of the second arm 352 that can be configured as an engagement surface of the at least one finger 393, including an engagement surface of each of the fingers 393. The lock mechanism 335, and thus the insulation displacement contact 322, can include a third arm 359 that extends out from the base 340, such that the second arm 352 is movable with respect to the first arm 350 and the third arm 359 from the first position to the second position. The third arm 359 can be positioned such that the fingers 393 are disposed between the first arm 350 and the third arm 359 along the longitudinal direction L. The third arm 359 can define at least one engagement member configured as a flexible locking tab 395, for instance first and second locking tabs 395, that are configured to ride along the fingers 393 as the second arm moves from the first position to the second position. Each of the locking tabs defines an engagement surface that is configured to abut and interfere with the engagement surface of the fingers 393 when the second arm 352 is in the second position, thereby preventing movement of the second arm 352 from the second position toward the first position. The locking tabs can flex away from the fingers in response to a removal force that removes the interference such that the second arm 352 can move from the second position to the first position.

The third arm 359 can further include at least one surface **359*a* that defines a second insulation displacement slot 353 that is aligned with the insulation displacement slot 351 of the first arm 350. For instance, the third arm 359 can be split so as to define opposed surfaces along the lateral direction A that define the second insulation displacement slot 353. Thus, one of the opposed surfaces can define a respective piercing member 337 that pierces the outer electrically insulative layer 339 of the electrical cable 328 and contacts the electrical conductor 341 when the electrical cable 328 is disposed in the second insulation displacement slot 353. It should be appreciated that while the insulation displacement contact 322 can include the first and second insulation displacement slots 351 and 353, the insulation displacement connector can alternatively include only one of the insulation displacement slots 351 and 353 as desired. In accordance with one embodiment, the at least one surface 352*a* of the first arm 350 can define a strain relief aperture that is configured to at least compress against, for instance cut into, the outer electrically insulative layer 339 without contacting the electrical conductor 341** as described herein.

As illustrated in FIGS. 4J-4T and 4A, the entirety of the insulation displacement contact can be made from a single monolithic blank sheet of stock material 374, such as a metal, by folding the sheet along various fold lines to produce the mating and mounting portions 324 and 326. The sheet of stock material 374, and the stock material that comprises all insulation displacement contacts as described herein, can have any suitable dimension as desired. For instance, the stock material 374 and the stock material that comprises all insulation displacement contacts as described herein can have a thickness between 0.1 mm and 2 mm. For instance, the thickness can be approximately 0.3 mm. As will be described in more detail below, the sheet of stock material 374, and the stock material that comprises all insulation displacement contacts as described herein, can be bent along respective bend lines that are perpendicular to the thickness of the stock material so as to form the respective insulation displacement contact. As illustrated in FIG. 4J, the stock material 374 can define a first upper end 374*a* and an opposed second lower end 374*b*. The second lower end 374*b* is spaced down from the first upper end 374*a*. Likewise, the first upper end 374*a* is spaced up from the second lower end 374*b*. The first carrier aperture 361 can be said to be disposed at the first upper end 374*a*. The second insulation displacement slot 353 can be said to be disposed at the second lower end 374*b*. The first insulation displacement slot 351 is disposed between the first carrier aperture 361 and the second insulation displacement slot 353. It will be appreciated that the following bending steps can be performed in any order as desired.

Referring to FIG. 4K, the stock material 374 can be bent in a first bend direction along a first bend line 378*a* that is oriented in the longitudinal direction L at a location between the first carrier aperture 361 and the second insulation displacement slot 353. For instance, the first bend line 378*a* can be between the first carrier aperture 361 and the first insulation displacement slot 351. Referring to FIG. 4L, the stock material 374 can be bent in a second bend direction opposite the first direction along a second bend line 378*b* that is disposed between the first carrier aperture 361 and the first bend line 378*a*. Thus, the first bend line 378*a* is disposed between the second bend line 378*b* and the first insulation displacement slot 351. As illustrated in FIG. 4M, the stock material 374 can be bent in the second bend direction along a third bend line 378*c* that is disposed between the second bend line 378*b* and the first carrier aperture 361. Thus, the second bend line 378*b* is disposed between the first bend line 378*a* and the third bend line 378*c*. As illustrated in FIG. 4N, the stock material 374 can be bent in the second bend direction along a fourth bend line 378*d* that is disposed between the first carrier aperture 361 and the third bend line 378*c*. Thus, the third bend line 378*c* is disposed between the fourth bend line 378*d* and the second bend line 378*b*. Bending the stock material 374 along the fourth bend line 378*d* defines the hinge 355, and further causes the first insulation displacement slot to be in alignment with the first carrier aperture 361 along the longitudinal direction L, as described above. Next, as illustrated in FIGS. 4O-4P, the first and second arms 393 can be bent along respective fifth and sixth bend lines 378*e* and 378*f*, respectively, so as to define the second carrier aperture 357 that is aligned with the first carrier aperture 361 and the first insulation displacement slot 351 as described above. For instance, the first insulation displacement slot 351 is disposed between the first carrier aperture 351 and the second carrier aperture 357, as described above.

Referring now to FIG. 4Q, first and second tabs disposed laterally outward of the second insulation displacement slot 353 can be bent in the second bend direction along a seventh bend line 378*g*, so as to expose a tab 397 that is configured to be inserted into a slot 399 that extends through the hinge 355. Referring to FIG. 4R, the stock material 374 is bent in the first bend direction along an eighth bend line 378*h* so as to define the third arm 359. Thus, the eighth bend line is disposed between the second insulation displacement slot 353 and the first insulation displacement slot 351. Referring to FIG. 4S, the stock material 374 is bent in the second bend direction along a ninth bend line 378*i* so as to define the first arm 350. The ninth bend line 378*i* is thus disposed between the eighth bend line 378*h* and the first insulation displacement slot 351. Referring to FIG. 4T, the stock material is bent in the second bend direction along a tenth bend line 378*j* so as to define the base 340, such that the third arm 359 extends out with respect to the base 340 in the manner described above. Thus, the tenth bend line 378*j* is disposed between the ninth bend line 378*i* and the third arm 359. Finally, the tab 397 is inserted in the slot 399 so as to align the second insulation displacement slot 353 with the first carrier aperture 361, the second carrier aperture 357, and the first insulation displacement slot 351 along the longitudinal direction, as described above.

Referring to FIGS. 4A-4T in general, the electrical connector assembly 320 can include at least one of the insulation displacement contacts 322, the electrical cable 328 that extends through the carrier aperture 361 of the second arm and the insulation displacement slot 351, such that at least a portion of the surface 350*a* extends through the insulative layer of the electrical cable 328 and contacts an electrical conductor of the electrical cable 328. The electrical connector assembly 320 can further include the complementary electrical component 330.

Figure 4U:
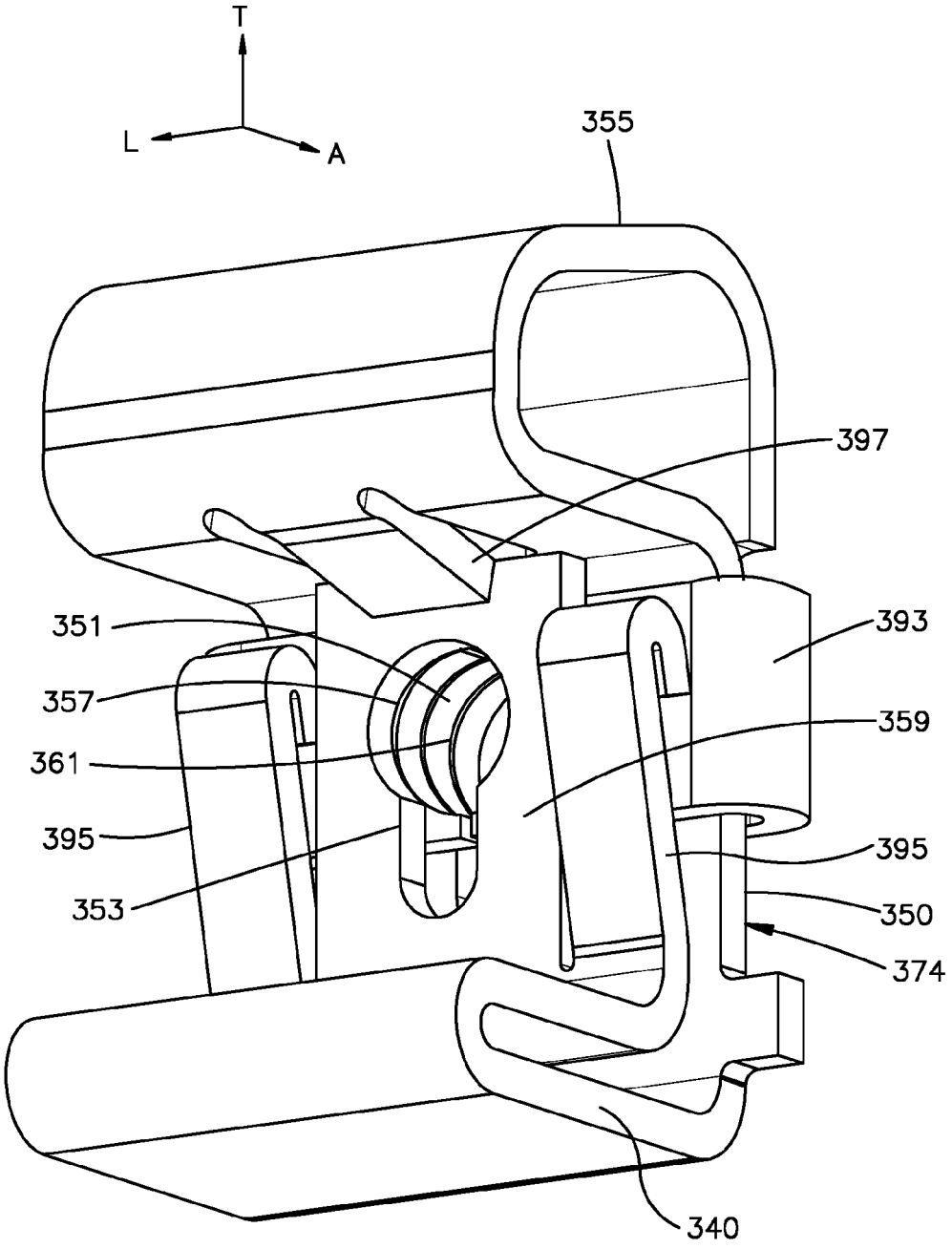
FIG. 4U is a perspective view of the insulation displacement contact as illustrated in FIG. 4B, but constructed in accordance with an alternative embodiment.

Referring now to FIG. 4U, it is appreciated that the third arm 359 can be secured relative to the hinge 355 in accordance with any suitable embodiment. For instance, the hinge 355 can include a tab 397, such that the third arm 359 is captured between the tab 397 and the fingers 393.

A method can be provided for placing the electrical cable 328 in electrical communication with the complementary electrical component 330. The method can include the steps of placing the mounting portion 326 of the insulation displacement contact 322 in electrical communication with the complementary electrical component 330, and inserting the electrical cable 328 through the carrier aperture 361 of the second arm 352 and the retention aperture 325 of the first arm 350. The method further includes the step of moving the second arm 352 relative to the first arm 350 so as to cause the carrier aperture 361 to move the electrical cable 328 from the retention aperture 325 to an insulation displacement slot 351 of the first arm 350 that is open to the retention aperture 325. The method further includes, during the moving step, the step of causing at least a portion of the surface 350*a* of the first arm 350 that at least partially defines the insulation displacement slot 351 to pierce the outer electrically insulative layer of the electrical cable 328 and physically and electrically contact an electrical conductor of the electrical cable 328.

The method can include the step of applying electrical current between the electrical cable 328 and the complementary electrical component 330. The method can include the step of applying a data signal between the electrical cable 328 and the complementary electrical component 330. A method can further be provided for selling the insulative displacement contact 322 or the electrical connector assembly 320. The method can include the steps of teaching to a third party one or more up to all of the method steps described herein, and selling to the third party the insulative displacement contact 322 or the electrical connector assembly 320.

Referring now to FIGS. 5A-5F, an electrical connector assembly 420 can include at least one insulation displacement contact 422 such as a plurality of insulation displacement contacts 422 that define a mating portion 424 and a mounting portion 426. The electrical connector assembly 420 can further include at least one electrical cable 428 such as a plurality of electrical cables 428 that are configured to mate with a respective one of the insulation displacement contacts 422 at the mating portion 424, and a complementary electrical component 430 such as a substrate, for instance a printed circuit board. The insulation displacement contacts 422, and in particular the respective mounting portions 426, are configured to be mounted to a respective electrical terminal 432 of the complementary electrical component 430, which for instance can be configured as a mounting pad. Thus, the mounting portions 426 are each configured to be surface mounted, for instance soldered, welded, or the like, onto the complementary electrical component 430, for instance to the electrical terminal 432. Alternatively or additionally, the mounting portion 426 can include a projection that is configured to be inserted into an aperture of the complementary electrical component 430. The projection can be press-fit into the aperture of the complementary electrical component 430, which can be an electrically conductive plated via. When the insulation displacement contact 422 is mounted to the complementary electrical component 430 and mated with the respective electrical cable 428, the electrical cable 428 is placed in electrical communication with the complementary electrical component 430. It should be appreciated that the complementary electrical component 430, and all complementary electrical components described herein, can be a printed circuit board or any suitable constructed alternative electrical component 430 as desired.

The insulation displacement contacts 422, and all insulation displacement contacts described herein, can be made from any suitable electrically conductive material, such as a metal. Each insulation displacement contact 422 can include an electrically conductive contact body 423 that defines both the mating portion 424 and the mounting portion 426, which can be monolithic with the mating portion 424. The mating portion 424 can include at least one slot that extends into the contact body 423, and at least one piercing member 437 that at least partially defines the slot such that, when the slot receives the electrical cable 428, the piercing member 437 pierces an outer electrically insulative layer 439 of the electrical cable 428 and contacts an electrical conductor 441 of the electrical cable 428 that is disposed inside the outer electrically insulative layer 439. The outer electrically insulative layer 439, and all outer electrically insulative layers as described herein, can be made of any suitable electrically insulative material as desired. The electrical conductor 441, and all electrical conductors as described herein, can be made from any suitable electrically conductive material as desired.

The electrically conductive contact body 423 can include a base 440 that defines an outer surface and an inner surface 444 that faces opposite the outer surface along the transverse direction T. The outer surface is configured to face the electrical terminal, and can be configured as an outer contact surface 442 that is configured to contact the electrical terminal 432. For instance, the outer contact surface 442 can be surface mounted, such as soldered or welded, to the electrical terminal 432. Alternatively, the base 440 can include mounting tails that extend from the outer surface and are configured to be inserted, for instance press-fit, into vias of the complementary electrical component 430. Thus, the mounting portion 426 can be defined by the base 440, and in particular the outer contact surface 442. When the outer contact surface 442 is in contact with the electrical terminal 432, either directly or indirectly, the electrical terminal 432 in placed in electrical communication with the mounting portion 426, and thus the mating portion 424. The outer contact surface 442 and the inner surface 444 can be spaced from each other along a transverse direction T. In particular, the inner surface 444 is spaced above, or up from, the outer contact surface 442 along the transverse direction T, and the outer contact surface 442 is spaced below, or down from, the inner surface 444 along the transverse direction T.

The mating portion 424 can include a first arm 450 that extends from the mounting portion 426, and in particular from the base 440. The first arm 450 includes at least one surface 450*a* that defines an insulation displacement slot 451 extending through the first arm 450, for instance along the longitudinal direction L. The at least one surface 450*a* can further define a piercing member 437 that pierces the outer electrically insulative layer 439 of the electrical cable 428 and contacts the electrical conductor 441 when the electrical cable 428 is disposed in the insulation displacement slot 451. The mating portion 424 can further include a second arm 452 that also extends out with respect to the mounting portion 426, and in particular from the base 440. In accordance with one embodiment, the mating portion 424 extends out from the mounting portion 426 and base 440 indirectly, that is, from the first arm 450 which, in turn, extends out from the base 440. Alternatively, the second arm 452 can extend directly out from the base 440, and thus directly from the mounting portion 426. The first and second arms 450 and 452 are spaced from each other along the longitudinal direction L.

The insulation displacement slot 451 can be referred to as a first insulation displacement slot, and the second arm 452 includes at least one surface 452*a* that defines a second insulation displacement slot 453 extending through the second arm 452, for instance along the longitudinal direction L. Thus, the contact body 423 includes first and second insulation displacement slots 451 and 453 that extend through the mating portion 424. The at least one surface 452*a* can further define a piercing member 437 that pierces the outer electrically insulative layer 439 of the electrical cable 428 and contacts the electrical conductor 441 when the electrical cable 428 is disposed in the second insulation displacement slot 453. The first and second insulation displacement slots 451 and 453 are aligned with each other in the longitudinal direction, such that the electrical cable 428 can be inserted into each of the first and second insulation displacement slots 451 and 453. The insulation displacement slots can define any distance along the lateral direction A as desired. Thus, the opposed surfaces that define the respective insulation displacement slots can be spaced from each other any distance along the lateral direction as desired.

The first arm 450 can define a first or inner region 470*a* and a second or outer region 470*b*. The inner and outer regions 470*a* and 470*b* are located such that the inner region is disposed between the outer region and the second arm 452. In accordance with one embodiment, the outer region 470*b* can extend away from the base 440, and the inner region 470*a* can extend from the outer region 470*b* toward the base 440 at a location spaced from the outer region 470*b* along the longitudinal direction L. Thus, the first arm 450 can define an inverted, or downward facing, concavity that can be configured as a U-shape or any suitable alternative shape as desired. Similarly, the second arm 452 can define a first or inner region 471*a* and a second or outer region 471*b*. The inner and outer regions 471*a* and 471*b* are located such that the inner region 471*a* is disposed between the outer region 471*b* and the first arm 450. In accordance with one embodiment, the outer region 471*b* can extend from the inner region 471*a* toward the base 440 at a location spaced from the inner region 471*a* along the longitudinal direction L. Accordingly, the second arm 452 can define an inverted, or downward facing, concavity that can be configured as a U-shape or any suitable alternative shape as desired.

In accordance with one embodiment, the insulation displacement contact 422, and in particular the mating portion 424, can include a bridge 427 that is connected between the inner region 470*a* of the first arm 450 and the inner region 471*a* of the second arm 452. Thus, the inner region 471*a* can extend from the inner region 470*a* of the first arm 450 along a direction away from the base 440. The bridge can define an upward-facing concavity that can be configured as a U-shape or any suitable alternative shape that is oriented opposite the downward-facing concavities of the first and second arms 450 and 452. The mating portion 424 can define, sequentially along the longitudinal direction L, the outer region 470*b*, the inner region 470*a*, the inner region 471*a*, and the outer region 471*b*. It should be appreciated that the inner region 471*a* can be spaced from the inner region 470*a*, and the outer region 471*b* can extend out from the base 440.

The insulation displacement contact 422 can further include at least one strain relief aperture, such as a first strain relief aperture 471, that extends through the mating portion 424, and in particular through at least one of the first and second arms 450 and 452. In accordance with one embodiment, the first strain relief aperture 471 can extend through the first arm 450, and in particular through the outer region 470*b* of the first arm 450. The first strain relief aperture 471 can be aligned with the first and second insulation displacement slots 451 and 453 along the longitudinal direction L. Thus, the first strain relief aperture 471 is positioned such that one of the first and second insulation displacement slots 451 and 453 is positioned between the other of the insulation displacement slots 451 and 453 and the strain relief aperture. In particular, the first insulation displacement slot 451 is positioned between the second insulation displacement slot 453 and the first strain relief aperture 471. Opposed surface portions that define the strain relief aperture are configured to grip the outer electrically insulative layer without extending through the outer electrically insulative layer to the electrical conductor when the electrical cable 428 extends through the both insulation displacement slots 451 and 453 and the strain relief aperture 471. The surface portions of the at least one strain relief aperture can be defined by different opposed surfaces, or by the same surface.

The insulation displacement contact 422 can further include a second strain relief aperture 473 that extends through the mating portion 424. In accordance with one embodiment, the second strain relief aperture 473 can extend through the second arm 452, and in particular through the outer region 471*b* of the second arm 452. The second strain relief aperture 473 can be aligned with the first and second insulation displacement slots 451 and 453 along the longitudinal direction L. Thus, the second strain relief aperture 473 is positioned such that the second insulation displacement slot 453 is positioned between the first insulation displacement slot 451 and the second strain relief aperture 473. Thus, each of the first and second insulation displacement slots 451 and 453 are positioned between the first and second strain relief apertures 471 and 473. Opposed surface portions that define the second strain relief aperture 473 are configured to grip the outer electrically insulative layer without extending through the outer electrically insulative layer to the electrical conductor when the electrical cable 428 extends through the both insulation displacement slots 451 and 453 and the second strain relief aperture 473. The surface portions of the at least one strain relief aperture can be defined by different opposed surfaces, or by the same surface. It should be appreciated that the first and second strain relief apertures 471 and 473 can be configured as strain relief slots as illustrated. It should be appreciated that the insulation displacement slots 451 and 453 define a first width along the lateral direction A, and the strain relief apertures 471 and 473 define a second width along the lateral direction A that is greater than the first width.

It should be appreciated that each of the at least one surface 450*a* that defines the first insulation displacement slot 451 and the at least one surface 452*a* that defines the second insulation displacement slot 453 can include opposed surface portions that at least partially define the respective insulation displacement slots 451 and 453. For instance, the at least one surface 450*a* can include a pair of opposed surfaces 450*a*. Similarly, the at least one surface 452*a* can include a pair of opposed surfaces 452*a*. The opposed surface portions can be defined by the same surface or by different surfaces. As described above, the opposed surface portions of the strain relief apertures 471 and 473 can likewise be defined by the same surface or by different surfaces. In accordance with the illustrated embodiment, the first and second arms 450 and 452 and the bridge 427 can include a first bridge portion and a second bridge portion that is spaced from the first portion along the lateral direction. Each portion of the first and second arms 450 and 452 partially defines the respective first and second insulation displacement slots 451 and 453 and the first and second strain relief apertures 471 and 473. The first and second portions of each of the first and second arms 450 and 452 are attached to each other at the respective inner regions 470*a* and 471*a*, for instance via the first and second bridge portions.

The first and second portions of the bridge 427 define respective surfaces that face each other and define a first width along the lateral direction when the electrical cable 428 is not disposed in the first and second insulation displacement slots 451 and 453 and the first and second strain relief apertures 471 and 473. One or both of the first and second bridge portions is flexible from the other of the first and second bridge portions along the lateral direction. For instance, the first width defined by the opposed surfaces of the first and second bridge portions can be less than an outer cross-sectional dimension, such as an outer diameter, of the outer electrically insulative layer 439 of the electrical cable 428. During operation, the electrical cable 428 is inserted into the bridge 427 and the first and second arms 450 and 452, and in particular into the first and second insulation displacement slots 451 and 453 and the first and second strain relief apertures 471 and 473. The outer electrically insulative layer 439 causes one or both of the first and second bridge portions to flex away from the other of the first and second bridge portions as the electrical cable is inserted into the bridge 427.

Further, at least one or both of the outer regions 470*b* and 471*b* of the first and second arms 450 and 452 can be angled toward the respective inner region 470*a* and 471*a* as it extends along a direction away from the mounting portion 426, and in particular from the base 440. Accordingly, as the electrical cable is inserted into the first and second arms 450 and 452, and in particular into the first and second insulation displacement slots 451 and 453 and the first and second strain relief apertures 471 and 473 along the transverse direction T, the surface portions that define the strain relief apertures 471 and 473 apply a tensile force to the outer electrically insulative layer 439.

As illustrated in FIGS. 5B and 5G-5N, the entirety of the insulation displacement contact 422 can be made from a single monolithic sheet of stock material 474, such as a metal, by folding the sheet along various fold lines to produce the mating and mounting portions 424 and 426. As illustrated in FIG. 5O, the single monolithic structure can further include a carrier strip 449 that extends from the electrically conductive contact body 423 of a plurality of insulation displacement contacts 422, which can all be formed by the same single monolithic sheet of stock material. The individual insulation displacement contacts 422 can be removed from the carrier strip 449. Referring to FIGS. 5A and 5G, the stock material 474 can define a first end 474*a* and a second end 474*b* spaced from the first end 474*a* along the longitudinal direction L. The stock material defines a slot 476 that is elongate along the longitudinal direction L, and defines the first insulation displacement slot 451, the second insulation displacement slot 453, the first strain relief aperture 471, and the second strain relief aperture 473. It will be appreciated that the following bending steps can be performed in any order as desired.

As illustrated in FIG. 5H, the protrusions 443 of the first and second arms 450 and 452 can be bent along respective first and second bend lines 478*a* and 478*b* such that the protrusions are configured to engage the connector housing 477 in the manner described above. As illustrated in FIG. 5I, the stock material 474 can be bent along a third bend line 478*c* so as to define the first arm 450, including the first outer region 470*b*. The third bend line 478*c* can be aligned with a portion of the elongate slot 476 so as to define the first strain relief aperture 471 and the first insulation displacement slot 451. Thus, the third bend line 478*c* can be disposed between the first and second ends 474*a* and 474*b*. As illustrated in FIG. 5J, the stock material 474 can be bent along a fourth bend line 478*d* so as to form the bridge 427 and the inner region 470*a* of the first arm 450. The fourth bend line 478*d* can be disposed between the third bend line 478*c* and the second end 474*b*. As illustrated in FIG. 5K, the stock material 474 can be bent along a fifth bend line 478*e* so as to form the second arm 452, including the second inner region 471*a* and the second outer region 471*b* as illustrated in FIG. 5L, a first inner portion of the base 440 can be bent along a sixth bend line 474*f* from the second arm 452 along a direction toward the first arm 450 at a location spaced below the bridge 427. As illustrated in FIG. 5M, second and third inner portions of the base 440 can be bent along a seventh bend line 478*g* from the first arm 450 along a direction toward the second arm 452 at a location spaced below the bridge 427. The first inner portion of the base 440 can be disposed between the second and third inner portions of the base 440 with respect to the lateral direction A (see FIG. 5B). Lastly, as illustrated in FIG. 5N, at least one outer tab 496 of the first arm 450 can be bent along an eight bend line 478*h* away from the first, second, and third inner portions of the base 440 along the longitudinal direction L so as to form a first outer portion of the base 440. Similarly, at least one outer tab 498 of the second arm 452, such as a pair of outer tabs 498, can be bent along a ninth bend line 478*i* away from the first, second, and third inner portions of the base 440 along the longitudinal direction L so as to form a second outer portion of the base 440. Thus, the first, second, and third inner portions of the base 440 can be disposed between the first and second outer portions of the base 440 with respect to the longitudinal direction. At least portion of each of the first, second, and third inner portions of the base 440 can be coplanar with at least a portion of the first and second outer portions of the base 440.

Referring now to FIGS. 5P-5T, an insulation displacement connector 475 can include one or more of the insulation displacement contacts 422 and a dielectric or electrically insulative connector housing 477 that includes a housing body 479 and at least one cable retention channel 485 such as a plurality of cable retention channels 485 that extend through the housing body 479 along the longitudinal direction L. For instance, each of the cable retention channels 485 can extend through opposed end walls 483 of the housing body 479 that are spaced from each other along the longitudinal direction L. The cable retention channel 485 is sized to receive the electrical cable 428, and has a width along the lateral direction A that is sized so that the electrical cable 428 can be retained in the cable retention channel 485. For instance, at least a portion of the cable retention channel 485 can define a width along the lateral direction A that is less than an outer cross-sectional dimension, such as an outer diameter, of the outer electrically insulative layer 439 of the electrical cable 428. Accordingly, at least one surface of the housing body 479 that defines the portion of the cable retention channel 485 can at least compress or pierce the outer electrically insulative layer 439 so as to retain the electrical cable 428 in the respective cable retention channel 485.

At least a portion of each of the cable retention channels 485 can be open at one end, for instance the lower end that faces the downward along the transverse direction T, and thus faces the complementary electrical component 430 when the insulation displacement contacts 422 are mounted to the complementary electrical component 430. The connector housing 477 can be brought down with respect to the insulation displacement contacts 422 along an insertion direction, so as to insert the electrical cable 428 into the insulation displacement slots 451 and 453 and the strain relief apertures 471 and 473. Each of the insulation displacement contacts 422 can further include a plurality of retention apertures 425, which can define cradles that are each open to one of the insulation displacement slots 451 and 453 and the strain relief apertures 471 and 473. The retention apertures 425 are spaced further from the mounting portion 426 than the first and second insulation displacement slots 451 and 453 are spaced from the mounting portion 426. The retention apertures 425 define a second cross-sectional dimension along the lateral direction A that is greater than that of the respective cross-sectional dimension of the corresponding one of the insulation displacement slots 451 and 453 and the strain relief apertures 471 and 473. Thus, the connector housing 477 can be brought down with respect to the insulation displacement contacts 422 along the insertion direction so as to insert the retained electrical cables 428 in the retention apertures 425 of the corresponding insulation displacement contacts 422. Further movement of the connector housing 477 downward in the insertion direction causes the electrical cable 428 to move from the retention apertures 425 into the respective insulation displacement slots 451 and 453 and the strain relief apertures 471 and 473. When the connector housing 477 is mounted onto the insulation displacement contacts 422, the first and second arms 450 and 452 are disposed between the end walls of the housing body 479.

Referring now in particular to FIGS. 5S-5T, the insulation displacement contact 422 can include a lock mechanism that is movable between an engaged configuration and a disengaged configuration. When the lock mechanism is in the engaged configuration, the lock mechanism prevents the connector housing 477 from being removed from the insulation displacement contacts 422. When the lock mechanism is in the disengaged configuration, the lock mechanism does not prevent removal of the connector housing 477 from the insulation displacement contacts 422 along a removal direction that is opposite the insertion direction. Thus, the connector housing 477 can be removed from the insulation displacement contacts 422 along the removal direction. For instance, the lock mechanism can include at least one engagement member of the insulation displacement contact 422 that is configured to engage with a complementary engagement member of the connector housing 477 when the lock mechanism is in the engaged configuration, so as to interfere with each other and prevent movement of the connector housing 477 along the removal direction with respect to the insulation displacement contacts 422. The at least one engagement member of the insulation displacement contact 422 is configured, in response to a removal force, disengage from the engagement member of the connector housing 477 so as to remove the interference and iterate the lock mechanism to the disengaged configuration.

For instance, in accordance with one embodiment, the lock mechanism can include at least one engagement member, such as a first engagement member, that is supported by the first arm 450 and can be configured as a protrusion 443 of the first arm 450. The lock mechanism can further include at least one engagement member, such as a second engagement member, that is supported by the second arm 452 and can be configured as a protrusion 443 of the second arm 452. The first and second engagement members can be configured as a protrusion of the outer regions 470*b* and 471*b* that extend away from the respective inner regions 470*a* and 471*a*. The connector housing 477 defines complementary engagement members that can be defined by the housing body 479, for instance by the end walls of the housing body 479. The engagement members of the connector housing can be configured as first and second abutment surfaces of the opposed end walls, respectively, that define recesses that extend into or through the respective end wall. The protrusions of the insulation displacement contact can be flexible such that, when the connector housing 477 is mounted onto the insulation displacement contacts 422, the protrusions of the insulation displacement contacts 422 are received in the recesses of the connector housing 477. Thus, the engagement members of the insulation displacement contacts 422 abut the engagement members of the connector housing 477 so as to define an interference between the insulation displacement contacts 422 and the connector housing 477 that prevents the connector housing 477 from being moved relative to the insulation displacement contacts 422 along the removal direction. It should be appreciated that the engagement members of the insulation displacement contacts 422 can be defined by recesses and the engagement members of the connector housing 477 can alternatively be configured as protrusions that are configured to be received by the recesses.

An insulation displacement connector assembly can include the insulation displacement connector 475 and a housing removal tool 487 having one or more sets of first and second removal walls 489*a* and 489*b* sized to be inserted through respective ones of first and second access slots 491*a* and 491*b* that extend at least into or through the housing body 479 in alignment with the first and second flexible engagement members, for instance of the insulation displacement contact 422. The first and second removal walls 489*a* and 489*b* are configured to apply a removal force to the respective ones of the first and second flexible engagement members to bias the first and second engagement members inward, for instance toward the respective inner regions 470*a* and 471*a*, and away from the connector housing 477, thereby removing the interference between the insulation displacement contacts 422 and the connector housing 477.

The electrical connector assembly 420 can include the insulation displacement connector 475 or the insulation displacement connector assembly; the electrical cable 428 extending through the cable retention channel 485, such that the connector housing 477 is configured to move along the insertion direction so as to insert the retained electrical cable into the insulation displacement slots 451 and 453 and strain relief apertures 471 and 473 of the mating portion 424. The electrical connector assembly 420 can further include the complementary electrical component 430, wherein the mounting portion 426 of the insulation displacement contact 422 is configured to be mounted onto the complementary electrical component 430, such that the complementary electrical component 430 is in electrical communication with the electrical conductor of the electrical cable 428.

A method can be provided for selling one or more of the insulation displacement connector 475, the insulation displacement connector assembly and the electrical connector assembly 420, the method including the steps of teaching to a third party one or more method steps of using or assembling one or more of the insulation displacement connector 475, the insulation displacement connector assembly and the electrical connector assembly 420, and selling to the third party at least one or more of the insulation displacement connector 475, the insulation displacement connector assembly, and the electrical connector assembly 420.

Referring now to FIGS. 6A-6F generally, an electrical connector assembly 520 can include at least one insulation displacement contact 522 such as a plurality of insulation displacement contacts 522. The insulation displacement contact 522 defines a mating portion 524 and a mounting portion 526. The electrical connector assembly 520 can further include at least one electrical cable 528 such as a plurality of electrical cables that are configured to mate with a respective one of the insulation displacement contacts at the respective mating portion 524, and a complementary electrical component such as a substrate, for instance a printed circuit board. The insulation displacement contact 522, and in particular the respective mounting portion 526, is configured to be mounted to a respective electrical terminal of the complementary electrical component, which for instance can be configured as a mounting pad, in the manner described above. Thus, the mounting portions 526 are each configured to be surface mounted, for instance soldered, welded, or the like, onto the complementary electrical component, for instance to the electrical terminal. Alternatively or additionally, the mounting portion 526 can include a projection that is configured to be inserted into an aperture of the complementary electrical component, and the projection can be press-fit into the aperture of the complementary electrical component, which can be an electrically conductive plated via, in the manner described above. When the insulation displacement contact 522 is mounted to the complementary electrical component and mated with the respective electrical cable 528, the electrical cable 528 is placed in electrical communication with the complementary electrical component. It should be appreciated that the complementary electrical component, and all complementary electrical components described herein, can be a printed circuit board or any suitable constructed alternative electrical component as desired.

The insulation displacement contacts 522, and all insulation displacement contacts described herein, can be made from any suitable electrically conductive material, such as a metal. Each insulation displacement contact 522 can include an electrically conductive contact body 523 that defines both the mating portion 524 and the mounting portion 526, which can be monolithic with the mating portion 524. The mating portion 524 can include at least one slot that extends into the contact body 523, and at least one piercing member 537 that at least partially defines the slot such that, when the slot receives the electrical cable 528, the piercing member 537 pierces an outer electrically insulative layer 539 of the electrical cable 528 and contacts an electrical conductor 541 of the electrical cable 528 that is disposed inside the outer electrically insulative layer 539. The outer electrically insulative layer 539, and all outer electrically insulative layers as described herein, can be made of any suitable electrically insulative material as desired. The electrical conductor 541, and all electrical conductors as described herein, can be made from any suitable electrically conductive material as desired.

The electrically conductive contact body 523 can include a base 540 that defines an outer surface and an inner surface 544 that faces opposite the outer surface along the transverse direction T. The outer surface is configured to face the electrical terminal, and can be configured as an outer contact surface 542 that is configured to contact the electrical terminal. For instance, the outer contact surface 542 can be surface mounted, such as soldered or welded, to the electrical terminal. Alternatively, the base 540 can include mounting tails that extend from the outer surface and are configured to be inserted, for instance press-fit, into vias of the complementary electrical component. Thus, the mounting portion 526 can be defined by the base 540, and in particular the outer contact surface 542. When the outer contact surface 542 is in contact with the electrical terminal of the substrate, either directly or indirectly, the electrical terminal of the substrate in placed in electrical communication with the mounting portion 526, and thus the mating portion 524. The outer contact surface 542 and the inner surface 544 can be spaced from each other along a transverse direction T. In particular, the inner surface 544 is spaced above, or up from, the outer contact surface 542 along the transverse direction T, and the outer contact surface 542 is spaced below, or down from, the inner surface 544 along the transverse direction T.

The mating portion 524 can include at least one arm, such as a first arm 550, that extends from the mounting portion 526, and in particular from the base 540. The first arm 550 includes at least one surface, such as at least one first surface 550*a* including a pair of opposed first surfaces 550*a* that can define an insulation displacement slot, such as a first insulation displacement slot 551, that extends through at least a portion of the first arm 550 and thus the contact body 523, and thus the mating portion 524, for instance along the longitudinal direction L. One or both of the first surfaces 550*a* can further define a piercing member 537 that pierces the outer electrically insulative layer 539 of the electrical cable 528 and contacts the electrical conductor 541 when the electrical cable 528 is disposed in the insulation displacement slot 551. Both of the first surfaces 550*a* can define piercing members 537 so as to define redundant points of electrical contact with the electrical conductor of the electrical cable. The first surfaces 550*a*, and thus the piercing members 537, can be spaced from each other along the lateral direction A.

The insulation displacement slot 551 can be referred to as a first insulation displacement slot, and the first arm 550 can include at least one surface, such as at least one second surface 550*b* including a pair of opposed second surfaces 550*b*, that can define an insulation displacement slot, such as a second insulation displacement slot 553, that extends through the first arm 550 and thus the contact body 523, and thus the mating portion, for instance along the longitudinal direction L. One or both of the second surfaces 550*b* can further define a piercing member 537 that pierces the outer electrically insulative layer 539 of the electrical cable 528 and contacts the electrical conductor 541 when the electrical cable 528 is disposed in the second insulation displacement slot 553. Both of the second surfaces 550*b* can define piercing members 537 so as to define redundant points of electrical contact with the electrical conductor of the electrical cable. The second surfaces 550*b*, and thus the piercing members 537, can be spaced from each other along the lateral direction A. The first and second insulation displacement slots 551 and 553 are aligned with each other in the longitudinal direction L, such that the electrical cable 528 can be inserted into each of the first and second insulation displacement slots 551 and 553.

In accordance with one embodiment, the first arm 550 can define a first or inner region 570*a* and a second or outer region 570*b*. The inner and outer regions 570*a* and 570*b* are located such that the inner region 570*a* is disposed between the outer region 570*b* and a strain relief aperture 571 of a second arm 552 with respect to the longitudinal direction. Thus, the inner and outer regions 570*a* and 570*b* are spaced from each other along the longitudinal direction L. In accordance with one embodiment, the inner region 570*a* can extend away from the base 540, and the outer region 570*b* can extend from the inner region 570*a* toward the base 540 at a location spaced from the inner region 570*a* along the longitudinal direction L. Thus, the first arm 550 can define an inverted, or downward facing, concavity that can be configured as a U-shape or any suitable alternative shape as desired. The contact body 523 can define an insertion opening 525 that extends down through the upper ends of the inner and outer regions 570*a* and 570*b* so as to be continuous with each of the first and second insulation displacement slots 551 and 553. The insertion opening 525 can extend through an interface defined by the first and second arms 550 and 552. Thus, the electrical cable can be inserted down along the transverse direction T through the insertion opening 525 and into each of the first and second insulation displacement slots 551 and 553. The base 540 can be segmented as it extends along the longitudinal direction L as illustrated, or can be continuous as desired. The first insulation displacement slot 551 extends through the first region 570*a* along the longitudinal direction L, and the second insulation displacement contact 553 extends through the outer region 570*b* along the longitudinal direction L.

The mating portion 524 can further include the second arm 552 that extends out with respect to the mounting portion 526, and in particular from the base 540. In accordance with one embodiment, the second arm 552 extends out from the mounting portion 526 and base 540 directly, though the mating portion 524 can alternatively extend out from the mounting portion 526 indirectly, that is, from the first arm 550 which, in turn, extends out from the base 540. Thus, the first and second arms 550 and 552 can be connected by a bridge of the type illustrated in FIGS. 5A-5M. The first and second arms 550 and 552 are spaced from each other along the longitudinal direction L, such that the mating portion 524 can define, sequentially along the longitudinal direction L, the outer region 570*b*, the inner region 570*a*, and the second arm 552.

The second arm 552 includes at least one second surface 552*a*, which can define an inner surface such as a pair of opposed inner surfaces that can define an strain relief aperture 571, that extends through the second arm 552 along the longitudinal direction L. The second surfaces 552*a* can be spaced from each other along the lateral direction A so as to define the strain relief aperture 571. The strain relief aperture 571 can be spaced from the first arm 550, and thus spaced from the first and second insulation displacement slots 551 and 553 along the longitudinal direction L. The strain relief aperture 571 can be aligned with the first and second insulation displacement slots 551 and 553 along the longitudinal direction L. Thus, the strain relief aperture 571 is positioned such that one of the first and second insulation displacement slots 551 and 553 is positioned between the other of the insulation displacement slots 551 and 553 and the strain relief aperture 571 with respect to the longitudinal direction L. In particular, the first insulation displacement slot 551 is positioned between the second insulation displacement slot 553 and the strain relief aperture 571. The opposed second surfaces 552*a* that define the strain relief aperture 571 are configured to grip the outer electrically insulative layer without extending through the outer electrically insulative layer to the electrical conductor when the electrical cable 528 extends through the both insulation displacement slots 551 and 553 and the strain relief aperture 571. It should be appreciated that the insulation displacement slots 551 and 553 define respective first widths along the lateral direction A, which can be equal to each other or different than each other, and the strain relief aperture 571 defines a second width along the lateral direction A that is greater than the first width of each of the insulation displacement slots 551 and 553. It should be appreciated that the strain relief aperture 571 can be configured as a strain relief slot as illustrated, and can be open at its upper end. Thus, as the electrical cable is inserted down through the insertion opening 525 along the transverse direction T and into the insulation displacement slots 551 and 553, the electrical cable is also inserted into the strain relief aperture 571. During operation, a tensile force applied to the electrical cable away from the strain relief aperture 571 is absorbed by the second arm 552, thereby substantially isolating the tensile force from the interface between the electrical cable and the insulation displacement slots 551 and 553.

With continuing reference to FIGS. 6A-6F, the contact body 523 can include at least one weakened portion 572 adjacent to at least one or both of the insulation displacement slots 551 and 553, for instance with respect to the lateral direction A. Thus, the weakened portions 572 are disposed in a wall that defines an insulation displacement slot. The wall can be defined by the first arm 550, for instance at one or both of the inner region 570*a* and the outer region 570*b*. In accordance with the illustrated embodiment, the inner region 570*a* can define at least one weakened portion 572, for instance, a pair of weakened portions 572, adjacent the first insulation displacement slot 551, such that the first insulation displacement slot 551 is disposed between the weakened portions 572 along the lateral direction. The weakened portions 572 can be spaced from the respective first surface 550*a* along the lateral direction A, and thus can be defined between the respective first surface 550*a* and a laterally outer surface of the inner region 570*a*, and thus of the first arm 550. Similarly, the outer region 570*b* can define at least one weakened portion 572, for instance, a pair of weakened portions 572, adjacent the second insulation displacement slot 553, such that the second insulation displacement slot 553 is disposed between the weakened portions 572 along the lateral direction A. The weakened portions 572 can be spaced from the respective second surface 550*b* along the lateral direction A, and thus can be defined between the respective second surface 550*b* and a laterally outer surface of the outer region 570*b*, and thus of the first arm 550.

Each of the inner and outer regions 570*a* and 570*b* can define respective inner surfaces 574 and outer surfaces 576 that face opposite the inner surfaces 574 along the longitudinal direction. The inner surfaces 574 of the inner and outer regions 570*a* and 570*b* face each other along the longitudinal direction L. The weakened portions 572 can be configured as windows 578 in the respective inner and outer regions 570*a* and 570*b*. The windows 578 can be defined by embossments 580 as illustrated. As will be described in more detail below, the embossments 580 can define at least one region of removed material so as to provide an aperture 582 that extends through the respective inner and outer regions 570*a* and 570*b*. Alternatively, an entirety of the windows 578 can be defined by an aperture, which can be provided by material that has been removed, for instance punched, out of the respective inner and outer regions 570*a* and 570*b*.

Each of the embossments 580 can define a recess 584 that extends into one of the inner surface 574 and the outer surface 576, and a projection 586 that extends out with respect to the other of the inner surface 574 and the outer surface 576. In accordance with one embodiment, the recess 584 extends into the inner surfaces 574 of each of the inner and outer regions 570*a* and 570*b*, and the projection 586 extends out from the outer surfaces 576 of each of the inner and outer regions 570*a* and 570*b*.

As described above, the embossments 580 can define an aperture 582 that extends through the contact body 523, for instance the first arm 550, and in particular through the corresponding one of the inner region 570*a* and the outer region 570*b*. The contact body 523, for instance the first arm 550, and in particular the respective inner and outer regions 570*a* and 570*b*, can define a margin 590 disposed between the respective insulation displacement slot and each of the weakened portions 572, such as the embossments 580, along the lateral direction A. In accordance with one embodiment, the embossments 580 define a perimeter 588 having an inner end disposed closest to the respective insulation displacement slot than any other region of the embossment 580. The aperture 582 can extend through the respective inner and outer regions 570*a* and 570*b* between the inner end of the perimeter and the respective margin 590. The weakened portions 572 allow for deformation, which can include a change of size, shape or position, such as deflection, of one or both of the respective first surfaces 550*a* and second surfaces 550*b* when the electrical cable is inserted into the respective insulation displacement slot. For instance, the surfaces can deform from a straight configuration A as they extend along the transverse direction T to a curved configuration B as they extend along the transverse direction T (see FIG. 6C). Thus, when the electrical cable is inserted into the respective insulation displacement slot, the electrical cable provides a force to the respective surfaces 550*a* and 550*b* that causes one or both of the opposed surfaces to deflect away from the other of the opposed surfaces. Without being bound by theory, it is believed that as the respective ones of the surfaces 550*a* and 550*b* deform, the respective margins 590 that include the surfaces 550*a* and 550*b* also deform against the weakened portion 572 along the lateral direction A, thereby compressing the weakened portion 572 with respect to the lateral direction.

As illustrated in FIG. 6G, the entirety of the insulation displacement contact 522 can be made from a single monolithic sheet 592 of stock material, such as a metal, by folding the sheet along various fold lines to produce the mating and mounting portions 524 and 526, respectively.

A method can be provided for selling one or more of the insulation displacement contact 522 and the electrical connector assembly 520, the method including the steps of teaching to a third party one or more method steps of using or assembling one or more of the insulation displacement contacts 522 and the electrical connector assembly 520, and selling to the third party at least one or more of the insulation displacement contact 522 and the electrical connector assembly 520.

Referring now to FIGS. 7A-7J, an electrical connector assembly 620 can include at least one insulation displacement contact 622 such as a plurality of insulation displacement contacts 622 that define a mating portion 624 and a mounting portion 626. The electrical connector assembly 620 can further include at least one electrical cable 628 (see FIG. 7I) such as a plurality of electrical cables 628 that are configured to mate with a respective one of the insulation displacement contacts 622 at the mating portion 624, and a complementary electrical component 630 such as a substrate, for instance a printed circuit board. The insulation displacement contacts 622, and in particular the mounting portions 626, are configured to be mounted to the substrate so as to place the insulation displacement contacts 622 in electrical communication with the substrate. The electrical connector assembly 620 can further include one or more dielectric or electrically insulative connector housings 677 each configured to support at least one of the insulation displacement contacts 622, such as a plurality of the insulation displacement contacts 622.

The insulation displacement contacts 622, and in particular the respective mounting portions 626, are configured to be mounted to a respective electrical terminal 632 of the complementary electrical component 630, which for instance can be configured as a mounting pad. Thus, the mounting portions 626 are each configured to be surface mounted, for instance soldered, welded, or the like, onto the complementary electrical component 630, for instance to the electrical terminal 632. Alternatively or additionally, as illustrated in FIGS. 8A-8F, the mounting portion 626 can include at least one mounting tail 675 as a projection that is configured to be inserted into an aperture of the complementary electrical component 630. The mounting tail 675 can be press-fit into the aperture of the complementary electrical component 630. The apertures can be electrically conductive plated vias, or can be apertures that are configured to receive the projections so as to locate the mounting portions 626 with the mounting pad. When the insulation displacement contact 622 is mounted to the complementary electrical component 630 and mated with the respective electrical cable 628, the electrical cable 628 is placed in electrical communication with the complementary electrical component 630. It should be appreciated that the complementary electrical component 630, and all complementary electrical components described herein, can be a printed circuit board or any suitable constructed alternative electrical component 630 as desired.

The insulation displacement contacts 622, and all insulation displacement contacts described herein, can be made from any suitable electrically conductive material, such as a metal. Each insulation displacement contact 622 can include an electrically conductive contact body 623 that defines both the mating portion 624 and the mounting portion 626, which can be monolithic with the mating portion 624. The mating portion 624 can include at least one slot that extends into the contact body 623, and at least one piercing member 637 that at least partially defines the slot such that, when the slot receives the electrical cable 628, the piercing member 637 pierces an outer electrically insulative layer 639 of the electrical cable 628 and contacts an electrical conductor 641 of the electrical cable 628 that is disposed inside the outer electrically insulative layer 639. The outer electrically insulative layer 639, and all outer electrically insulative layers as described herein, can be made of any suitable electrically insulative material as desired. The electrical conductor 641, and all electrical conductors as described herein, can be made from any suitable electrically conductive material as desired.

The electrically conductive contact body 623 can include a base 640 that defines an outer surface and an inner surface 644 that faces opposite the outer surface along the transverse direction T. The outer surface is configured to face the electrical terminal, and can be configured as an outer contact surface 642 that is configured to contact the electrical terminal 632. For instance, the outer contact surface 642 can be surface mounted, such as soldered or welded, to the electrical terminal 632. The base 640 can include at least first and second base segments 640*a* and 640*b* that are spaced from each other along a longitudinal direction L that is perpendicular to the transverse direction T. Each of the first and second base segments 640*a* and 640*b* can be bifurcated so as to define a pair of regions that are separated from each other along a lateral direction A that is perpendicular to both the longitudinal direction L and the transverse direction T. Each of the first and second base segments 640*a* and 640*b*, including the respective regions, can define a respective outer contact surface 642.

Alternatively or additionally, as illustrated in FIGS. 8A-8F, the base 640 can include at least one mounting tail that projects down from a respective at least one of the first and second arms 650 and 652. The mounting tails 675 can extend down from respective ones of the outer regions 670*b* and 671*b* of the first and second arms 650 and 652, respectively, along the transverse direction T. The mounting tails 675 are configured to be inserted, for instance press-fit, into vias of the complementary electrical component 630. The mounting portion can include any number of mounting tails 675 as desired. For instance, as illustrated in FIGS. 8A-8C, the mounting portion can include first and second mounting tails 675 that are spaced from each other along the longitudinal direction L, and can extend along respective planes that are defined by the transverse direction T and the lateral direction A. The mounting tails 675 can thus be configured as blades that traverse an entirety of the respective strain relief apertures 673 and 681. As illustrated in FIGS. 8D-8F, the mounting portion can include four mounting tails 675. For instance, a first pair of mounting tails 675 can extend down from the first outer end 670*b* of the first arm 650. A second pair of mounting tails 675 can extend down from the second outer end 671*b* of the second arm 652. Each of the mounting tails 675 of the first pair can be spaced apart along the lateral direction A. Each of the mounting tails 675 of the second pair can be spaced apart along the lateral direction A. Thus, the mounting tails 675 can be configured as mounting fingers that are each configured to be inserted into a respective opening of the complementary electrical component. It should be appreciated that the mounting portion can include any number of mounting tails as desired. As illustrated in FIGS. 8D-8F, the insulation displacement contact 622 can include the first and second base segments 640*a* and 640*b*, such that the mounting tails 675 project down with respect to the base segments 640*a* and 640*b* along the transverse direction T. The first and second base segments 640*a* and

640*b* can be configured to abut the complementary electrical component so as to limit a depth of insertion of the mounting tails 675 into the complementary electrical component. Thus, the first and second base segments 640*a* and 640*b* can extend out with respect to the mounting tails 675 along the lateral direction A.

It should be appreciated that the mounting portion 626 can be defined by the base 640, and in particular the outer contact surface 642. The mounting portion 626 can further be defined by at least one mounting tail 675 which can define a mounting tail that extends down along the transverse direction with respect to the outer contact surface 642. When the outer contact surface 642 is in contact with the electrical terminal 632, either directly or indirectly, the electrical terminal 632 is placed in electrical communication with the mounting portion 626, and thus the mating portion 624. The outer contact surface 642 and the inner surface 644 can be spaced from each other along a transverse direction T. In particular, the inner surface 644 is spaced above, or up from, the outer contact surface 642 along the transverse direction T, and the outer contact surface 642 is spaced below, or down from, the inner surface 644 along the transverse direction T.

The mating portion 624 can include a first arm 650 that extends from the mounting portion 626, and in particular from the base 640. For instance, the first arm 650 can extend from the first base segment 640*a*. The first arm 650 includes at least one surface 650*a* that defines an insulation displacement slot 651 extending through the first arm 650, for instance along the longitudinal direction L. The at least one surface 650*a* can include a pair of opposed surfaces 650*a*. The at least one surface 650*a* can further define a piercing member 637 that pierces the outer electrically insulative layer 639 of the electrical cable 628 and contacts the electrical conductor 641 when the electrical cable 628 is disposed in the insulation displacement slot 651. The mating portion 624 can further include a second arm 652 that also extends out with respect to the mounting portion 626, and in particular from the base 640. For instance, the second arm 652 can extend from the second base segment 640*b*. It should be appreciated that both the first arm 650 and the second arm 652 can extend directly out from the base 640, and thus directly from the mounting portion 626. The first and second arms 650 and 652 are spaced from each other along the longitudinal direction L.

The insulation displacement slot 651 can be referred to as a first insulation displacement slot, and the second arm 652 includes at least one surface 652*a* that defines a second insulation displacement slot 653 extending through the second arm 652, for instance along the longitudinal direction L. The at least one surface 650*a* can include a pair of opposed surfaces 650*a*. Thus, the contact body 623 includes first and second insulation displacement slots 651 and 653 that extend through the mating portion 624. The at least one surface 650*a* can further define a piercing member 637 that pierces the outer electrically insulative layer 639 of the electrical cable 628 and contacts the electrical conductor 641 when the electrical cable 628 is disposed in the second insulation displacement slot 653. The first and second insulation displacement slots 651 and 653 are aligned with each other in the longitudinal direction, such that the electrical cable 628 can be inserted into each of the first and second insulation displacement slots 651 and 653. The insulation displacement slots can define any distance along the lateral direction A as desired. Thus, the opposed surfaces that define the respective insulation displacement slots 651 and 653 can be spaced from each other any distance along the lateral direction as desired. For instance, the insulation displacement slots 651 and 653, and thus the opposed surfaces that define the respective insulation displacement slots, can be spaced from each other by a distance of zero prior to insertion of the electrical cable into the insulation displacement slots 651 and 653. Insertion of the electrical cable into the insulation displacement slots 651 and 653 can cause the opposed surfaces 650*a* and 652*a* to move away from each other along the lateral direction A such that the electrical cable is disposed in the insulation displacement slots 651 and 653. Alternatively, the insulation displacement slots 651 and 653, and thus the opposed surfaces that define the respective insulation displacement slots, can be spaced from each other by a distance greater than zero prior to insertion of the electrical cable into the insulation displacement slots 651 and 653.

The first arm 650 can define a first or inner region 670*a* and a second or outer region 670*b*. The inner and outer regions 670*a* and 670*b* are located such that the inner region 670*a* is disposed between the outer region 670*b* and the second arm 652. In accordance with one embodiment, the outer region 670*b* can extend away from the base 640, and the inner region 670*a* can extend from the outer region 670*b* toward the base 640 at a location spaced from the outer region 670*b* along the longitudinal direction L. For instance, the outer region 670*b* can extend away from the first base segment 640*a*. Thus, the first arm 650 can define an inverted, or downward facing, concavity along the longitudinal direction. The concavity can be configured as a U-shape or any suitable alternative shape as desired. The concavity can be defined at an interface of the outer region 670*b* and the inner region 670*a*. Similarly, the second arm 652 can define a first or inner region 671*a* and a second or outer region 671*b*. The inner and outer regions 671*a* and 671*b* are located such that the inner region 671*a* is disposed between the outer region 671*b* and the first arm 650. The outer region 671*b* can extend out from the base 640. For instance, the outer region 671*b* can extend out from the second base segment 640*b*. In accordance with one embodiment, the outer region 671*b* can extend from the inner region 671*a* toward the base 640 at a location spaced from the inner region 671*a* along the longitudinal direction L. Accordingly, the second arm 652 can define an inverted, or downward facing, concavity along the longitudinal direction L. The concavity can be configured as a U-shape or any suitable alternative shape as desired. The concavity can be defined at an interface of the outer region 671*b* and the inner region 671*a*.

In accordance with one embodiment, the insulation displacement contact 622, and in particular the mating portion 624, can include a bridge 627 that is connected between the inner region 670*a* of the first arm 650 and the inner region 671*a* of the second arm 652. Thus, the inner region 671*a* can extend from the inner region 670*a* of the first arm 650 upward along the transverse direction T, and thus away from the base 640. Similarly, the inner region 670*a* can extend from the inner region 671*a* of the second arm 652 upward along the transverse direction T, and thus away from the base 640. The bridge 627 can define an upward-facing concavity that can be configured as a U-shape or any suitable alternative shape that is oriented opposite the downward-facing concavities of the first and second arms 650 and 652. The mating portion 624 can define, sequentially along the longitudinal direction L, the outer region 670*b*, the inner region 670*a*, the inner region 671*a*, and the outer region 671*b*. It should be appreciated that the inner region 671*a* can be spaced from the inner region 670*a* along the longitudinal direction L, and the inner regions 670*a* and 671*a* can be disposed between the outer regions 670*b* and 671*b*.

Similarly, the second base segment 640*b* extends out along the longitudinal direction from the lowermost end of the second outer region 671*b*. Thus, the first base segment 640*a* extends from the first outer region 670*b* away from the second base segment 640*b*. Similarly, the second base segment 640*b* extends from the second outer region 671*b* away from the first base segment 640*a*.

The insulation displacement contact 622 can further include at least one strain relief aperture, such as a first strain relief aperture 673, that extends through the mating portion 624, and in particular through at least one of the first and second arms 650 and 652. In accordance with one embodiment, the first strain relief aperture 673 can extend through the first arm 650, and in particular through the outer region 670*b* of the first arm 650. The first strain relief aperture 673 can be aligned with the first and second insulation displacement slots 651 and 653 along the longitudinal direction L. Thus, the first strain relief aperture 673 is positioned such that one of the first and second insulation displacement slots 651 and 653 is positioned between the other of the insulation displacement slots 651 and 653 and the first strain relief aperture 673. In particular, the first insulation displacement slot 651 is positioned between the second insulation displacement slot 653 and the first strain relief aperture 673. Opposed surface portions that define the strain relief aperture are configured to grip the outer electrically insulative layer without extending through the outer electrically insulative layer to the electrical conductor when the electrical cable 628 extends through the both insulation displacement slots 651 and 653 and the first strain relief aperture 673. The surface portions of the at least one strain relief aperture can be defined by different opposed surfaces, or by the same surface.

The insulation displacement contact 622 can further include a second strain relief aperture 681 that extends through the mating portion 624. In accordance with one embodiment, the second strain relief aperture 681 can extend through the second arm 652, and in particular through the outer region 671*b* of the second arm 652. The second strain relief aperture 681 can be aligned with the first and second insulation displacement slots 651 and 653 along the longitudinal direction L. Thus, the second strain relief aperture 681 is positioned such that the second insulation displacement slot 653 is positioned between the first insulation displacement slot 651 and the second strain relief aperture 681. Thus, each of the first and second insulation displacement slots 651 and 653 are positioned between the first and second strain relief apertures 673 and 681. Opposed surface portions that define the second strain relief aperture 681 are configured to grip the outer electrically insulative layer without extending through the outer electrically insulative layer to the electrical conductor when the electrical cable 628 extends through the both insulation displacement slots 651 and 653 and the second strain relief aperture 681. The surface portions of the at least one strain relief aperture can be defined by different opposed surfaces, or by the same surface. It should be appreciated that the first and second strain relief apertures 673 and 681 can be configured as strain relief slots as illustrated. It should be appreciated that the insulation displacement slots 651 and 653 define a first width along the lateral direction A, and the first and second strain relief apertures 673 and 681 define a second width along the lateral direction A that is greater than the first width.

The inner regions 670*a* and 671*a* can define the opposed surfaces that, in turn, define the first and second insulation displacement slots 651 and 653, respectively. The opposed surfaces can further define lead-ins to the respective insulation displacement slots 651 and 653 along the transverse direction T. For instance, the opposed surfaces can taper inward toward each other as they extend down along the transverse direction T. Thus, as the electrical cable is inserted down along the transverse direction T, the electrical cable biases the opposed surfaces to flex away from each other until the electrical cable is received in the respective first and second insulation displacement slots 651 and 653.

It should be appreciated that each of the at least one surface 650*a* that defines the first insulation displacement slot 651 and the at least one surface 652*a* that defines the second insulation displacement slot 653 can include opposed surface portions that at least partially define the respective insulation displacement slots 651 and 653. The opposed surface portions can be defined by the same surface or by different surfaces. As described above, the opposed surface portions of the first and second strain relief apertures 673 and 681 can likewise be defined by the same surface or by different surfaces. In accordance with the illustrated embodiment, the first and second arms 650 and 652 and the bridge 627 can include a first bridge portion and a second bridge portion that is spaced from the first portion along the lateral direction. Each portion of the first and second arms 650 and 652 partially defines the respective first and second defines the respective first and second insulation displacement slots 651 and 653 and the first and second strain relief apertures 673 and 681. The first and second portions of each of the first and second arms 650 and 652 are attached to each other at the respective inner regions 670*a* and 671*a*, for instance via the first and second bridge portions, respectively.

The first and second portions of the bridge 627 define respective surfaces that face each other and define a first width along the lateral direction when the electrical cable 628 is not disposed in the first and second insulation displacement slots 651 and 653 and the first and second strain relief apertures 673 and 681. One or both of the first and second bridge portions is flexible from the other of the first and second bridge portions along the lateral direction. For instance, the first width defined by the opposed surfaces of the first and second bridge portions can be less than an outer cross-sectional dimension, such as an outer diameter, of the outer electrically insulative layer 639 of the electrical cable 628. During operation, the electrical cable 628 is inserted into the first and second insulation displacement slots 651 and 653 and the first and second strain relief apertures 673 and 681. The electrical cable 628 causes one or both of the opposed surfaces that define the respective first and second insulation displacement slots 651 and 653 to flex away from the other of the opposed surfaces that define the respective first and second insulation displacement slots 651 and 653, which can further cause the first and second bridge portions to flex away from the other of the first and second bridge portions.

Further, at least one or both of the outer regions 670*b* and 671*b* of the first and second arms 650 and 652 can be angled toward the respective inner region 670*a* and 671*a* as it extends upward along the transverse direction T, that is away from the mounting portion 626, and in particular from the base 640. Accordingly, as the electrical cable is inserted into the first and second arms 650 and 652 downward along the transverse direction T, and in particular into the first and second insulation displacement slots 651 and 653 and the first and second strain relief apertures 673 and 681, the surface portions that define the first and second strain relief apertures 673 and 681, respectively, apply a tensile force to the outer electrically insulative layer 639.

As illustrated in FIG. 7K, the entirety of the insulation displacement contact 622 can be made from a single monolithic sheet of stock material, such as a metal, by folding the sheet along various fold lines to produce the mating and mounting portions 624 and 626. As illustrated in FIG. 7K, the single monolithic structure can further include a carrier strip 649 that extends from the electrically conductive contact body 623 of a plurality of insulation displacement contacts 622, which can all be formed by the same single monolithic sheet of stock material. The insulation displacement contacts 622 can be removed from the carrier strip 649.

Referring now to FIGS. 7L-7Q, the electrical connector assembly 620 can include one or more of the insulation displacement contacts 622 and a dielectric or electrically insulative connector housing 677 that is configured to support the one or more insulation displacement contacts 622. The connector housing 677 includes a dielectric or electrically insulative housing body 679 that defines an inner surface 679*a* and an outer surface 679*b* opposite the inner surface 679*a*. As will now be described, the insulation displacement contacts 622 are received in an anterior of the connector housing 677 that is defined by the inner surface 679*a*. The housing body 679 includes an upper wall 685 and first and second outer walls 687*a* and 687*b* that extends down from the upper wall 685 along the transverse direction T. The first and second outer walls 687*a* and 687*b* are spaced from each other along the longitudinal direction L. The connector housing 677 is configured to receive the insulation displacement contacts such that the first and second arms 650 and 652 of the insulation displacement contact 622 are configured to be received between the first and second outer walls 687*a* and 687*b*. In particular, the inner surface 679*a* of the first and second outer walls 687*a* and 687*b* faces each of the insulation displacement contacts 622 that are supported by the connector housing 677. The housing body 679 can further include a third wall 687*c* that extends down from the upper wall 685 at a location between the first and second outer walls 687*a* and 687*b*. Thus, the third wall 687*c* can be referred to as a middle wall. The third wall 687*c* can be equidistantly spaced between the first and second outer walls 687*a* and 687*b* along the longitudinal direction L.

The inner surface 679*a* of the housing body 679 at the upper wall 685, the first outer wall 687*a*, and the third wall 687*c* can combine to define a first inverted, or downward facing, concavity along the longitudinal direction L. The inner surface 679*a* of the housing body 679 at the upper wall 685, the second outer wall 687*b*, and the third wall 687*c* can combine to define a second inverted, or downward facing, concavity along the longitudinal direction L. The first, second, and third walls 687*a-c* and the upper wall 685 can all be monolithic with each other. For instance, the housing body 679 can be elongate along the lateral direction A. In accordance with one embodiment, the housing body 679 can be formed from extruded plastic or other suitable electrically insulative material. When the insulation displacement contact 622 is received by the connector housing 677, the first and second arms 650 and 652 are received by the first and second concavities. The third wall 687*c* is received between the inner regions 670*a* and 671*a* along the longitudinal direction L.

The connector housing 677 and each of the insulation displacement contacts 622 can include a respective at least one engagement member 691 and 693 that engage each other so as to removably retain the insulation displacement contacts 622 supported by the connector housing 677. The engagement members can be configured as desired. For instance, one of the engagement members 691 and 693 can be configured as protrusions, and the other of the engagement members 691 and 693 can be configured as recesses configured to receive the protrusions. In accordance with the illustrated embodiment, the at least one engagement member 691 of the connector housing 677 projects the out from the inner surface 679*a* and into a respective one of the concavities. For instance, the at least one engagement member 691 can project out from the inner surface 679*a* of the third wall 687*c*. In accordance with one embodiment, the connector housing 677 can include first and second engagement members 691 that project out from opposed inner surface 679*a* of the third wall 687*c* into the first and second concavities, respectively. The at least one engagement member 693 of the insulation displacement contact 622 can be recessed into the contact body 623. For example, the insulation displacement contact 622 can include first and second engagement members 693 that are recessed into opposed surfaces along the longitudinal direction L of the third wall 687*c*.

Thus, when the insulation displacement contacts 622 are supported by the connector housing 677, the projections are inserted into the recesses, thereby retaining the insulation displacement contacts 622 supported by the connector housing 677. When the insulation displacement contacts 622 are supported by the connector housing 677, the first and second arms 650 and 652 of the insulation displacement contacts 622 are disposed between the first and second walls 687*a* and 687*b* of the connector housing 677 with respect to the longitudinal direction L. Further, when the insulation displacement contacts 622 are supported by the connector housing 677, the third wall 687*c* of the connector housing 677 is disposed between the first and second arms 650 and 652 of the insulation displacement contacts 622, and in particular is disposed between the first and second inner regions 670*a* and 671*a*. Furthermore, the third wall 687*c* can seat against the bridge 627. As illustrated in FIG. 7P, when the insulation displacement contacts 622 are supported by the connector housing such that the engagement members 691 and 693 engage each other, the base segments 640*a* and 640*b* extend along the longitudinal direction L under the respective first and second outer walls 687*a* and 687*b*. Thus, the first and second walls 687*a* and 687*b* are disposed between longitudinally outermost ends of the first and second base segments 640*a* and 640*b*. As illustrated in FIGS. 8A-8F, when the insulation displacement contact 622 includes mounting tails 675 that extends down relative to the base 640 along the transverse direction T, the mounting tails 675 can extend down with respect to the first and second outer walls 687*a* and 687*b* along the transverse direction T when the insulation displacement contact 622 is supported by the connector housing 677.

During operation, the insulation displacement contacts 622 are supported by the connector housing 677 such that the engagement members 691 and 693 engage each other. The insulation displacement contacts 622 supported by the connector housing 677 can be spaced from each other any distance along the longitudinal direction L as desired. The connector housing 677 can be moved toward the underlying complementary electrical component 630 until the base 640 is placed adjacent the respective electrically conductive mounting pad of the complementary electrical component 630. A solder reflow can then attach the base 640 to the mounting pads of the complementary electrical component 630. When the insulation displacement contacts 622 include mounting tails 675, the mounting tails 675 can be inserted, for instance press-fit, into the respective apertures of the complementary electrical component 630. As described above, the apertures can be at least partially defined by an electrically conductive material, such that press-fitting the mounting tails 675 into the apertures places the insulation displacement contact 622 in electrical communication with the substrate. An upward removal force can then be applied to the connector housing 677 in the upward direction, which causes the engagement members 691 and 693 to disengage, and further causes the connector housing 677 to be removed from the insulation displacement contacts 622. The electrical cables can then be inserted into the insulation displacement slots 651 and 653 and strain relief apertures 673 and 681 of respective ones of the insulation displacement contacts 622.

A method can be provided for selling one or more of the insulation displacement contacts 622, the electrical connector assembly 620, the method including the steps of teaching to a third party one or more method steps of using or assembling one or more of the insulation displacement contacts 622 and the electrical connector assembly 620, and selling to the third party at least one or more of the insulation displacement contacts 622 and the electrical connector assembly 620, either with the insulation displacement contacts 622 supported by the connector housing 677 or separate from the connector housing 677.

Referring now to FIGS. 9A-9B, the insulation displacement contact 622 can define a mating portion 624 and a mounting portion 626 as described above with respect to FIG. 7A. The electrical connector assembly 620 can further include at least one electrical cable 628 such as a plurality of electrical cables 628 that are each configured to mate with a respective one of the insulation displacement contacts 622 at the mating portion 624, and a complementary electrical component 630 (see FIG. 7A) such as a substrate, for instance a printed circuit board. The insulation displacement contacts 622, and in particular the mounting portions 626, are configured to be mounted to the substrate so as to place the insulation displacement contacts 622 in electrical communication with the substrate. The electrical connector assembly 620 can further include one or more dielectric or electrically insulative connector housings # each configured to receive the electrical cables 628 at one end, and at least one of the insulation displacement contacts 622, such as a plurality of the insulation displacement contacts 622, at a second end opposite the first end, such that the insulation displacement contacts 622 are configured to mate with the electrical cables 628 in the connector housing #.

As described above, the first outer region 670*b* of the first arm 650 can extend monolithically up from the base 640 along the transverse direction T. As illustrated in FIGS. 9A-9B, the base 640 can extend along the longitudinal direction to a location at least aligned with the second outer region 671*b* of the second arm 652. For instance, a portion of the base 640 can be disposed outward of the second outer region 671*b* along the longitudinal direction L. Accordingly, the second outer region 671*b* is disposed between the first outer region 670*b* and the portion of the base 640 that is disposed outward of the second outer region 671*b* along the longitudinal direction L. Thus, the bridge 627, and each the first and second insulation displacement slots 651 and 653 can be aligned with the base 640 along the transverse direction T. Further, the second outer region 671*b* can be aligned with the base 640 along the transverse direction T.

The first outer region 670*b* can extend up from the base 640, and the second outer region 671*b* can be attached to the base 640. For instance, the base 640 can define a slot 678 that extends at least into the inner surface 644 in the downward direction, which is along the transverse direction T, toward the outer contact surface 642. In accordance with one embodiment, the slot 678 extends through the outer contact surface 642. Thus, the mounting portion 626 can define the slot 678 that extends through the base 640 along the transverse direction T from the inner surface 644 to the outer contact surface 642. The second arm 652 can include an attachment tab 671*c* that extends down from the second arm 652. For instance, the attachment tab 671*c* can extend down from the second outer region 671*b*. The attachment tab 671*c* is sized to be received in the slot 678. When the attachment tab 671*c* is disposed in the slot 678, mechanical interference between the base 640 and the attachment tab 671*c* prevents movement of the second outer region 671*b* toward and away from the first arm 650 along the longitudinal direction L. Thus, insertion of the attachment tab 671*c* in the slot 678 can limit or prevent movement of the first and second arms 650 and 652 relative to the base 640, depending on the size of the slot 678 relative to the size of the attachment tab 671*c*.

Referring now to FIGS. 9A-9E, and as described above, the electrical connector assembly 620 can include one or more of the insulation displacement contacts 622 and a dielectric or electrically insulative connector housing 677 that is configured to support the one or more insulation displacement contacts 622. For instance, the connector housing 677 can be configured to receive the electrical cables 628 and the insulation displacement contacts 622, such that the insulation displacement contacts 622 mate with the electrical cables 628 in the interior of the connector housing 677. For instance, the electrical cables 628 can be inserted into the first and second strain relief apertures 673 and 681 and into the first and second insulation displacement slots 651 and 653 in the interior of the connector housing 677. As will now be described, the connector housing 677 is configured to receive the electrical cables 628 and the insulation displacement contacts 622 in opposite directions such that the electrical cables 628 mate with the insulation displacement contacts 622 inside the connector housing 677.

For instance, in accordance with one embodiment, the housing body 679, and thus the connector housing 677, defines at least one cable retention channel 690 such as a plurality of cable retention channels 690. The cable retention channels 690 can extend into the housing body 679 in the transverse direction T. For instance, the cable retention channels 690 can extend down into the upper wall 685 toward a lower end 682*a* of the housing body 679 that is opposite the upper wall 685 along the transverse direction T. The cable retention channels 690 can be open to an upper end 682*b* of the connector housing 677 that is opposite the lower end 682*a* of the connector housing 677 along the transverse direction T. The electrical cables 628 can thus be seated against the housing body 679 in the cable retention channels 690. The cable retention channels 690 can further extend through the first outer wall 687*a* along the longitudinal direction at least toward the second outer wall 687*b*. In accordance with one embodiment, the cable retention channels 690 terminate without passing through the second outer wall 687*b*. In another embodiment, the cable retention channels 690 can extend through both the first outer wall 687*a* and the second outer wall 687*b* along the longitudinal direction L.

Because the electrical cables 628 extend through the first outer wall 687*a* and are seated in the second outer wall 687*b* when disposed in the cable retention channels 690, the third wall 687*c* can be segmented along the lateral direction A.

Thus, the third wall 687*c* defines a plurality of third wall segments that are spaced from each other along the lateral direction A by a gap 694 that separates adjacent third wall segments from each other along the lateral direction A. The gaps 694 can be aligned with the cable retention channels 690 along the longitudinal direction such that the electrical cables seated in the cable retention channels 690 pass through the respective gaps 694.

The connector housing 677 can further include a plurality of divider walls 695 that extend from the first outer wall 687*a* to the second outer wall 687*b*. Adjacent divider walls 695 along the lateral direction A at least partially define respective pockets 698 that are each configured to receive a respective one of the insulation displacement contacts. The pockets 698 are open to the lower end 682*a* of the housing body 679, and thus of the connector housing 677. Thus, the connector housing 677 can be configured to receive the insulation displacement contacts 622 in the pockets 698 in the upward direction. Each of the pockets 698 can be defined by a pair of divider walls 695 that are adjacent each other along the lateral direction A, and further by the first and second outer walls 687*a* and 687*b*. Laterally outermost ones of the divider walls 695 can define end walls of the connector housing 677. The connector housing 677 can include a pair of third wall segments separated by one of the gaps 694 in each pocket 698.

As described above, at least one engagement member 691 can project out from the inner surfaces 697*a* of the third wall 687*c* in a direction toward one of the first outer wall 687*a* and the second outer wall 687*b*, respectively. For instance, one of the engagement members 691 can project out from the inner surfaces 697*a* of the third wall 687*c* in a direction toward the first outer wall 687*a* and the second outer wall 687*b*, respectively. In accordance with one embodiment, the connector housing 677 can include a first pair of engagement members 691 that extend out from the third wall 687*c* toward the first end wall 687*a* and are disposed on opposite sides of the gap 694 in the respective pocket 698. The connector housing 677 can include a first pair of engagement members 691 that extend out from the third wall 687*c* toward the second end wall 687*b*, and are disposed on opposite sides of the gap 694 in the respective pocket 698.

Thus, when the insulation displacement contacts 622 are supported by the connector housing 677, a first one of the third wall segments can be disposed between the first and second inner regions 670*a* and 671*a* of the first arm 650, and a second one of the third wall segments can be disposed between the first and second inner regions 670*a* and 671*a* of the second arm 652. The projections 691 can abut the insulation displacement contact 622 so as to assist in retention of the insulation displacement contact 622 in the respective pocket 698. For instance, the insulation displacement contact can include engagement members 693 as described above with respect to FIGS. 6A-6J. Further, when the at least one insulation displacement contact 622 is supported by the connector housing 677, the first arm 650 of the insulation displacement contact 622 is disposed between the first and third walls 687*a* and 687*c*, respectively, of the connector housing 677, and the second arm 652 of the insulation displacement contact 622 is disposed between the second and third walls 687*b* and 687*c*, respectively, of the connector housing 677.

During operation, the connector housing 677 can receive the insulation displacement contacts 622 in the upward direction from the lower end 682*a* toward the upper end 682*b* until the insulation displacement contacts 622 are disposed in respective ones of the pockets 698. Thus, the connector housing 677 is configured to support the insulation displacement contacts 622. The insulation displacement contacts 622 can be mounted to the complementary electrical component before insertion into the pockets 698 or after insertion into the pockets. When the insulation displacement contacts 622 are supported by the housing, the strain relief apertures 673 and 681 and the insulation displacement slots 651 and 653 are aligned with respective ones of the cable retention channels 690. Accordingly, insertion of the electrical cables 628 in the downward direction into the cable retention channels 690 can cause the electrical cables 628 to be inserted into the strain relief apertures 673 and 681 and the insulation displacement slots 651 and 653, thereby mating the insulation displacement contact 622 to the electrical cable 628 in the manner described above. Thus, the insulation displacement contacts 622 can mate with respective ones of the electrical cables 628 in an interior of the connector housing 677. The interior of the connector housing 677 can be defined by respective ones of the pockets 698. It should be appreciated that the electrical cables 628 can be inserted into the cable retention slots 690 before or after the insulation displacement contacts 622 have been inserted into the connector housing. It should be further appreciated that the connector housing 677 can be devoid of the divider walls 695 as desired.

As described above, a method can be provided for selling one or more of the insulation displacement contacts 622, the electrical connector assembly 620, the method including the steps of teaching to a third party one or more method steps of using or assembling one or more of the insulation displacement contacts 622 and the electrical connector assembly 620, and selling to the third party at least one or more of the insulation displacement contacts 622 and the electrical connector assembly 620, either with the insulation displacement contacts 622 supported by the connector housing 677 or separate from the connector housing 677.

The foregoing description is provided for the purpose of explanation and is not to be construed as limiting the invention. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the invention is not intended to be limited to the particulars disclosed herein. For instance, it should be appreciated that structure and methods described in association with one embodiment are equally applicable to all other embodiments described herein unless otherwise indicated. Thus, each insulation displacement contact can include one or more up to all features, including structure and methods, alone or in combination, as the other insulation displacement contacts as described herein. Those skilled in the relevant art, having the benefit of the teachings of this specification, may effect numerous modifications to the invention as described herein, and changes may be made without departing from the spirit and scope of the invention, for instance as set forth by the appended claims.

What is claimed:

1. An insulation displacement contact, comprising:

a mounting portion configured to mounted onto a substrate so as to place the insulation displacement contact in electrical communication with the substrate;

a first arm that extends out with respect to the mounting portion, the first arm comprising a first C-shaped hump having a first concavity facing the substrate when the mounting portion is mounted onto the substrate, and the first arm defining a first insulation displacement slot; and a second arm that extends out with respect to the mounting portion, the second arm comprising a second C-shaped hump having a second concavity facing the substrate when the mounting portion is mounted onto the substrate, and the second arm defining a second insulation displacement slot that is aligned with the first insulation displacement slot along a longitudinal direction so that when an electrical cable extends through both of the first and second insulation displacement slots along the longitudinal direction, respective first and second piercing members that at least partially define respective ones of the first and second insulation displacement slots pierce an outer electrically insulative layer of the electrical cable and contact an electrical conductor of the electrical cable that is disposed inside the electrically insulative layer, wherein the insulation displacement contact defines a strain relief aperture that extends through at least one of the first and second arms, the strain relief aperture being positioned such that one of the first and second insulation displacement slots is positioned between the other of the insulation displacement slots and the strain relief aperture, and opposed surface portions that at least partially define the strain relief aperture are configured to grip the outer electrically insulative layer without extending through the outer electrically insulative layer to the electrical conductor when the electrical cable extends through the both insulation displacement slots and the strain relief aperture.

2. The insulation displacement contact as recited in claim 1, wherein the strain relief aperture is a first strain relief aperture, the insulation displacement contact further comprising a second strain relief aperture that is defined by the other of the first and second arms, and each of the first and second insulation displacement slots are positioned between the first and second strain relief apertures, wherein opposed surface portions that at least partially define the second strain relief aperture grip the outer electrically insulative layer without extending through the outer electrically insulative layer to the electrical conductor when the electrical cable extends through the both insulation displacement slots and both strain relief apertures.

3. The insulation displacement contact as recited in claim 2, wherein the insulation displacement slots define a first width, and the strain relief apertures define a second width that is greater than the first width, the widths defined along a lateral direction that is perpendicular to the longitudinal direction.

4. The insulation displacement contact as recited in claim 1, wherein the first arm includes an inner region that defines the first insulation displacement slot, and an outer region that defines the strain relief aperture.

5. The insulation displacement contact as recited in claim 4, wherein the second arm includes an inner region that defines the second insulation displacement slot, and an outer region that defines a second strain relief aperture.

6. The insulation displacement contact as recited in claim 5, further comprising a bridge connected between the inner regions of the first and second arms are each attached to each other at the respective inner regions.

7. The insulation displacement contact as recited in claim 1, wherein each of the first and second insulation displacement slots is defined by opposed surfaces that are spaced from each other by a distance prior to insertion of the electrical cable in the first and second insulation displacement slots.

8. The insulation displacement contact as recited in claim 7, wherein the distance is zero.

9. The insulation displacement contact as recited in claim 7, wherein the distance is greater than zero.

10. The insulation displacement contact as recited in claim 1, wherein the mounting portion comprises a base that includes first and second base segments that are spaced from each other along the longitudinal direction, the first arm extends out with respect to the first base segment, and the second arm extends out with respect to the second base segment.

11. The insulation displacement contact as recited in claim 10, wherein each of the first and second arms includes an outer region and a respective inner region, and each of the outer regions is angled toward the respective inner region as it extends along a direction away from the base.

12. The insulation displacement contact as recited in claim 10, wherein each of the first and second base segments is segmented along a lateral direction that is perpendicular with respect to the longitudinal direction.

13. The insulation displacement contact as recited in claim 1, wherein the mounting portion comprises a base, such that the first arm extends monolithically out from the base, and the second arm is attached to the base.

14. The insulation displacement contact as recited in claim 1, wherein an entirety of the insulation displacement contact comprises a single monolithic structure.

15. The insulation displacement contact as recited in claim 1, wherein the mounting portion has a base that includes first and second base segments that are spaced from each other along the longitudinal direction, and the first base segment extends from the first arm in a direction opposite the second arm.

16. The insulation displacement contact as recited in claim 1, wherein the first arm includes a first inner region, and a first outer region that extends from the mounting portion to the first inner region, and the second arm includes a second inner region, and a second outer region that extends from the mounting portion to the second inner region.

17. The insulation displacement contact as recited in claim 1, wherein the first arm includes a first inner region, and a first outer region that extends from the mounting portion to the first inner region, and the second arm includes a second inner region, and a second outer region that extends from the mounting portion to the second inner region.

18. The insulation displacement contact as recited in claim 17, wherein the first outer region is angled toward the first inner region as it extends along a direction away from the mounting portion and the second outer region is angled toward the second inner region as it extends along a direction away from the mounting portion.

19. An electrical connector assembly comprising:

at least one insulation displacement contact as recited in claim 1; and an electrically insulative connector housing including a housing body that includes upper wall, and first and second walls that extend down from the upper wall, wherein the connector housing is configured to support the at least one insulation displacement contact such that the first and second arms of the insulation displacement contact are disposed between the first and second walls of the connector housing.

20. The electrical connector assembly as recited in claim 19, wherein the housing body further comprises a third wall that extends down from the upper wall at a location between the first and second wall of the connector housing.

21. The electrical connector assembly as recited in claim 20, wherein when the at least one insulation displacement contact is supported by the connector housing, the first arm of the insulation displacement contact is disposed between the first and third walls of the connector housing, and the second arm of the insulation displacement contact is disposed between the second and third walls of the connector housing.

22. The electrical connector assembly as recited in claim 19, wherein the mounting portion comprises a base that includes first and second base segments that are spaced from each other along the longitudinal direction, the first arm that extends out with respect to the first base segment, the second arm extends out with respect to the second base segment, and the first and second base segments extend below the first and second walls of the connector housing, such that the first and second walls of the connector housing are disposed between longitudinally outermost ends of the first and second base segments with respect to the longitudinal direction.

23. The electrical connector assembly as recited in claim 20, wherein the connector housing comprises at least one engagement member that extends out from the third wall so as to contact the insulation displacement contact that is supported by the connector housing.

24. An insulation displacement contact, comprising:

a mounting portion configured to mounted onto a substrate so as to place the insulation displacement contact in electrical communication with the substrate, the mounting portion having a base that includes first and second base segments that are spaced from each other along a longitudinal direction;

a first arm that extends out with respect to the first base segment, the first arm comprising a first C-shaped hump and having an inner region, and an outer region that is angled toward the inner region as it extends along a direction away from the base, and the first arm defining a first insulation displacement slot;

a second arm that extends out with respect to the second base segment, the second arm comprising a second C-shaped hump and having an inner region, and an outer region that is angled toward the inner region of the second arm as it extends along a direction away from the base, and the second arm defining a second insulation displacement slot, wherein the first base segment extends from the outer region of the first arm in a direction opposite the inner region of the first arm, and the first and second insulation displacement slots are aligned with each other along the longitudinal direction so that, when an electrical cable extends through both of the first and second insulation displacement slots along the longitudinal direction, respective first and second piercing members that at least partially define respective ones of the first and second insulation displacement slots pierce an outer electrically insulative layer of the electrical cable and contact an electrical conductor of the electrical cable that is disposed inside the electrically insulative layer; and an electrically insulative connector housing comprising a first wall, a second wall and a third wall disposed between the first wall and the second wall, the third wall being positioned between the first arm and the second arm.

25. The insulation displacement contact of claim 24, wherein the second base segment extends from the outer region of the second arm in a direction away from the inner region of the second arm.

26. The insulation displacement contact of claim 24, wherein the inner region of the first arm defines an inner surface that faces an inner surface of the outer region of the first arm, and the inner region of the second arm defines an inner surface that faces an inner surface of the outer region of the second arm.

27. The insulation displacement contact as recited in claim 24, wherein the electrically insulative connector housing comprises a first engagement member and the first arm comprises a second engagement member, wherein the first engagement member is configured to mate with the second engagement member.

28. The insulation displacement contact as recited in claim 27, wherein the first engagement member comprises a protrusion and the second engagement member comprises a recess.

* * * * *